United States Patent [19]

Merwarth

[11] 4,398,455

[45] Aug. 16, 1983

[54] STACKER-TYER

[75] Inventor: Richard J. Merwarth, Plattsburgh, N.Y.

[73] Assignee: Harris Corporation, Melbourne, Fla.

[21] Appl. No.: 279,670

[22] Filed: Jul. 1, 1981

[51] Int. Cl.[3] ..... B65B 13/00

[52] U.S. Cl. ..... 100/7; 100/3; 100/14; 100/26; 414/46; 414/47; 414/51; 414/78

[58] Field of Search ..... 100/3, 7, 14, 26; 271/188, 218; 414/46, 47, 51, 78

[56] References Cited

U.S. PATENT DOCUMENTS

| | | | |
|---|---|---|---|
| 2,672,079 | 3/1954 | Chandler . | |
| 3,450,275 | 6/1969 | Carlen . | |
| 3,479,932 | 11/1969 | Stal et al. . | |
| 3,480,503 | 11/1969 | Morrow et al. . | |
| 3,538,818 | 11/1970 | Birath . | |
| 3,851,773 | 12/1974 | Kluge et al. . | |
| 4,037,525 | 7/1977 | Sjogren . | |
| 4,139,191 | 2/1979 | Muller . | |
| 4,162,733 | 7/1979 | Wiseman | 414/78 |

FOREIGN PATENT DOCUMENTS

| | | | |
|---|---|---|---|
| 2419079 | 11/1975 | Fed. Rep. of Germany | 100/7 |

*Primary Examiner*—Billy J. Wilhite
*Attorney, Agent, or Firm*—Yount & Tarolli

[57] ABSTRACT

The disclosure relates to a stacker tyer for stacking newspapers received in a shingled stream from a printing press. A single centrally located stacker mechanism is flanked by a pair of compensators and outside of the compensators is a pair of tyers. Stacks are built in the stacker and moved laterally first to a compensator and then to a tying mechanism. Outside the tying mechanism are located a pair of delivery mechanisms which deliver the tied stack for further processing. The stacker is able to form either short stacks (bundles) or tall stacks (logs). In the case of bundles, the bundles may be either compensated or uncompensated; compensated logs are not built.

23 Claims, 42 Drawing Figures

54
56

300
158a
9
150
281
58
296
246
126
328
10
158h
11
11
158b
280
292
158g
268
378
316
158c
280
158p
262
271
380
316
158d
273
158e
290
260
373
283
276
9
256
282
264
10

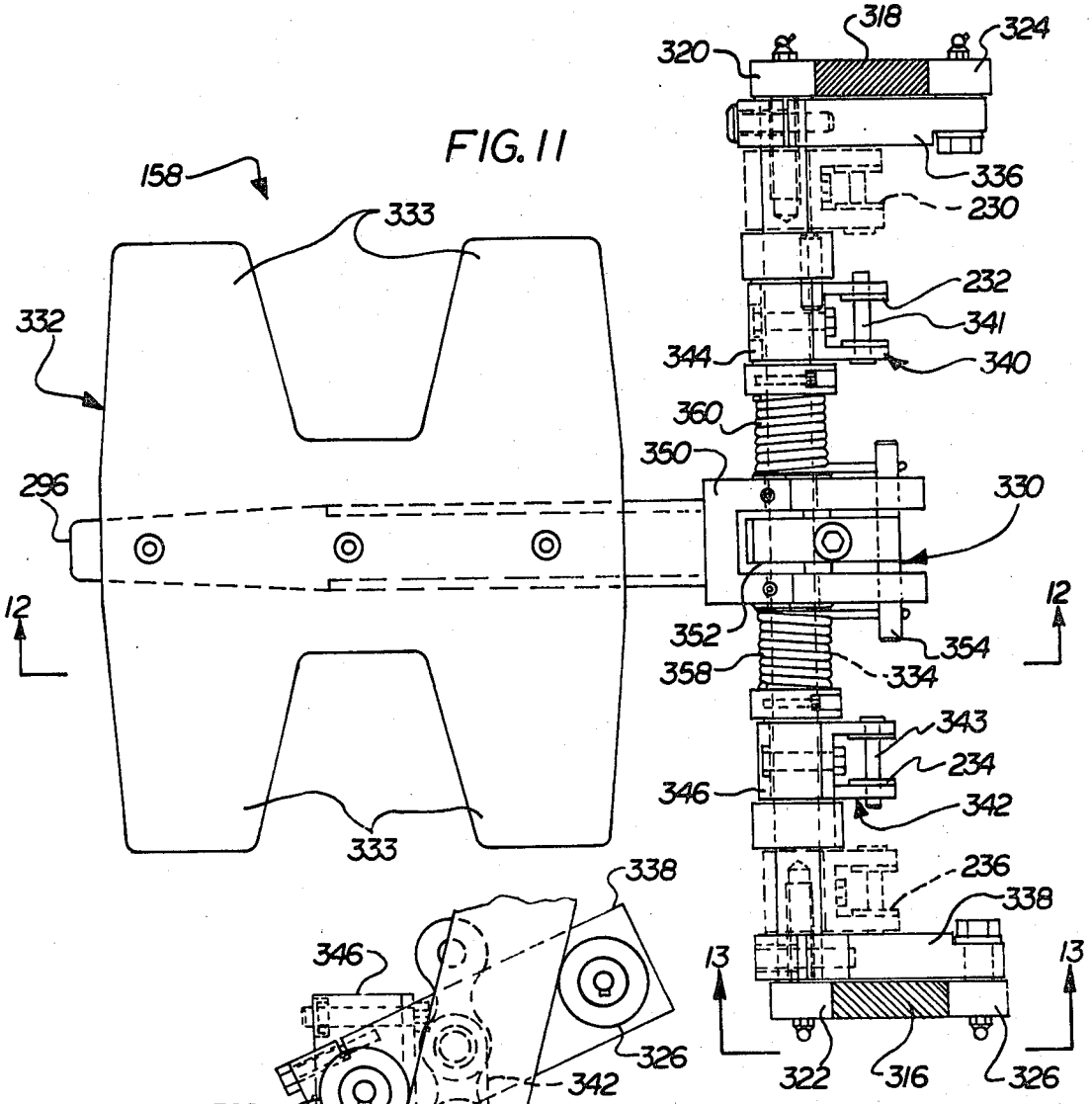
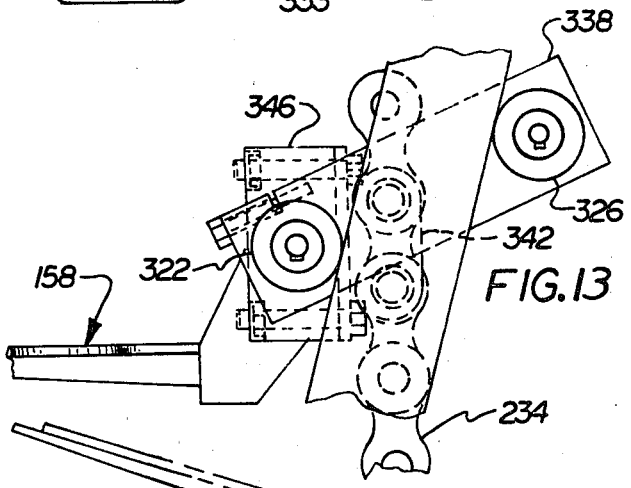
FIG. 13
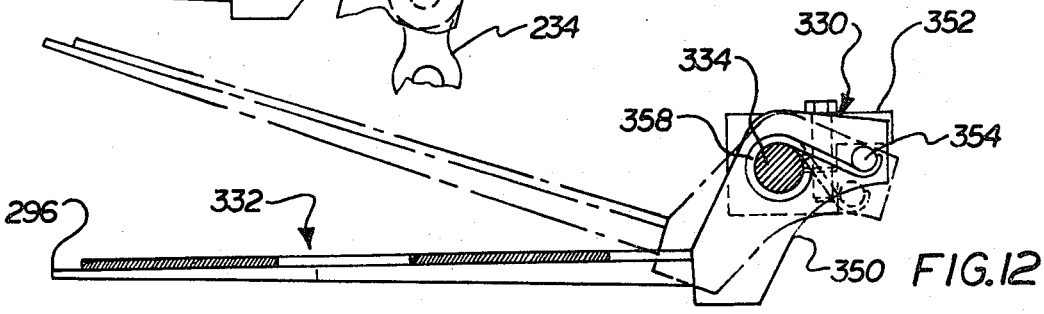
FIG. 12

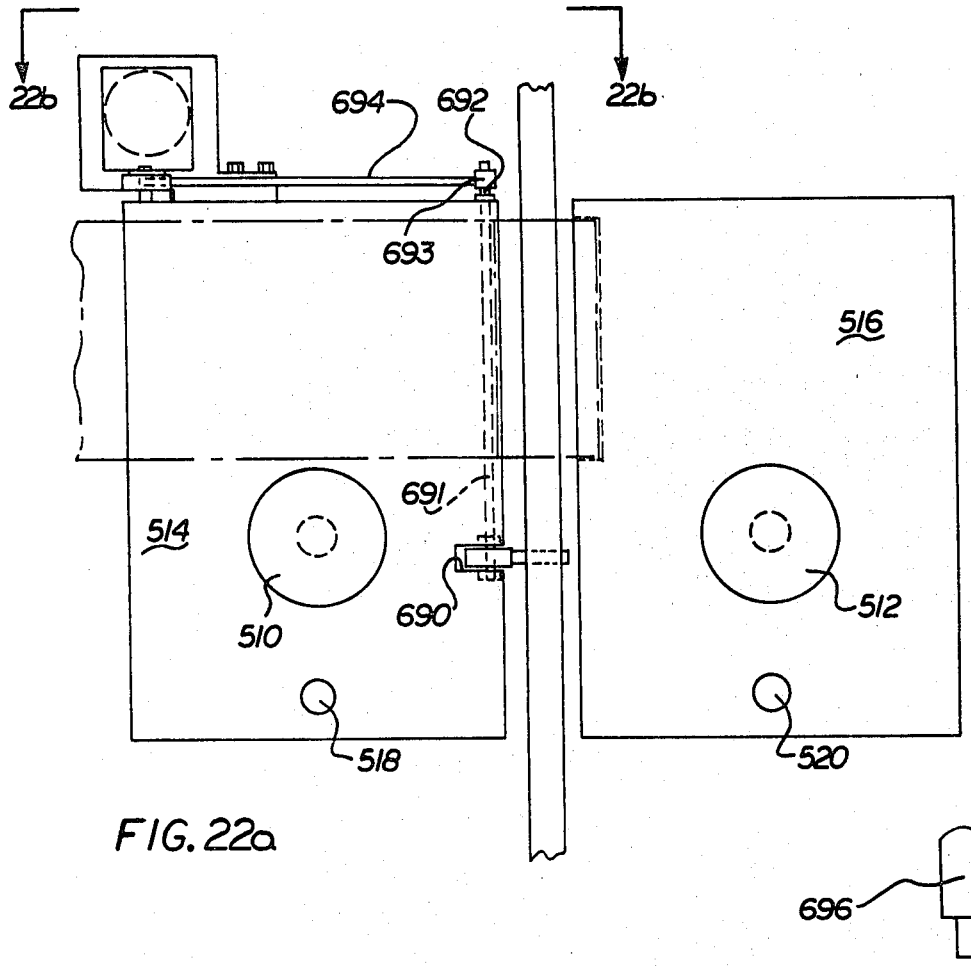
FIG. 22a
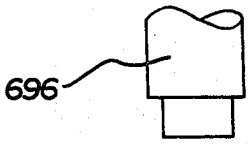
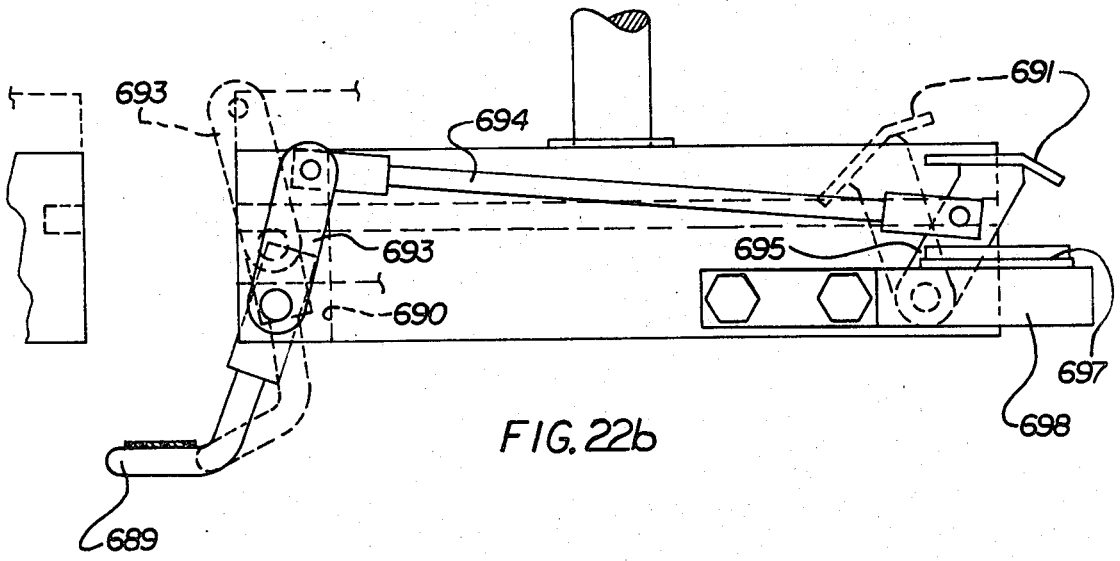
FIG. 22b

STACKER-TYER

BACKGROUND OF THE INVENTION

The present invention relates to a stacker-tyer capable of receiving a stream of sheet-like articles, forming the articles into a stack, and tying the stack.

Stackers for receiving signatures, newspapers, or other sheet-like articles in a stream and for forming them into stacks are well known. Typical are the stackers shown in U.S. Pat. Nos. 4,139,191; 4,037,525; 3,851,773; 3,538,818; 3,479,932; 3,450,275; 3,480,503; and 2,672,079. These stackers receive a stream of publications, form them into stacks and deposit them on a conveyor for subsequent handling. Known stackers can build stacks of a preselected count or number of publications, and the count selected may be adjustable. For example, stackers are known which are adjustable to form stacks of from 50 to 100 newspapers in each stack.

In some operations it is desirable to have the articles stacked in bundles up to about 12 inches high which are easily handled by an individual laborer. In other operations it is desirable to have the articles stacked to form logs up to 4 feet long which are easily handled by a forklift truck and which are suitable for feeding into automatic handling equipment. This would be the case in a newspaper printing plant where some sections of the newspaper are preprinted, e.g., the Sunday Magazine and advertising sections. These sections are thereafter collated with subsequently printed sections containing late news. The preprinted sections are stacked into logs which can be easily fed to an inserting or stuffing machine while the late news sections are fed directly from the press to a folder and then to the stuffing machine. On the other hand, a weekday paper may be printed all in a single press run, folded, and then stacked into bundles which can be easily handled by a delivery truck driver. To the applicant's knowledge, there is no single stacker which has the flexibility to form either bundles or logs.

Frequently, the stacks formed by a stacker are moved on a conveyor to a tying station where the stacks are tied prior to shipment. Commercially manufactured tyers are well known. One manufacturer of a tyer is the Signode Corporation, 2600 N. Western Avenue, Chicago, Illinois 60647. Tyers such as the ones made by Signode automatically feed a strap around a bundle, box, or other article, tighten the strap, cut the strap, and fasten the ends together.

One problem encountered in using a tyer in connection with a stacker which receives newspapers from a printing press concerns the speed of the tying operation relative to the speed of the press and stacker. A printing press at full speed can deliver over 70,000 newspapers per hour, and known stackers can handle this delivery rate. However, tyers can operate at only about one-half that speed, and as a result it is not uncommon to utilize two tyers with a single stacker.

Conveyor systems have been developed which alternately deliver stacks from the stacker to one or the other of two tyers. See, e.g., U.S. Pat. No. 4,037,525. However, these conveyor systems require a relatively large amount of floor space. Moreover, these conveyor systems have not proved entirely satisfactory because the conveyor itself may break down and because the stacks may become skewed or misaligned during movement on a conveyor from the stacker to the tyer, especially where the conveyor is operating at a speed fast enough to keep up with a stacker connected directly with a high speed press.

SUMMARY OF THE INVENTION

The present invention provides a stacker-tyer which receives a stream of sheet-like articles and forms them into either tall stacks (logs) or short stacks (bundles). Moreover, in an apparatus constructed according to the present invention two tyers are utilized, one located immediately adjacent each side of a stacker assembly, and the stacks (either bundles or logs) are shifted alternately from the stacker assembly laterally and directly into one or the other of the tyers. With the tyers right next to the stacker, lengthy conveyors are eliminated.

The stacker assembly of the present invention receives a stream of sheet-like articles from an overhead conveyor. The leading edge of each article hits a deflector and the articles drop to form a stack on a downwardly movable platform which supports the bottom of the stack. As the stack grows, the platform is moved downward, so that the top of the stack remains at approximately the same level.

The stacker also includes an upper and a lower stack support for receiving stacks from the movable platform. The upper stack support receives short stacks (bundles) from the movable platform. The upper stack support is removed when making tall stacks (logs). The tall stacks (logs) are received on the lower stack support from the movable platform. When the stack being built has a preselected number of sheet-like articles in it, the platform moves downward to the appropriate stack support where the stack is transferred from the platform to the stack support and moved laterally toward one or the other of the tyers.

The upper stack support extends laterally across the entire width of the two tyers and the stacker for building bundles. The platform supporting a bundle is moved downward as the bundle is built, and when the bundle is complete the platform moves rapidly to the level of the upper stack support. There the bundle is transferred from the platform to the upper stack support and then pushed laterally across the upper stack support into one of the other of the tyers where the bundle is compressed and tied.

When log-sized stacks are to be built, the upper stack support is removed. As articles pile on to build a log, the platform moves downward past the level where the upper stack support had been for receiving bundles. When a full log has been built, the platform moves downward rapidly to the level of the lower stack support. The log is transferred to the lower stack support and moved laterally toward a tyer (which has been adjusted to tie a log-sized stack). The tyer then compresses the log and ties it.

The stacker includes a series of platforms which move downward along a stacking path inclined from vertical. Movement of the platforms is coordinated so that when one stack has a preselected number of articles in it, the succeeding platform moves into position to intercept the incoming stream of articles and thus begin the succeeding stack.

As the stacks are completed, they are pushed laterally from the stacker into one or the other of the tyers by a shuttle mechanism with the bottom of the stacks resting on the stack support. The present invention eliminates conveyors between the stacker and the tyers and the problems associated with them. The resulting stacker-tyer is more compact and can operate at a higher speed than prior art devices.

The shuttle mechanism moves the stacks from the stacker to the tyers. The shuttle mechanism has pushers which engage two opposite sides of the stack to push the stack laterally while simultaneously keeping the stack in proper vertical alignment during movement. A third side of the stack is supported by skid plates which extend laterally parallel to the direction of movement of the stack. The skid plates are inclined slightly from vertical with the result that the stack leans against them. The skid plates extend the full length of the stacks and laterally from the stacker to each of the tyers. Thus, the pushers of shuttle mechanism and the skid plates support three sides of the stacks as they are moved across a stack support from the stacker to the tyer so that the stacks arrive at the tyers in vertical alignment and do not require realignment prior to tying.

BRIEF DESCRIPTION OF THE DRAWINGS

These and other advantages and features of the present invention will become clear from reading the following specification when taken together with the accompanying drawings which form a part thereof and in which:

FIG. 11 is a view taken along line 11—11 of FIG. 8;

FIG. 12 is a side view taken along line 12—12 of FIG. 11;

FIG. 13 is taken along line 13—13 of FIG. 11;

Figure 22:
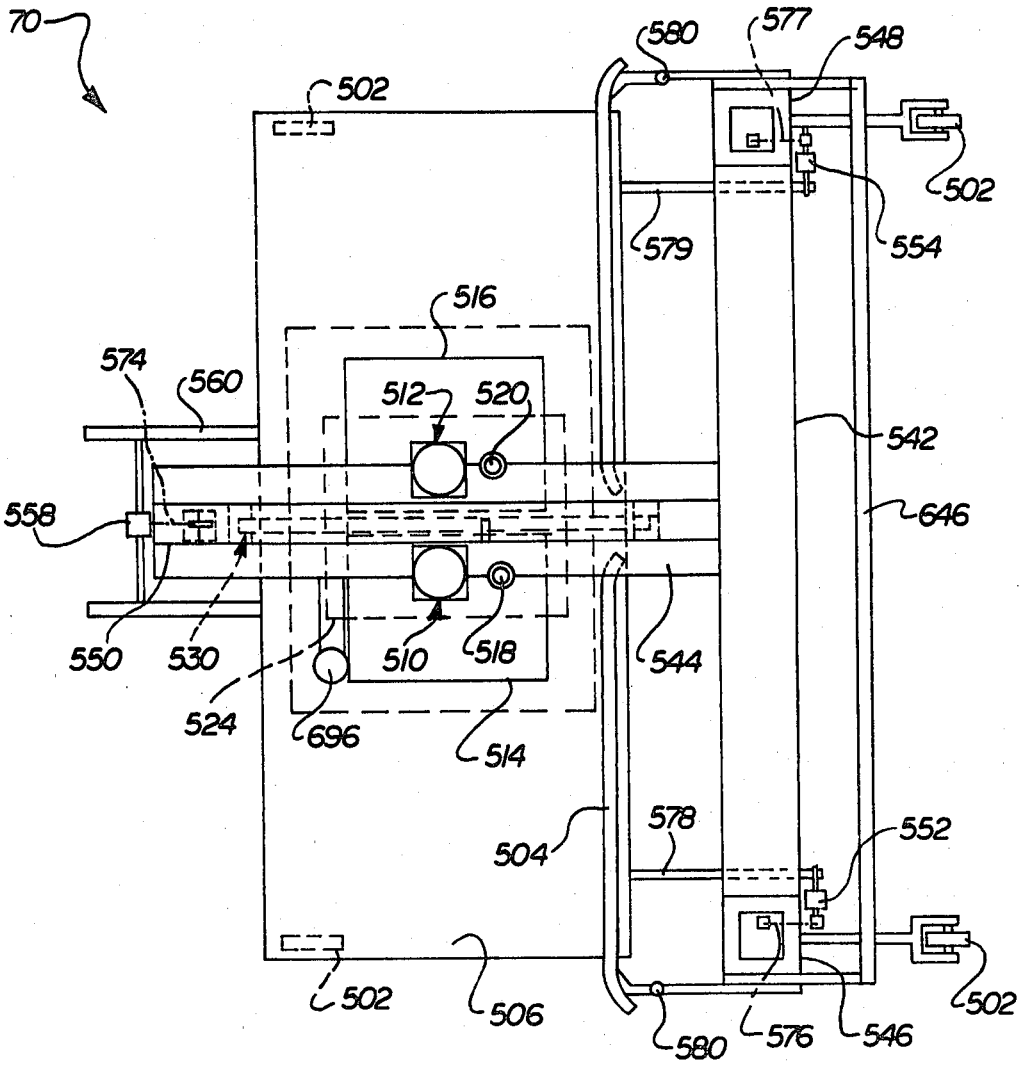
FIG. 22 is a plan view taken along line 22—22 of FIG. 18.

FIG. **22*a* is an enlarged view of a portion of the tyer assembly shown in FIG. 22**;

FIG. **22*b* is a plan view taken along lines 22*b*–22*b* of FIG. 22*a***.

Figure 1:
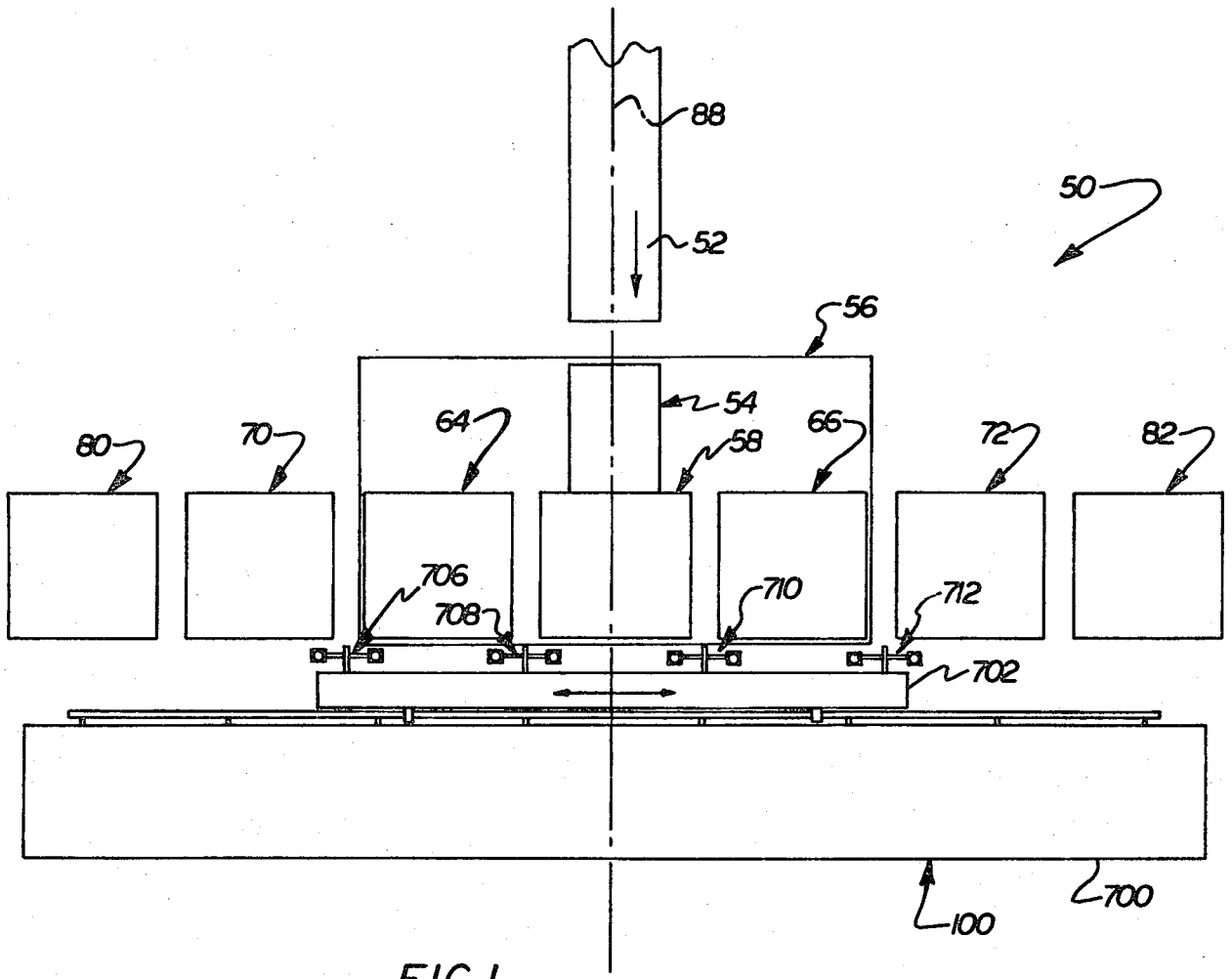
FIG. 1 is a schematic, plan view of a stacker-tyer constructed according to the present invention.
Figure 23:
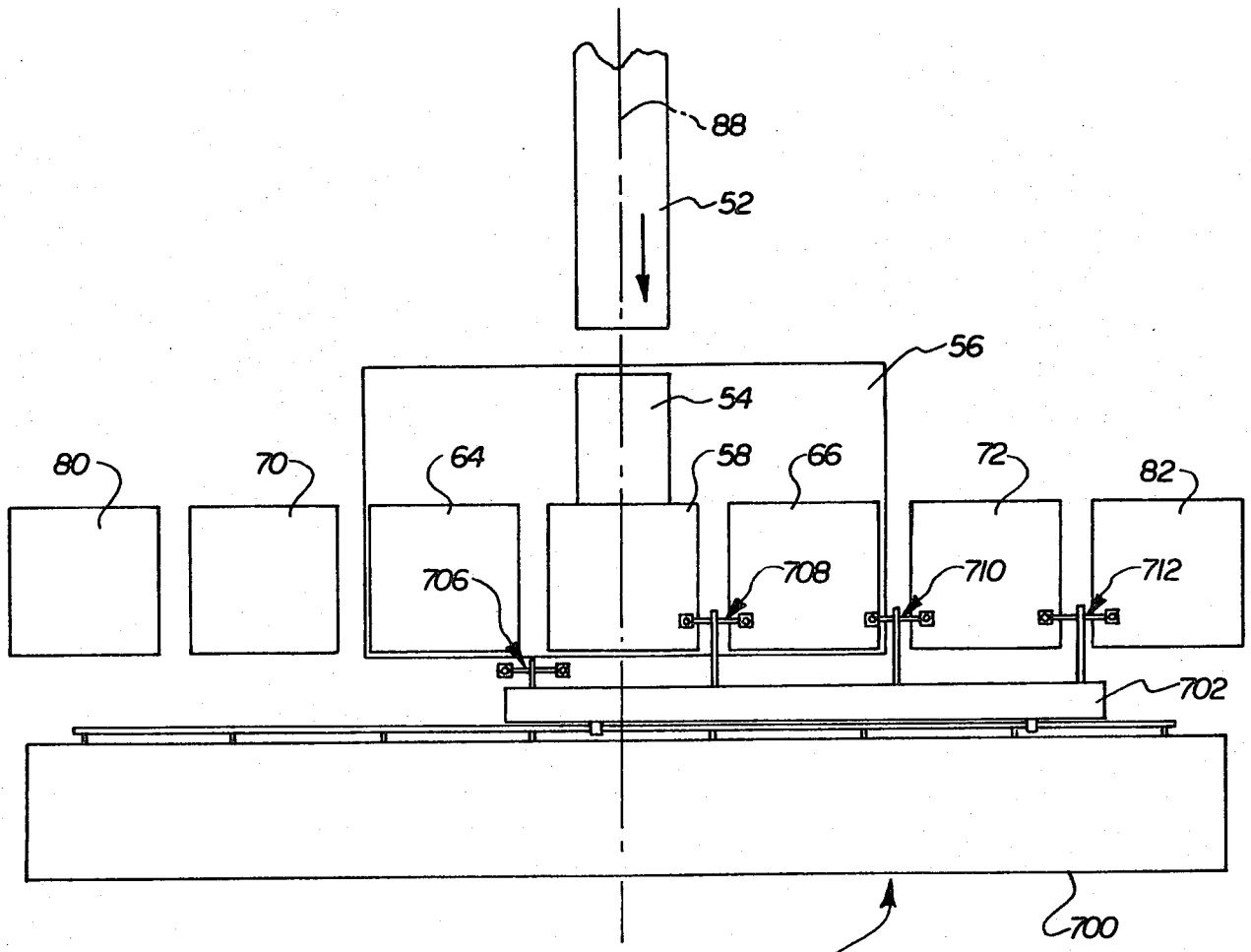
Figure 24:
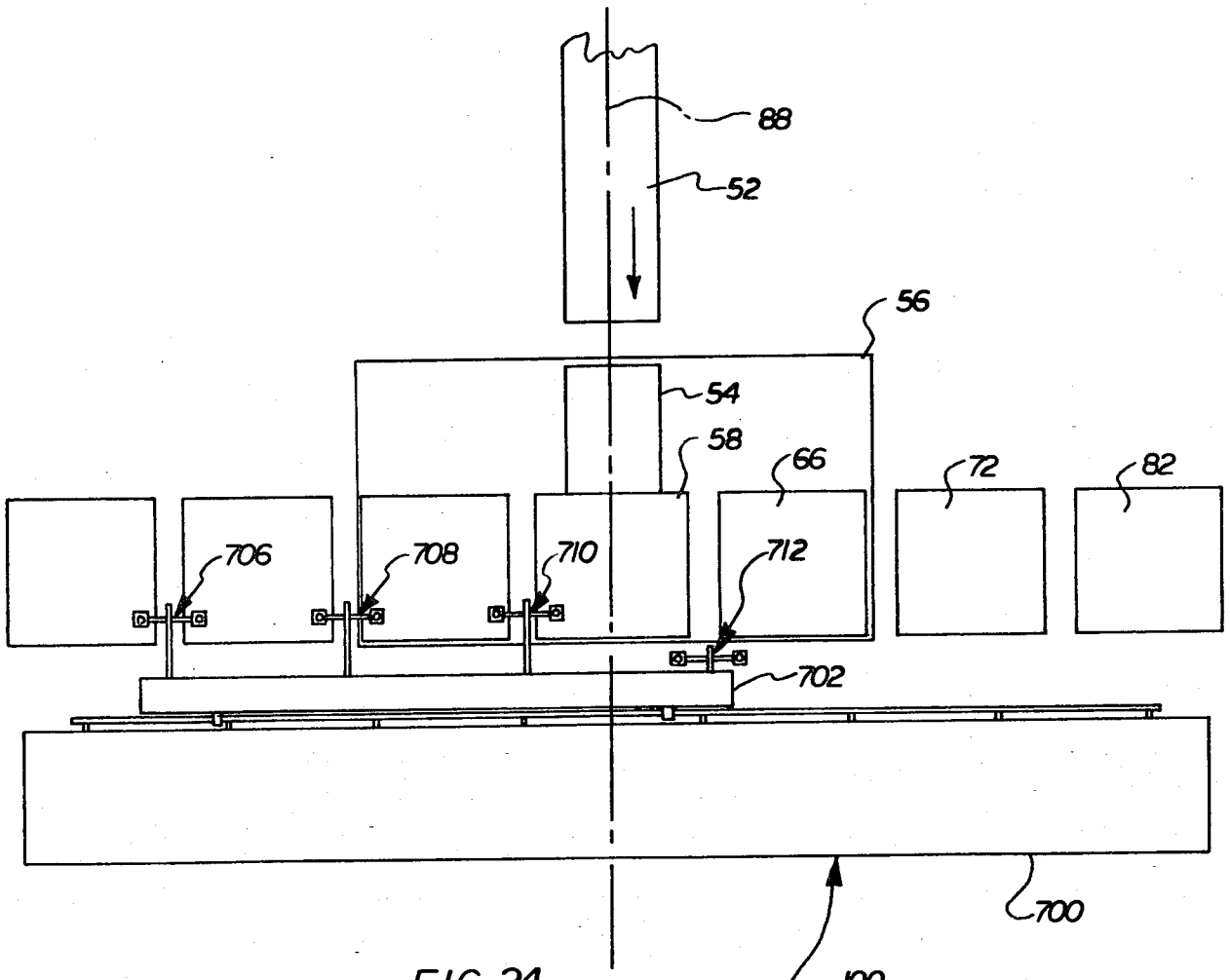
Figure 25:
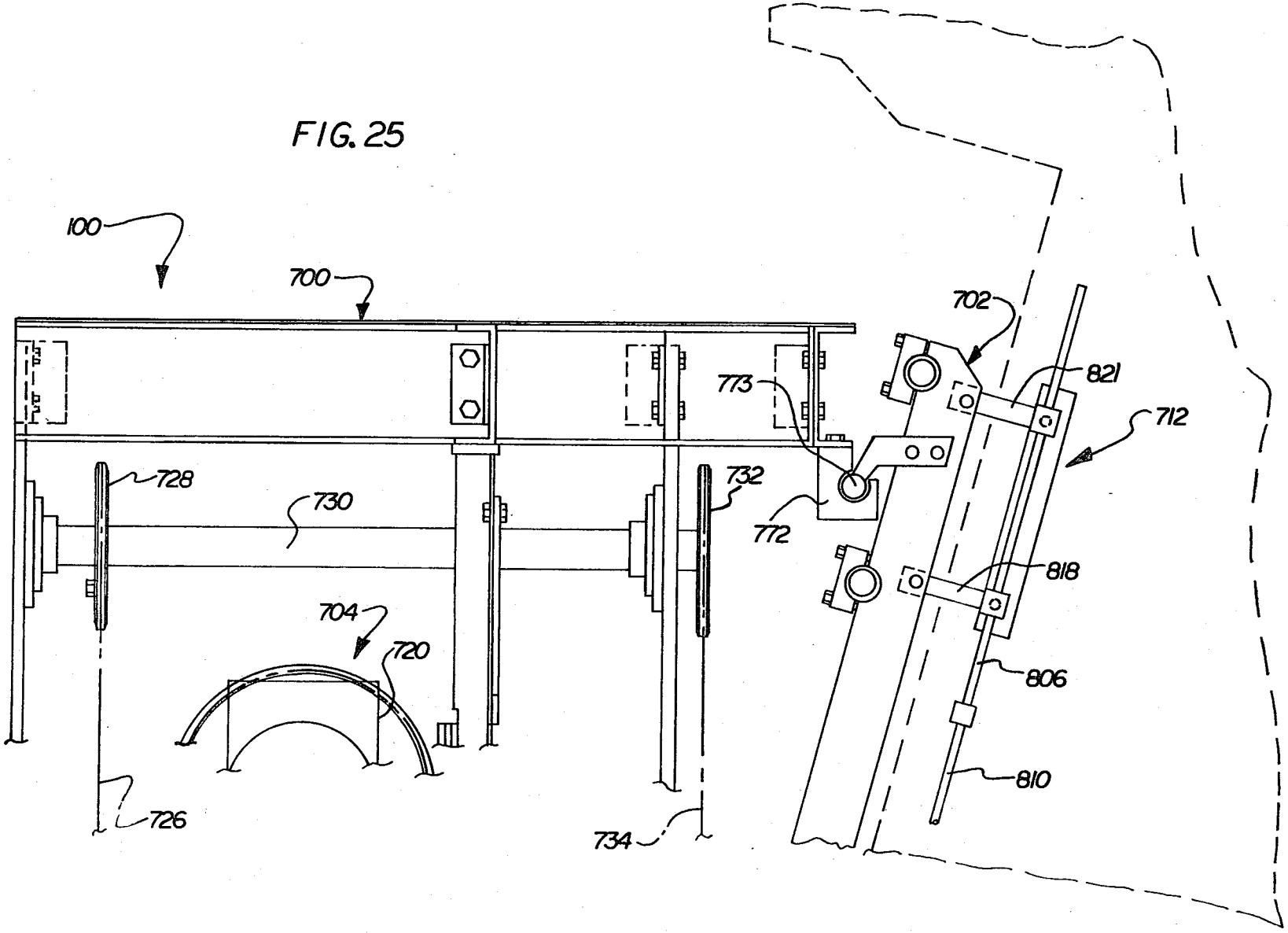
Figure 26:
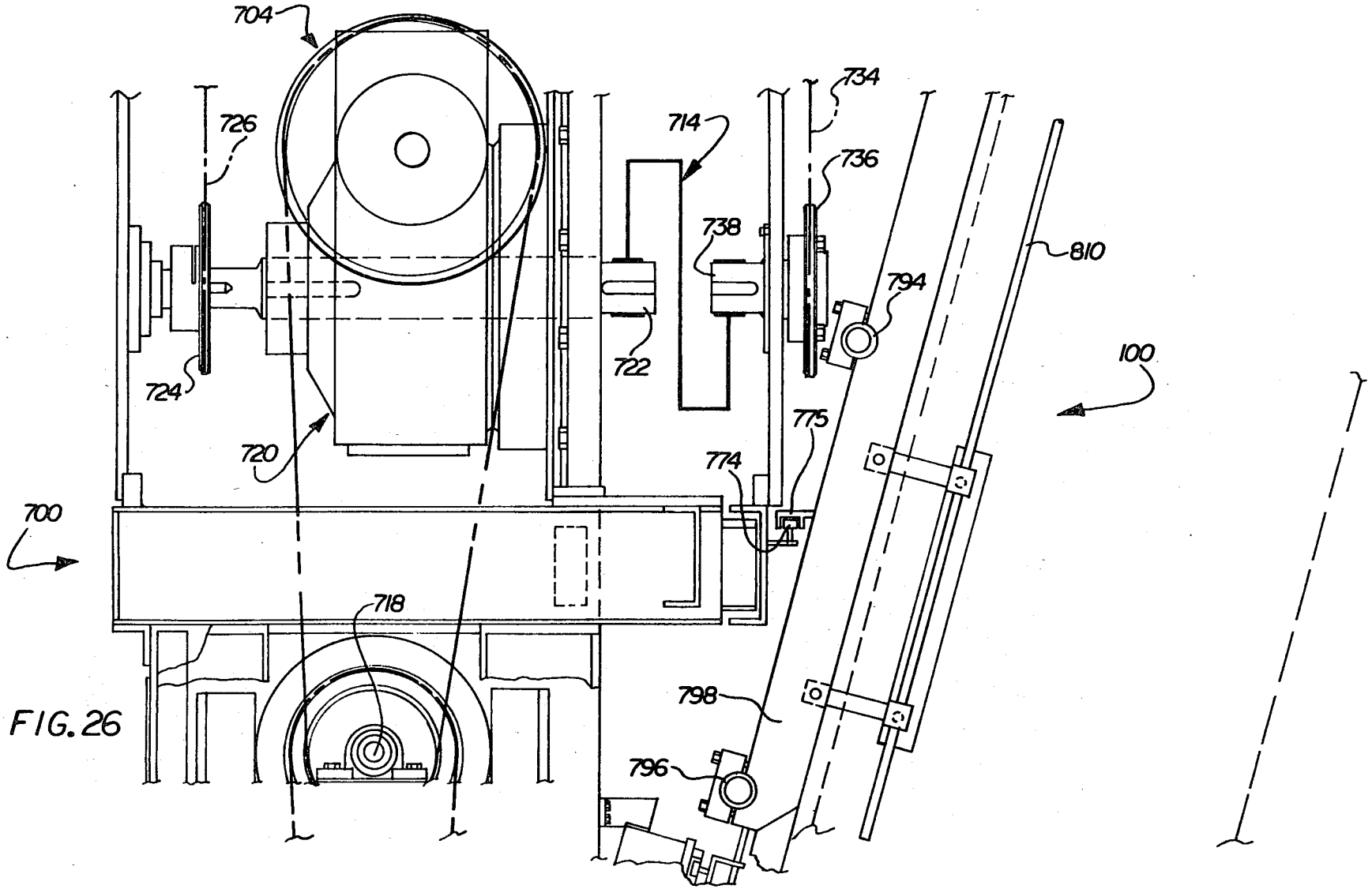
Figure 27:
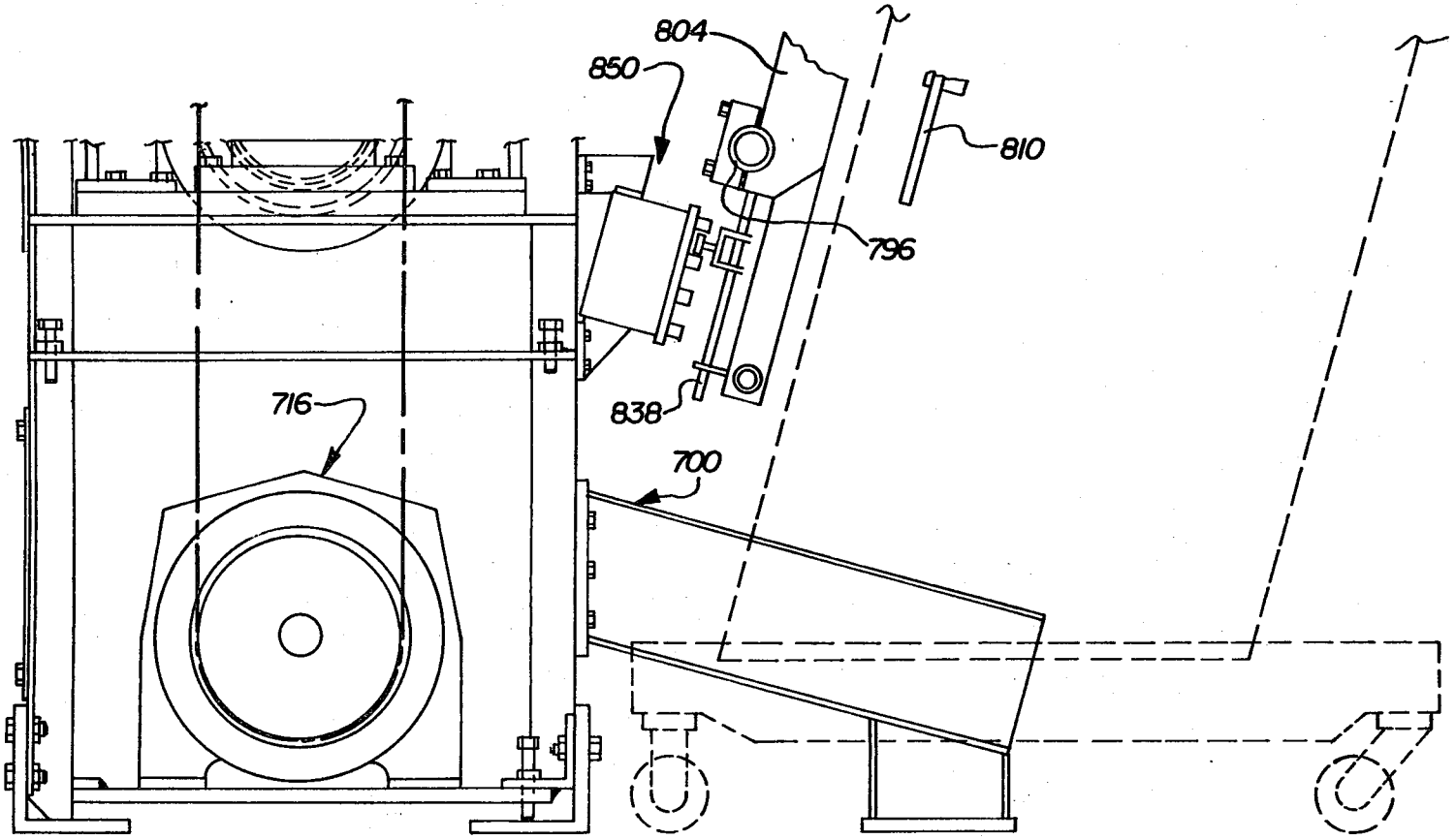
Figure 28:
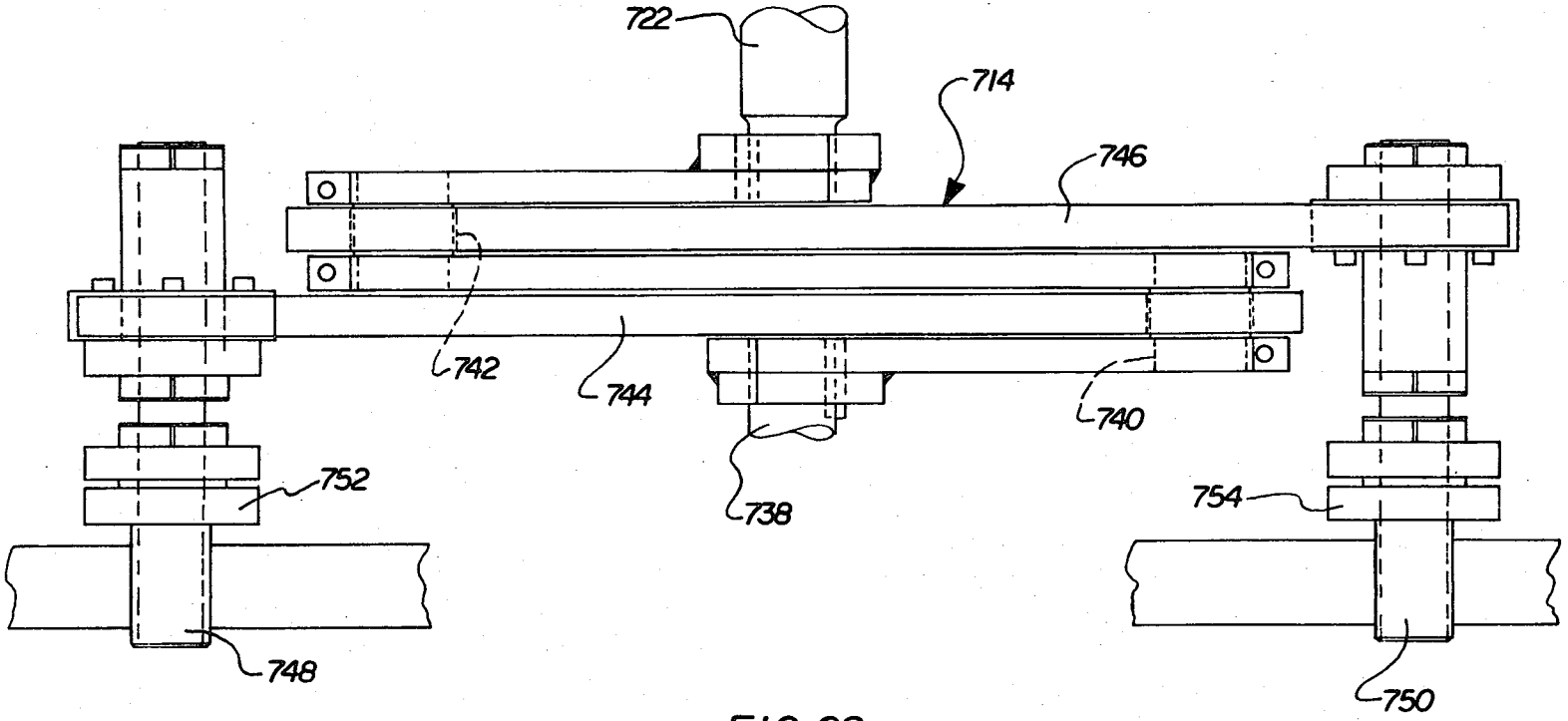
Figure 29:
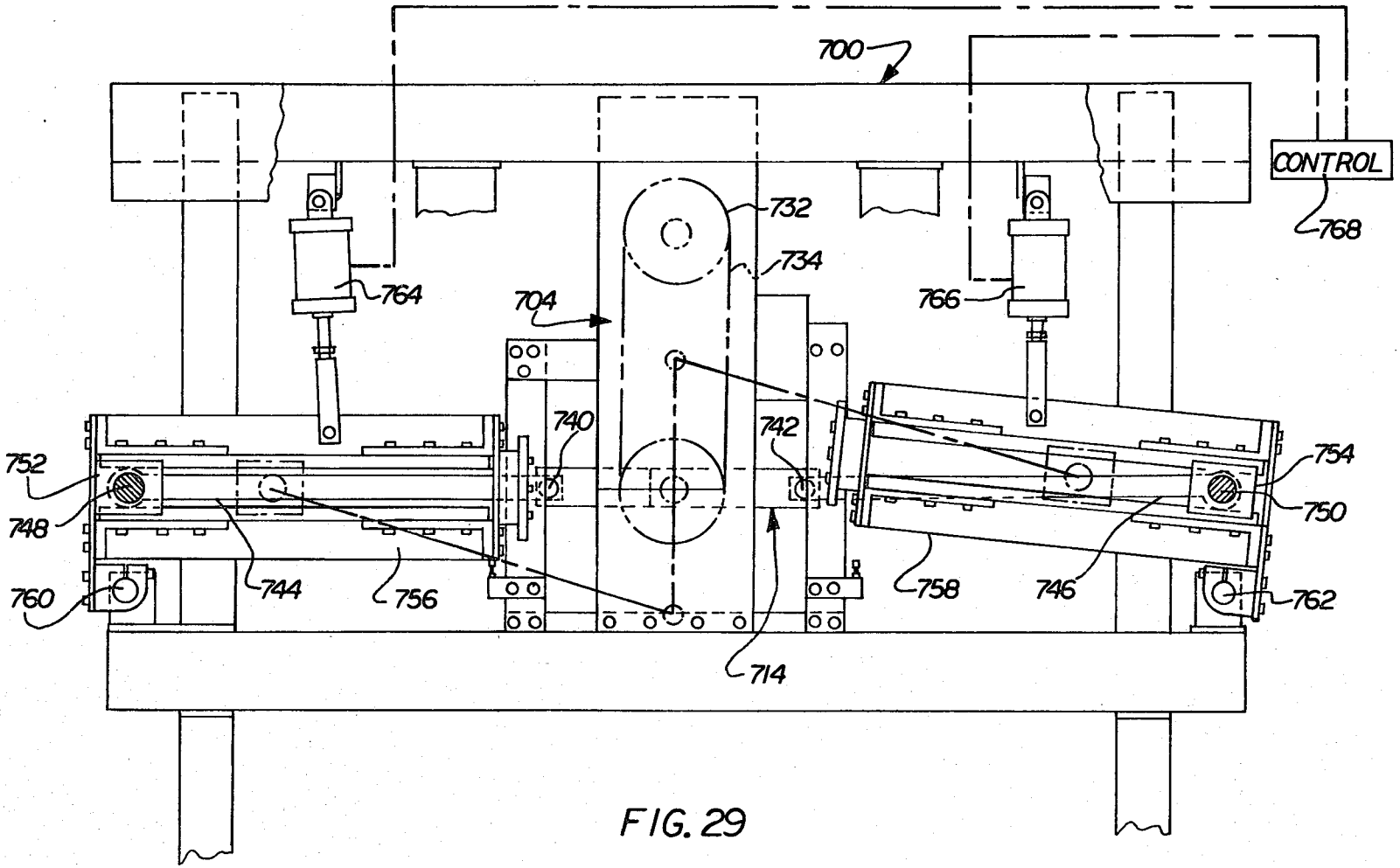
Figure 30:
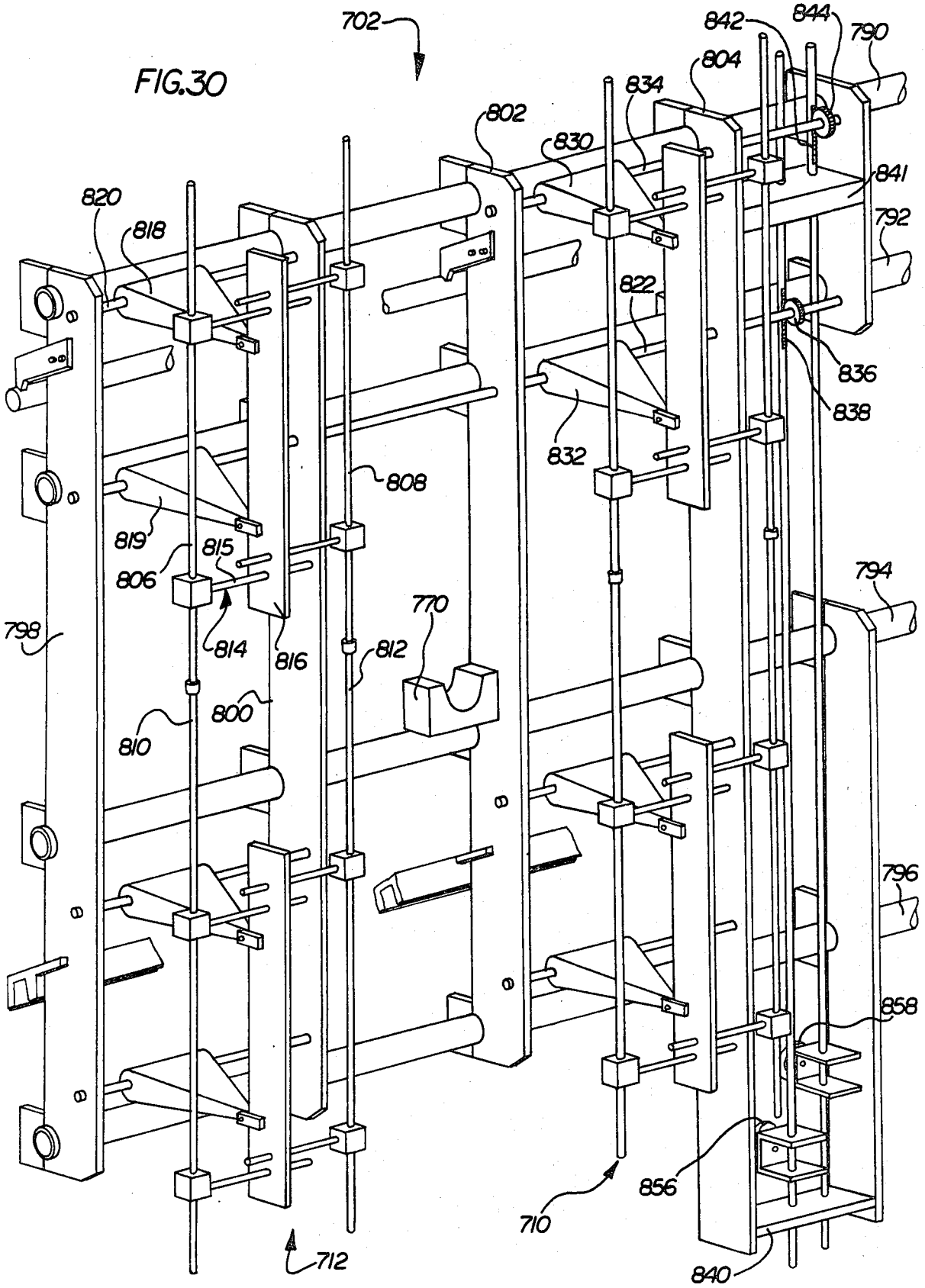
Figure 31:
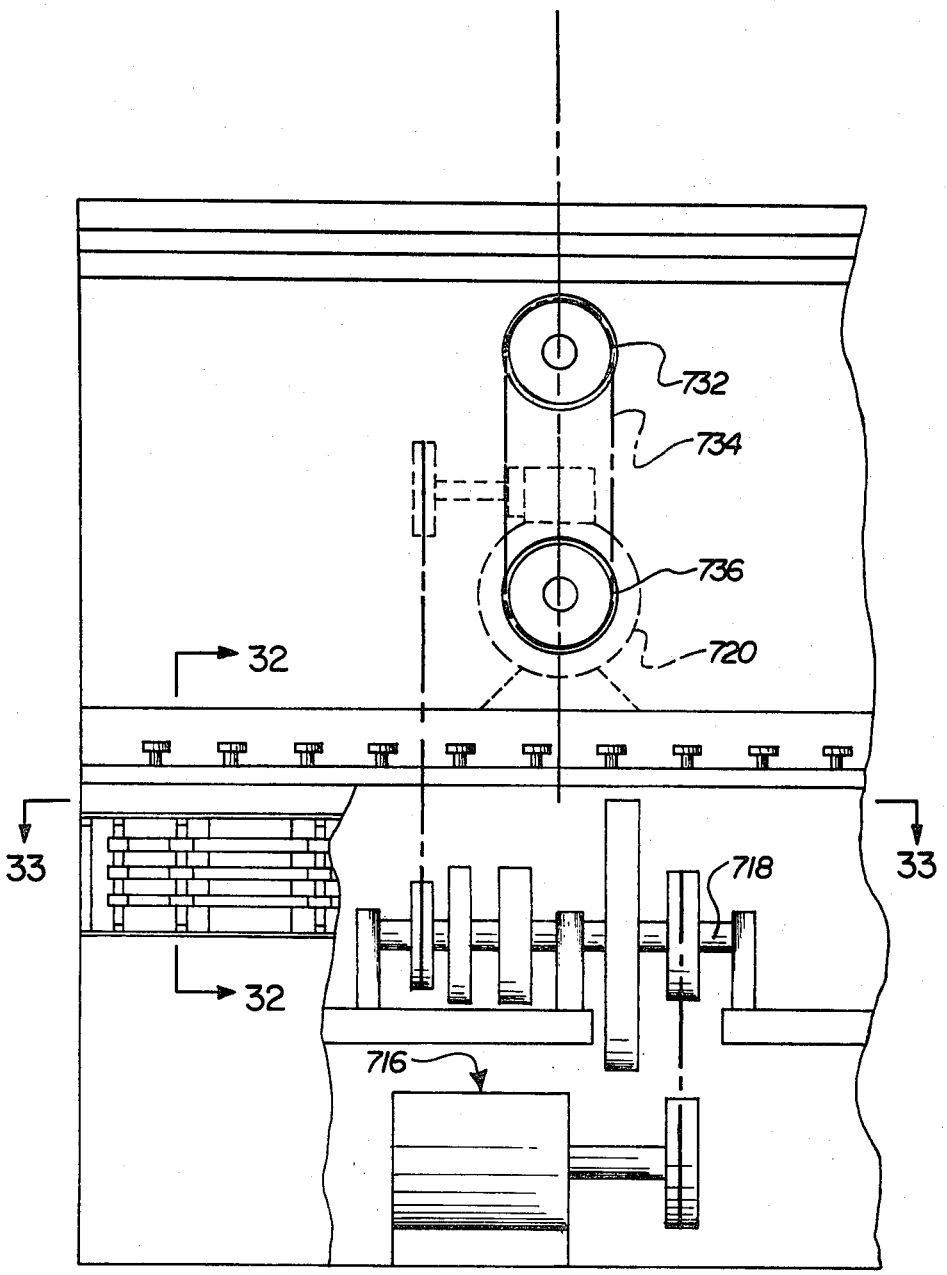
Figure 34:
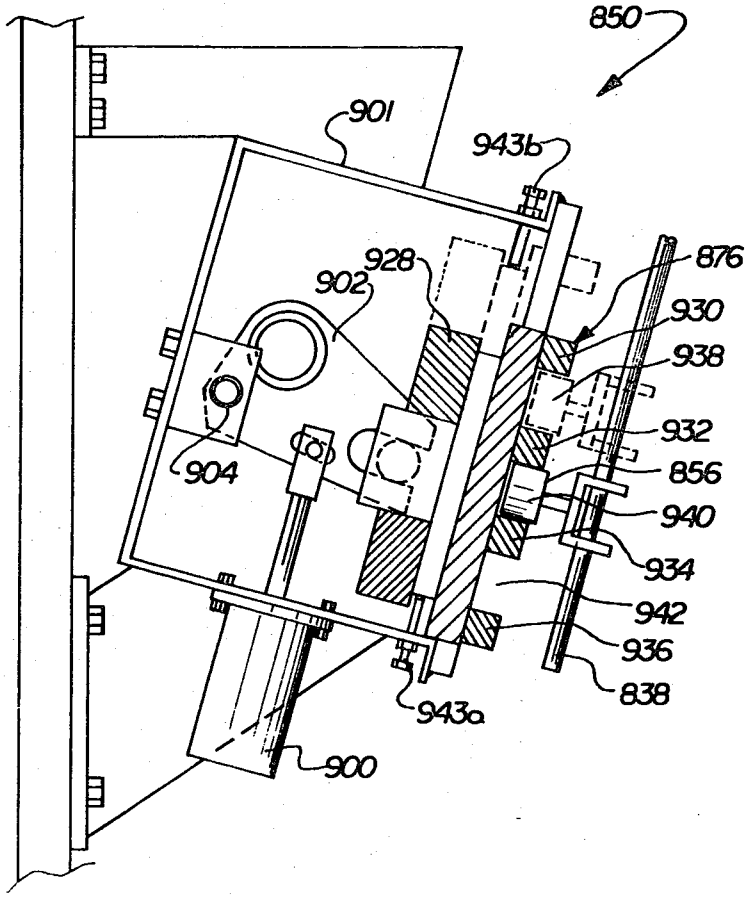
Figure 32:
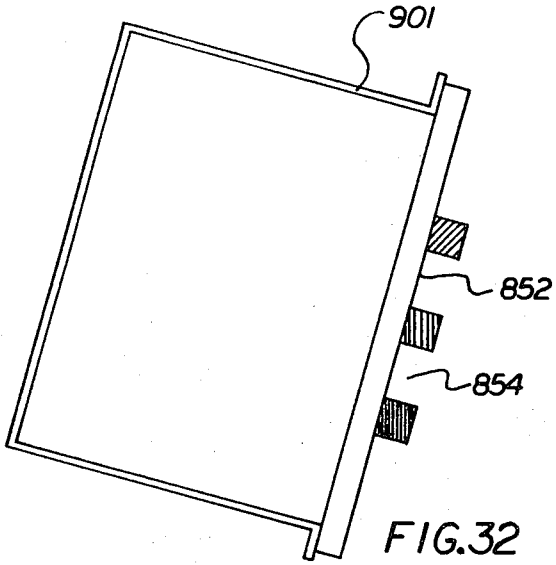
Figure 33:
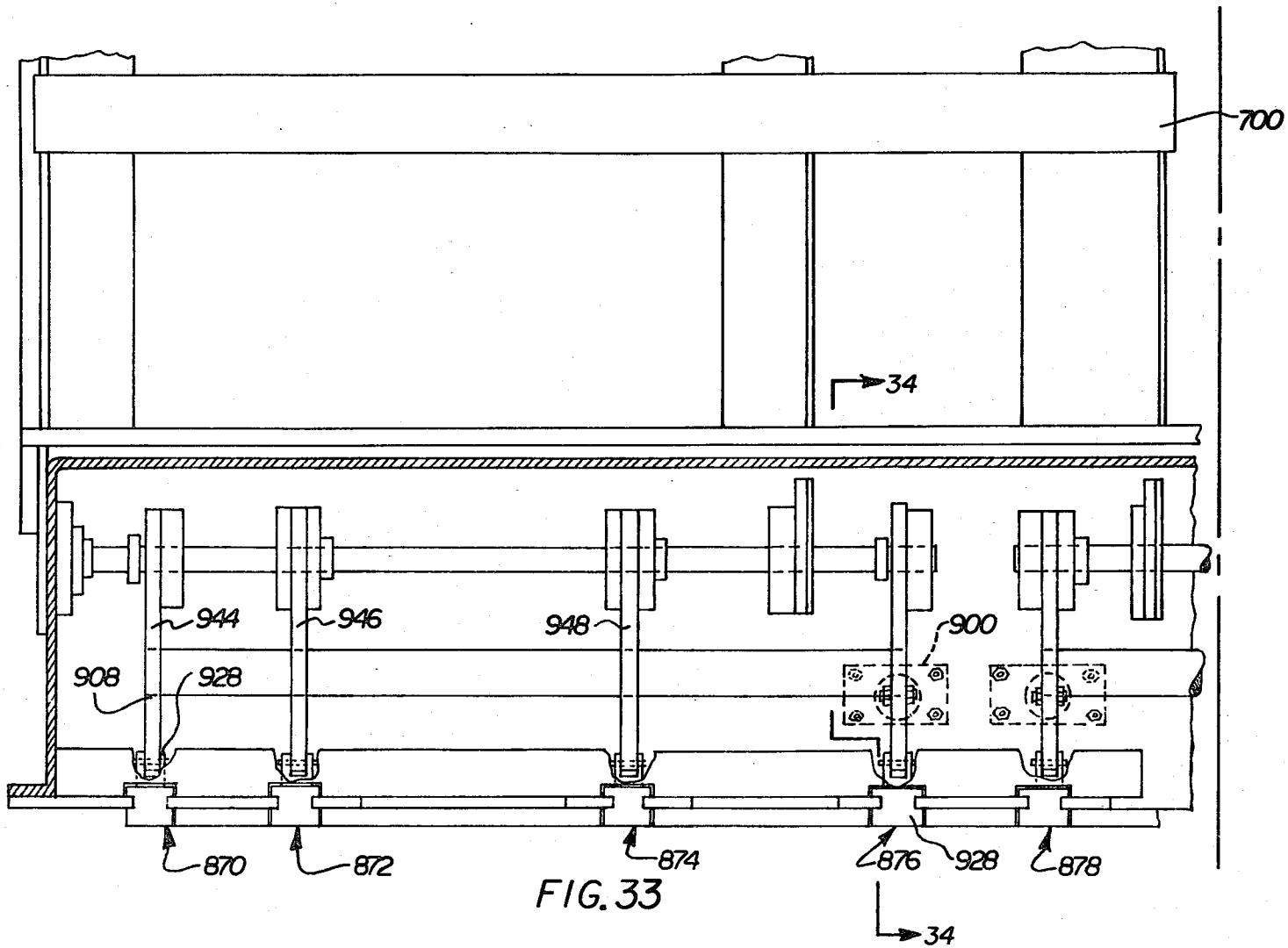

FIG. 23 is a schematic illustration of the stacker-tyer assembly of FIG. 1 showing a shuttle mechanism forming a part of the stacker-tyer assembly moved to one direction from a central position;

FIG. 24 is a schematic illustration generally similar to FIG. 23 but showing the shuttle mechanism moved in the opposite direction from a central position;

FIG. 25 is a partly schematic elevation view of an upper portion of the shuttle mechanism forming a part of the stacker-tyer illustrated in FIG. 1;

FIG. 26 is a partly schematic side elevation view of the middle portion of the shuttle mechanism of FIG. 25;

FIG. 27 is a partly schematic side elevation view of a lower portion of the shuttle mechanism illustrated in FIG. 25;

FIG. 28 illustrates a crank mechanism forming a part of the shuttle mechanism of FIGS. 25–27;

FIG. 29 is a partly schematic front elevation view of a portion of the shuttle mechanism illustrated in FIGS. 25–27;

FIG. 30 is a partly schematic perspective illustration of a portion of the shuttle mechanism illustrated in FIGS. 27–30;

FIGS. 31 is a partly schematic front elevation view of a portion of the shuttle mechanism illustrated in FIGS. 25–27;

FIG. 32 is a sectional view taken along line 32—32 of FIG. 31;

FIG. 33 is a sectional view taken along line 33—33 of FIG. 31;

FIG. 34 is a top plan view taken generally along line 34—34 of FIG. 33; and FIGS. 35A–35D show a portion of the shuttle mechanism illustrated in FIGS. 25–27 schematically in sequential operational positions.

DESCRIPTION OF PREFERRED EMBODIMENT

Overview

FIG. 1 illustrates a schematic plan view of a stacker-tyer 50 constructed in accordance with the present invention. The stacker-tyer 50 receives a stream of sheet-like articles from conveyor 52. In particular, it is contemplated that the conveyor 52 delivers folded newspapers comprising one or more sections and that the newspapers arrive in a shingled stream directly from a conventional folder or stuffer. The stream of articles is fed into the in feed section 54 of a stacker assembly 56 where the articles are arched in conveyors to give them rigidity. Then the articles are fed to a stacker section 58.

The stacker assembly 56 may form the articles into uncompensated stacks, i.e., the folded edges of all the articles in a stack may face in the same direction, or the stacks may be compensated in which the case the folded edges of half of the articles face one way, and half the other. If compensated stacks are desired, then during the stacking process one or both of the compensating sections 64 and 66 are utilized. The stacker section 58, and the compensators 64 and 66 together form what is termed herein the stacker assembly 56. In some applications, it may prove desirable to make only uncompensated bundles or logs in which case the compensators 64 and 66 would not be utilized and the stacker assembly 56 would consist of only the stacker section 58 and the infeed section 54.

After a stack has been formed, it is moved from the stacker assembly 56 to one or the other of the tyers 70 and 72 where it is compressed and tied. Thereafter, the stack is moved to the one of the delivery stations 80 and 82 which is adjacent to the tyer in which the stack had been tied. The delivery stations 80 and 82 push the tied stacks onto conveyors (not shown) for further processing.

The stacker-tyer 50 can stack and tie stacks which, when tied, are up to 12 inches high, herein termed "bundles", or stacks which, when tied, are up to 48 inches high, herein termed "logs". (The term "stack" is used in this specification genericly to refer to a stacked group of sheet-like articles which may be either a bundle or a log.) The ability to stack either bundles or logs provides great operational flexibility. When the articles being stacked are newspaper sections which will be further processed, for example, preprinted sections which must be temporarily stored and then later fed to automatic stuffing machinery, it is convenient to have the newspaper sections stacked into logs. On the other hand, when the arriving sheet-like articles are complete newspapers, it is convenient to have them stacked into bundles which can be easily handled by an individual laborer.

The physical layout of the stacker-tyer 50 is designed to facilitate stacking, tying, and delivering printed sheet-like articles as fast as modern presses, folders, and stuffers can operate. Although the stacking section 58 (FIG. 1A) can operate at the same speed as modern web presses and can stack articles as fast as they can be folded and stuffed, the compensator sections 64 and 66 and the tyers 70 and 72 are inherently slower. Accordingly, the stacker-tyer 50 is arranged symmetrically about a center line 88 (FIG. 1) which bisects the conveyor 52. On either side of the centrally located stacker section 58 are identical compensator sections 64 and 66; outside the compensators are the tyers 70 and 72, respectively, and outside the tyers 70 and 72 are the delivery sections 80 and 82, respectively. The stacker-tyer 50 includes a shuttle mechanism 100 which moves completed stacks from the stacker assembly 56 alternately to one or the other of the tyers 70 and 72. By having a compensator section 64, 66, a tyer 70, 72, and a delivery 80, 82 on each side of the stacker section 58, the slower components may work at half the speed of the stacker section 58, and the entire stacker-tyer 50 can keep up with the fastest web presses, folders and stuffers.

The shuttle mechanism 100 moves completed stacks from the stacker assembly 56 to the tyers 70 and 72 and to the delivery stations 80 and 82. The shuttle mechanism moves the stacks very rapidly from the stacker assembly 56 to one side or the other, and thereby enables the stacker-tyer 50 to operate as fast as the presses, folders, and stuffers currently available.

The shuttle mechanism 100 includes stack supporting surfaces 806, 808 (FIG. 30, discussed and illustrated more fully below) which support two opposite sides of the stacks to keep the articles in each stack in vertical alignment during movement. A third side of the stacks is supported by rear skid plates 380 (FIG. 1A) in the stacker section, rear skid plates 390, **390*a* in the compensators 66 and 64 and by rear skid plates 504 in the tyers 70 and 72. The bottom of the stacks are supported on stack supports 290 or 292 in the stacker 58, by the supports 382, 382*a*, 405 or 405*a* in the compensators 65 and 66 and by the stack receiving supports 506 in the tyers 70 and 72. Since the bottom and three sides are supported, the stacks arriving in the tyers 70 and 72** do not require realignment prior to tying. Moreover, because the stacks are supported during movement on both the front and rear sides of the stack (relative to the direction of movement) it is possible to subject the stacks to greater accelerations and decelerations and thus to move them faster than if the stacks were supported only from below or from below and on only one side during movement.

Stacker Assembly

Figure 1A:
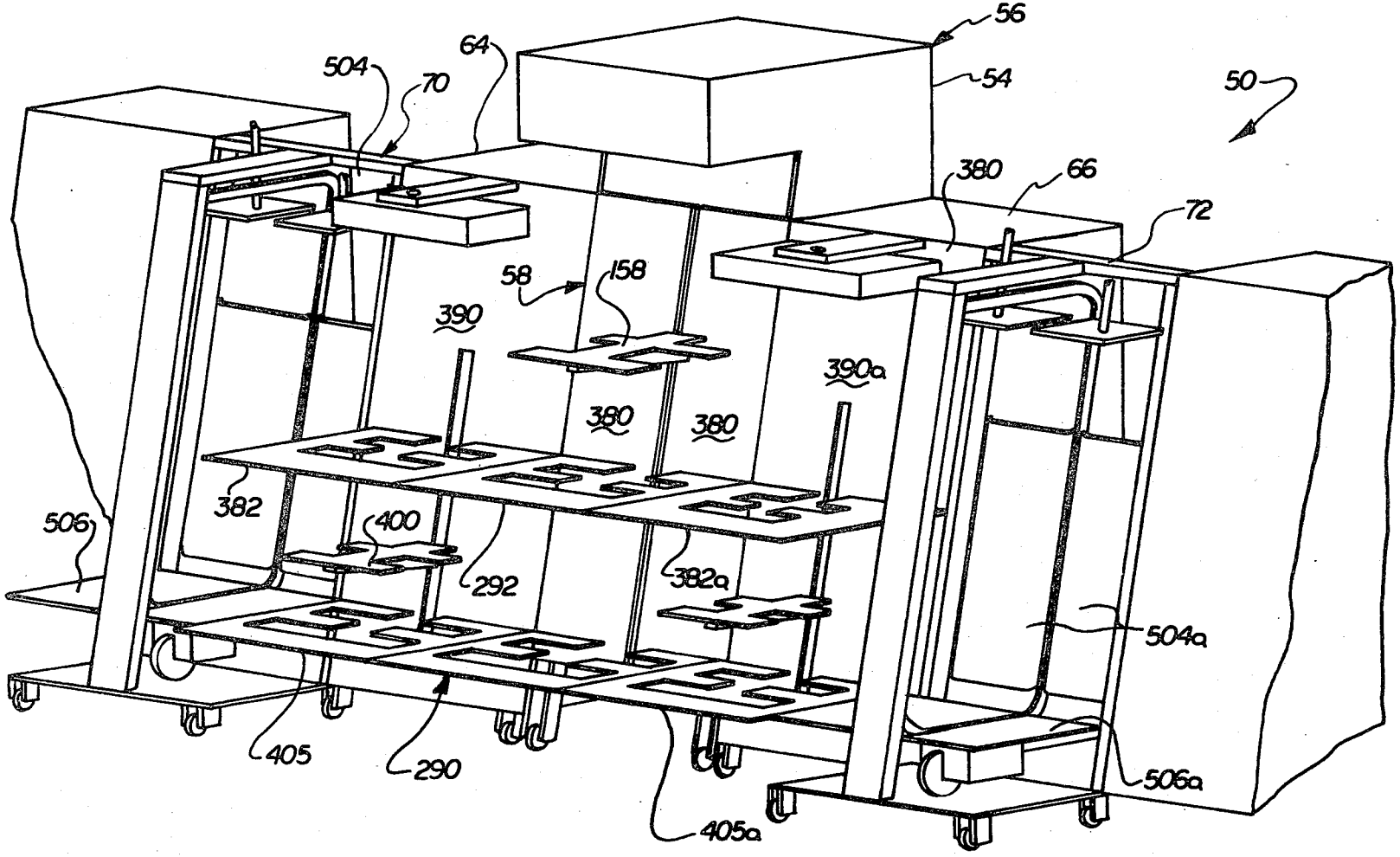
FIG. 1A is a partly schematic perspective illustration of a stacker assembly, two tyers and two delivery stations forming a part of the stacker-tyer of FIG. 1.
Figure 2:
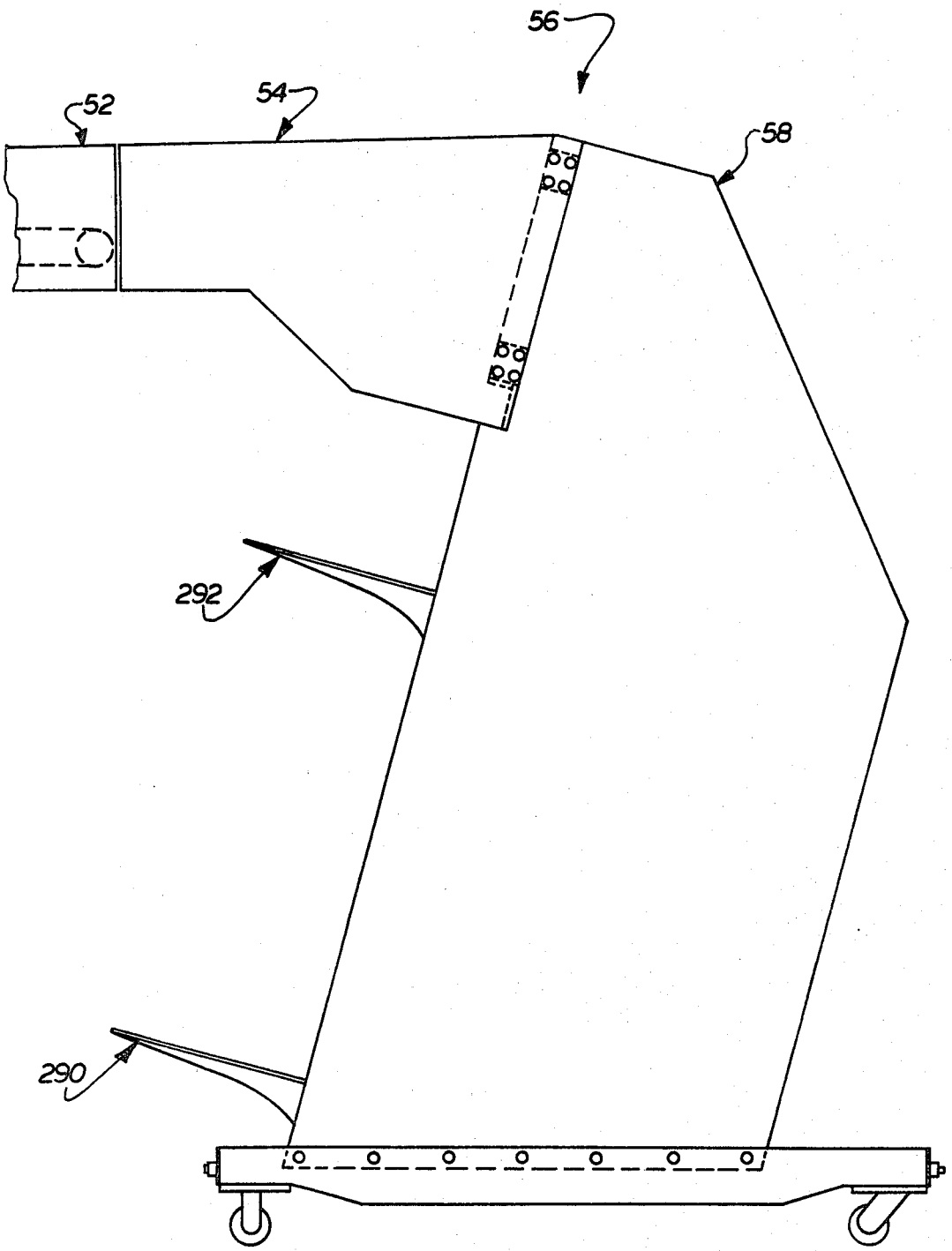
FIG. 2 is a side elevational view of a stacker assembly forming a part of the stacker tyer of FIG. 1.

FIG. 2 illustrates the infeed section 54 and stacker section 58 of the stacker assembly 56 in profile. The in feed section 54 receives sheet-like articles in a shingled stream from in feed conveyor 52. The infeed section 54 feeds the articles to the stacker section 58 where they are stacked. As shown in FIG. 1A, the stacker section 58, the compensators 64 and 66 and the tyers 70 and 72 are all mounted on wheels so that the sections may be easily removed for repair or maintenance.

The infeed section 54 (FIG. 3) receives a flat shingled stream of sheet-like articles between upper and lower cooperating belt conveyors 120 and 122. At the upstream nip 124 the upper and lower belt conveyors 120 and 122 are both flat, but at the downstream nip 126, the rollers 130 and 131 (FIG. 4) cause the upper and lower belt conveyors to take on an arched configuration to bend the arriving stream of articles about an axis parallel to their path of travel. This bending is conventional and adds rigidity to the articles and thereby facilitates jogging and stacking.

The rollers 130 mounted on shafts 132 (FIG. 4) are supported by pivotable brackets 133, 134 and 135. Adjustable pneumatic springs 136, 137, 138 control the pressure between the rollers 130 and 131. The pneumatic springs 136-138 may be adjusted according to the stiffness and thickness of the articles being stacked.

The conveyors 120 and 122 (FIG. 3) are driven in snychronism with each other by a motor 139 and drive chain 140 which connects the motor with sprockets 141 and 142 which in turn are connected with the upper belt conveyor 120 and lower belt conveyor 122, respectively. The motor 139 is driven at a speed slightly faster than the speed of the in feed conveyor 52 (FIG. 2) to assure that the arriving sheet-like articles will not jam in the in feed section 54.

Figure 5:
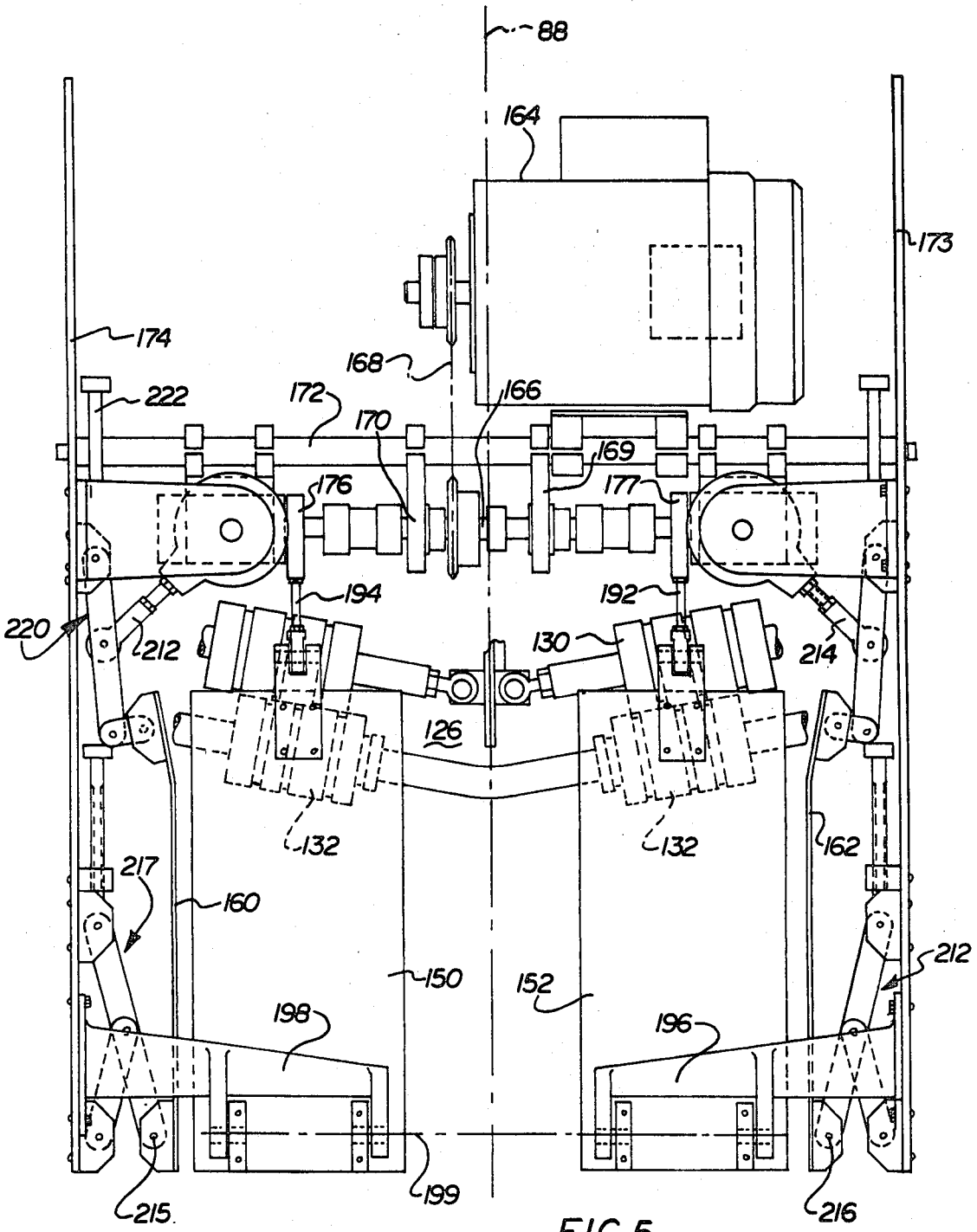
FIG. 5 is a cross sectional view taken along line 5—5 of FIG. 3.

The leading edge of each of the articles expelled from the downstream nip 126 (FIG. 3) of the upper and lower conveyors 120 and 122 of the in feed section 54 hits spaced apart deflectors 150 and 152 (FIG. 5). The deflectors 150 and 152 are positioned generally transverse to the path of travel of the articles as they leave the downstream nip 126, and contact with the deflectors causes the articles to drop onto a platform **158*b* (FIG. 3) to form a generally vertical stack. The stack supporting platform 158 moves downward as the stack grows in a manner to be described more fully below. Suffice it to say for the present, the stack supporting platform 158*b* moves downward so that the top of the growing stack remains slightly below the level of the downstream nip 126 of the belt conveyors 120 and 124**.

Figure 3:
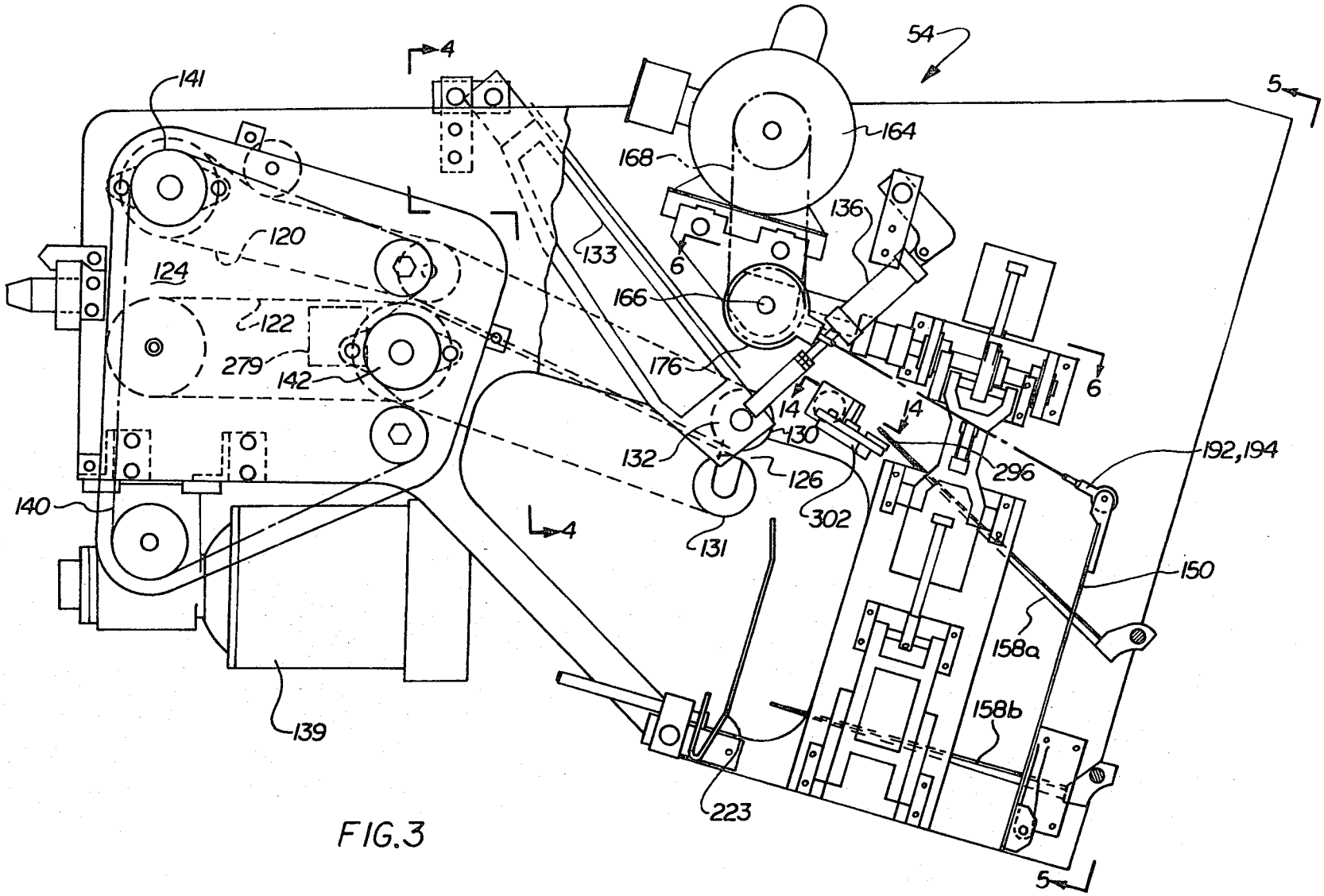
FIG. 3 is a partly cut away cross sectional view of an infeed section forming a part of the stacker assembly of FIG. 2.
Figure 4:
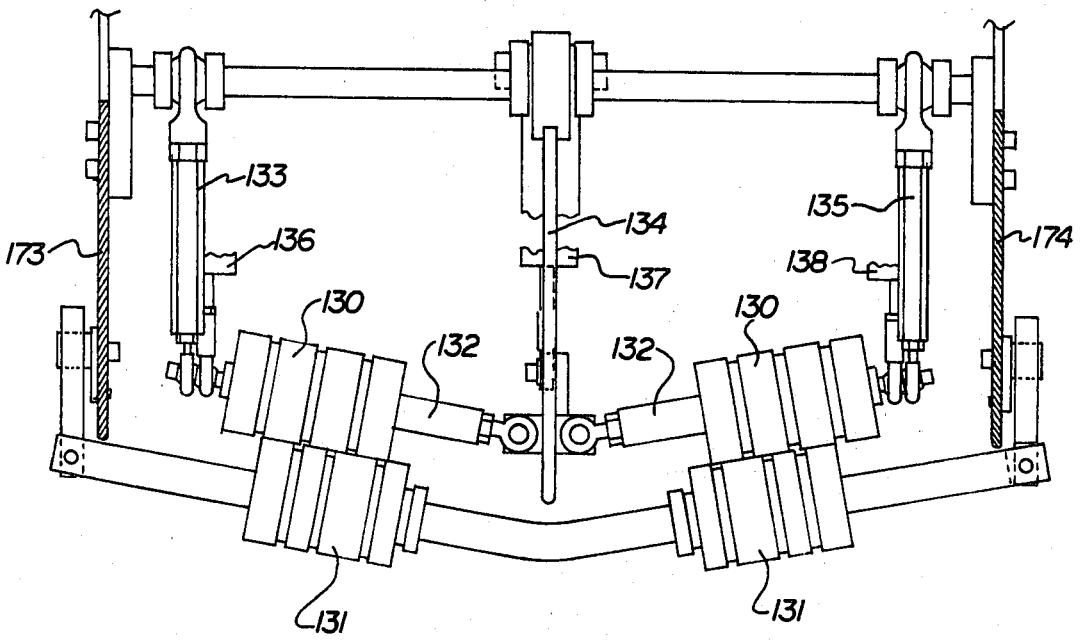
FIG. 4 is a view of the infeed section taken along line 4—4 of FIG. 3.
Figure 6:
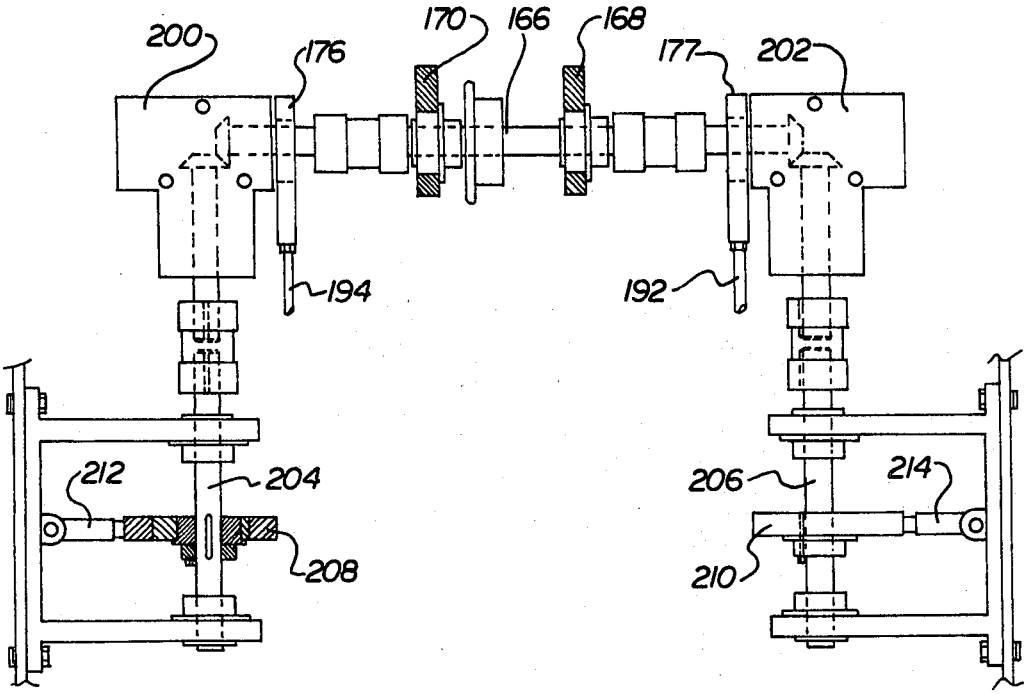
FIG. 6 is a cross sectional view taken along line 6—6 of FIG. 3.

The infeed section 54 (FIG. 3) includes a jogger mechanism which assures that succeeding articles expelled from the downstream nip 126 of the belt conveyors 120 and 122 lie squarely on top of the growing stack in proper vertical alignment. The jogger mechanism includes the deflectors 150 and 152 (FIG. 5) and side plates 160 and 162 all of which are driven in oscillatory movement by motor 164. FIGS. 3, 5 and 6 illustrate the jogger assembly and its drive.

The motor 164 (FIG. 5) drives shaft 166 (FIGS. 5 and 6) through a chain 168. The shaft 166 is rotatably mounted in bearings 169 and 170 which are connected with a fixed frame member 72 to which the motor 164 is also connected. The fixed frame member 172 is in turn rigidly connected with machine frame side plates 173 and 174.

The shaft 166 carries eccentrics 176 and 177 (FIG. 5) which drives the deflectors 150 and 152. The eccentric 176 is connected by a link 194 with deflector plate 150. The eccentric 177 is connected by a link 192 with the deflector plate 152. The links 192 and 194 are connected to the upper end portions of the deflectors 152 and 150, respectively. The opposite, lower end portions of the deflectors 150 and 152 are pivotably mounted by brackets 196 and 198 which are fixedly connected with the machine frame side plates 173 and 174. Upon rotation of shaft 166 the links 192 and 914 oscillate, pivoting the deflectors 150 and 152 about axis 199, thereby jogging the incoming articles.

As shown in FIG. 6, the shaft 166 also drives 90 degree gear boxes 200 and 202. These gear boxes in turn drive shafts 204 and 206, respectively, to which eccentrics 208 and 210, respectively, are connected. The eccentrics 208 and 210 have an output links 212, 214, respectively, which are connected through intermediate links to the upper end portions of the side plates 160 and 162 (FIG. 5). The lower end portions of side plates 160 and 162 are mounted for pivoting movement about shafts 215 and 216, respectively. When shaft 166 rotates, the output links 212 and 214 drive the side plates 160 and 162 in oscillatory motion to jog the incoming articles.

The infeed assembly 54 is adjustable to receive sheet-like articles of various lengths and widths. The lower end portions of the side plates 160 and 162 (FIG. 5) are both mounted on linkages 217 and 218 which permit the shafts 215 and 216 about which the side plates oscillate to be adjusted to compensate for different widths of incoming articles. The linkage 218 which supports the lower end portion of side plate 162 is generally similar to the linkage which supports the lower end portion of side plate 160. The linkage supporting plate 160 includes an adjusting screw 219 which, when turned, moves the shaft 215 and the lower end portion of the side plate 160 toward or away from the center line 88. A similar adjusting mechanism 220 having an adjusting screw 222 provides adjustment for the upper end portion of side plate 160.

The infeed section 54 (FIG. 3) also includes an adjustable trailing edge guide 223 positioned below the conveyor or nip 126. The guide 223 may be moved toward or away from the deflectors 150 and 152 to accommodate articles of different lengths. In place of edge guide 223 a belt jogger of conventional design may also be used to jog the trailing edge of the articles as they form a stack. The guide 223 and the side plates 160 and 162 may be adjusted to accommodate articles ranging in size from about 7"×10" to about 12"×17".

Stacker Section

As previously mentioned, the incoming articles are stacked on a platform 158*b* (FIG. 3) which moves downward as the stack grows. The stacker section 58 (FIG. 8) includes a plurality of platforms 158*a*–158*h* to receive stacks. Alternate platforms are driven independently, i.e., 158*a*, 158*c*, 158*e* and 158*g* are driven independently of platforms 158*b*, 158*d*, 158*f* and 158*h*. In this way one stack can be in the process of being built while the preceding stack is lowered to platform 290 or 292 (FIG. 7) to be moved laterally by the shuttle mechanism 100 (FIG. 1).

Figure 8:
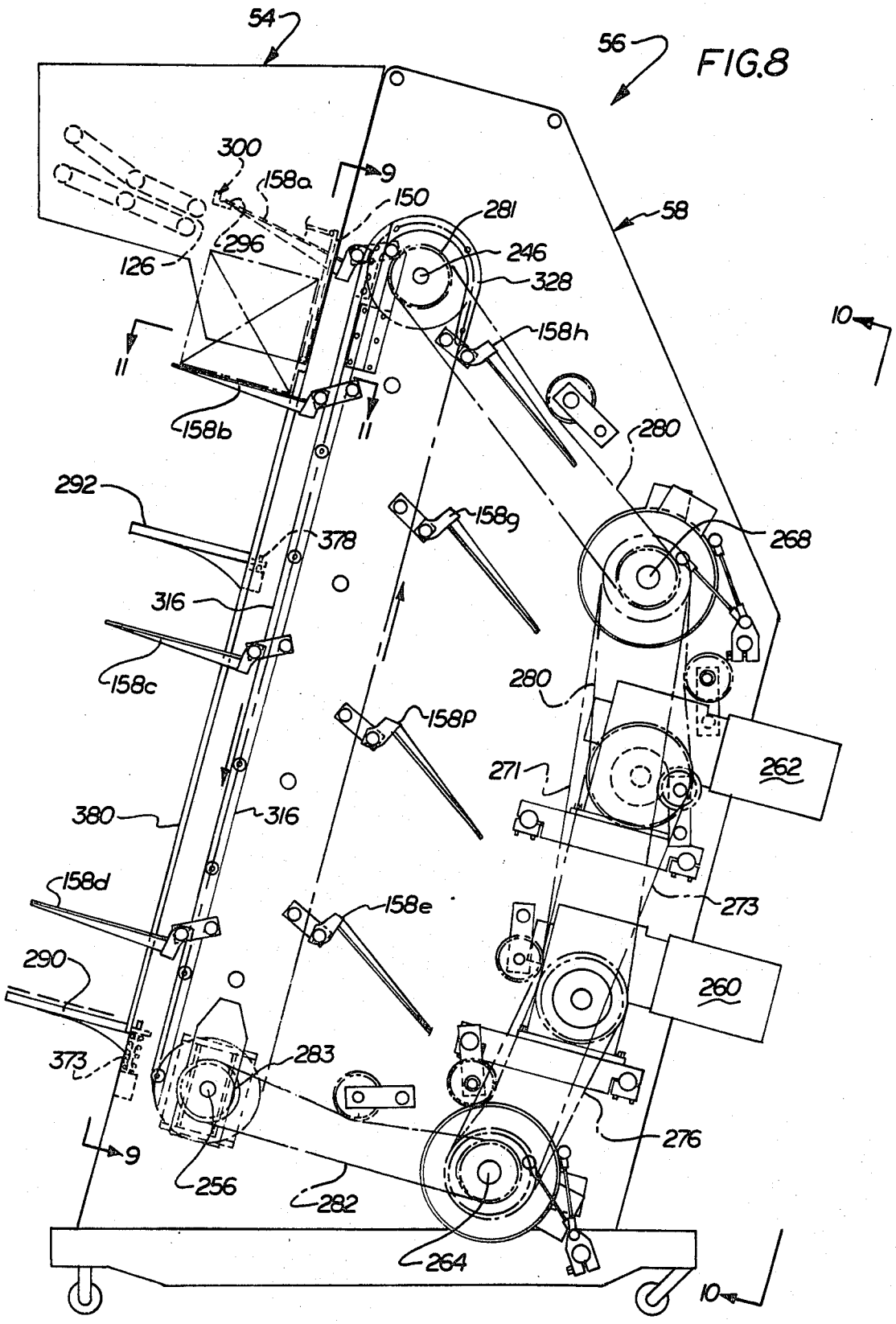
FIG. 8 is a side elevation, partly schematic view of the stacker assembly illustrated in FIG. 2.
Figure 9:
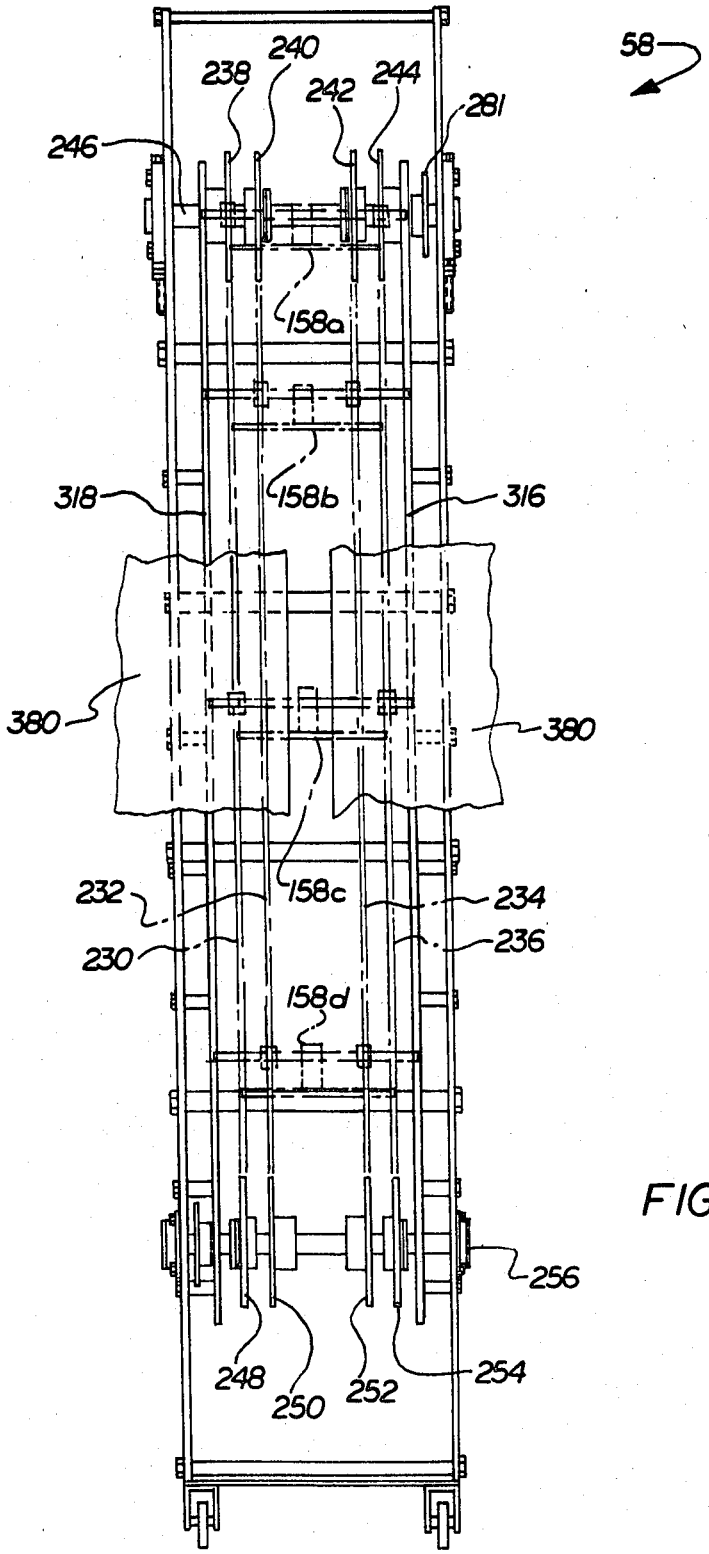
FIG. 9 is a front elevational view taken along line 9—9 of FIG. 8.

The platforms 158*a*–158*h* are mounted on endless chains 230, 232, 234 and 236 (FIG. 9). The chains 230–236 are trained around sprockets 238, 240, 242 and 244 which rotate about the axis of an upper shaft 246 and about sprockets 248, 250, 252 and 254 which rotate about the axis of a lower shaft 256. The upper shaft 246 is parallel to the lower shaft 256 but offset vertically from it (see FIG. 8) so that the straight portions of the paths of the chains 230–236 are inclined about 15 degrees from vertical. The chains 230–236 move downward on the forward or lefthand portion (as viewed in FIG. 8) of their path and upward on the rear or return portion of the path.

The chains 230–236 are paired into an outer pair comprising chains 230 and 236 and an inner pair comprising chains 232 and 234. Each platform 158*a*–158*h* is connected with either the outer pair of chains 230 and 236 or the inner pair of chains 232 and 234. As will be discussed below, the movement of each pair of chains is controlled independently from the movement of the other pair, and accordingly the platforms 158*a*, 158*c*, 158*e* and 158*g* move independently from the platforms 158*b*, 158*d*, 158*f* and 158*h*.

Sprockets 238, 240, 242, and 244 are mounted for rotation about upper shaft 246 (FIGS. 8 and 9). The outer pair of sprockets, 238 and 244, are mounted for free rotation on shaft 246. The inner pair of sprockets, 240 and 242, are fixedly connected with the shaft 246, and they rotate whenever the shaft is turned. At the lower end of the stacker section 58, the arrangement of sprockets 248, 250, 252 and 254 is reversed. The inner pair of sprockets 250 and 252 are mounted for free rotation on shaft 256, and the outer pair of sprockets 248 and 254 are fixedly connected with the shaft 256. With this arrangment the outer pair of chains 230 and 236 are driven through shaft 256 while the inner pair of chains 232 and 234 are driven through shaft 246.

The stacker section 58 includes two drive motors 260 and 262 (FIGS. 8 and 10) for driving the shafts 246 and 256 at high and low speeds, respectively. The high speed drive motor 260 may be selectively connected with an intermediate shaft 264 by a clutch 266 and drive chain 267. Similarly, the high speed drive motor 260 may be selectively connected with intermediate shaft 268 by clutch 270 and drive chain 271.

The low speed drive motor 262 may be selectively connected with the intermediate shaft 264 through means of a clutch 272 and drive chain 273. The low speed drive motor 262 may also be selectively connected with the upper intermediate shaft 268 by means of clutch 274 and drive chain 275. The lower and upper intermediate shafts 264 and 268 also each carry a selectively operable brake 276 and 278, respectively, which when applied stops rotation of the intermediate shaft to which they are connected.

The upper intermediate shaft 268 drives the upper shaft 246 through chain 280 and a sprocket 281 fixed to shaft 246. The upper shaft 246 in turn drives the inner pair of chains 232 and 234 (FIG. 9). The lower intermediate shaft 264 (FIG. 8) is drivingly connected with the lower shaft 256 by means of chain 282 and a sprocket 283 fixed to shaft 256 and thereby drives the outer pair of chains 230 and 236.

By selectively engaging or disengaging clutches 270 and 274 the inner pair of chains 240 and 242 may be driven at either a high or low speed. The brake 278 may be actuated to stop movement of the chains. Similarly, the outer pair of chains 230 and 236 may be driven at either high or low speeds by selective operation of clutches 266 and 272, and the outer pair of chains may be stopped by actuation of brake 276.

In operation, the inner pair of chains 232 and 234 (FIG. 9) are connected with the low speed motor 262 as a stack is being built on platform **158*b*. The low speed drive motor 262 is a variable speed motor, and its speed is controlled to maintain the top of the stack of incoming articles approximately even with or a little below the downstream nip 126 (FIG. 8) of the infeed section 54**.

Figure 7:
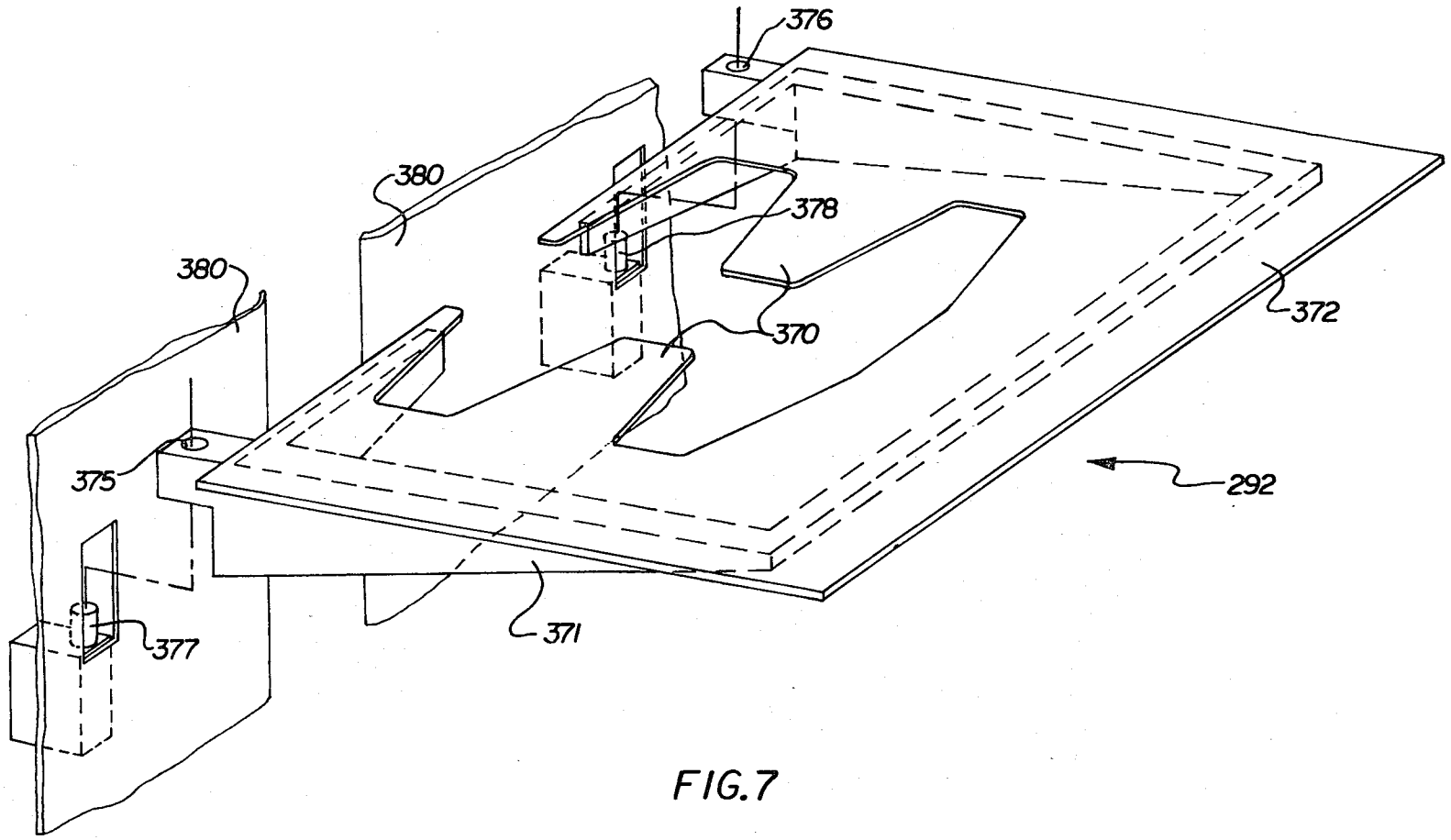
FIG. 7 is a perspective illustration of a stack receiving support forming a part of the stacker assembly of FIG. 2.

A counter 279 (shown schematically in FIG. 3) counts the number of articles on platform **158*b* (FIG. 8) (and on each succeeding platform), and when a predetermined number is reached, the chains 232 and 234 to which the platform 158*b* is connected, are disconnected from the low speed drive motor 262 (FIGS. 8 and 10) by disengaging clutch 274. Simultaneously, the chains 232 and 234 are connected with the high speed drive motor 260 by engagement of clutch 270. This causes the platform 158*b* to drop downward rapidly. The platform 158*b* moves downward and the stack, in the case of a log, is transferred to the stack receiving support 290 (FIGS. 7 and 8). If bundles are being made, then the platform transfers the stack to the upper stack receiving support 292**.

Figures 14, 15:
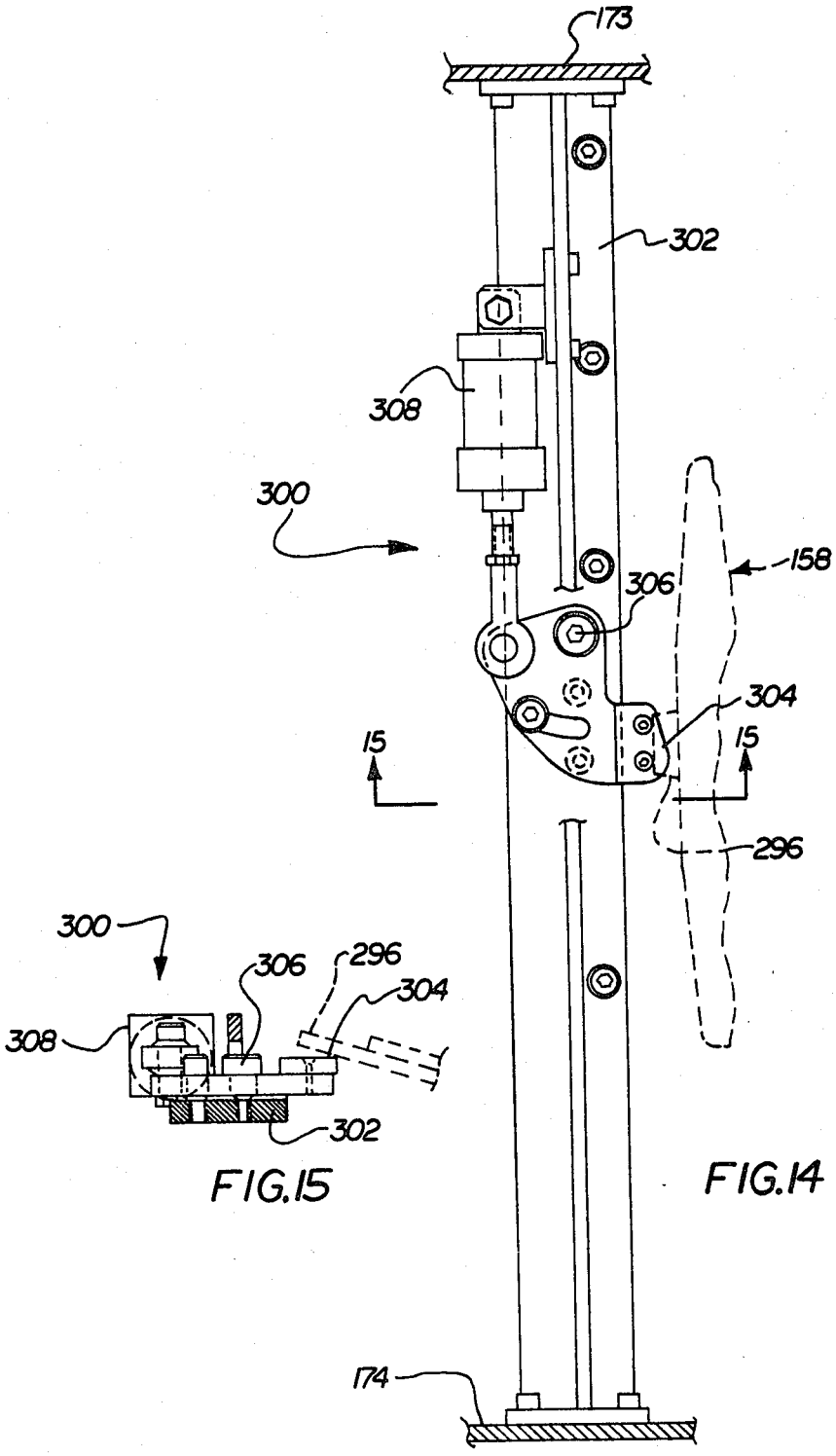
FIG. 14 is taken along line 14—14 of FIG. 3.
FIG. 15 is taken along the line 15—15 of FIG. 14.

While the stack was being built on platform **158*b*, the chains 232 and 234 were actuated to bring platform 158*a* to a position poised above the downstream nip 126 of the infeed section 54. The outermost tip 296 (FIGS. 8 and 11) of the platform 158*a* is restrained by a latch mechanism 300 (FIGS. 8, 14 and 15). The latch mechanism 300 serves to hold the tip 296 away from the stream of incoming articles until the stack being built on platform 158*b* contains the predetermined number of articles. Thereafter, the latch mechanism 300 releases the tip 296** which then intercepts the stream of articles to begin the next stack.

The latch mechanism 300 is shown in detail in FIGS. 14 and 15. The latch mechanism 300 is mounted to a fixed frame member 302 which extends between machine frame side plates 173 and 174. The latch includes a pivotable catch 304 which can be rotated about the axis of bolt 306 by actuation of the cylinder 308. When the cylinder 308 is in its extended position, the pivotable catch 304 extends outward from the fixed frame member 302 and engages the tip 296 (FIGS. 3 and 8) of the platform **158*a*. A controller (not shown) is connected with the counter 279 (FIG. 3), and when a preselected number of articles has been counted, indicating that a stack is complete, the cylinder 308 (FIG. 14) is retracted to pull back the catch 304 and release the tip 296**.

As the tip 296 (FIG. 8) of the platform **158*a* is released, brake 276 (FIG. 10) is released and the clutch 272 is engaged to drive the sprockets 248 and 254 through the lower shaft 256 to thereby cause the platform 158*a* to be lowered slowly as the stack grows thereon. After the stack on platform 158*a* is completed, the process is repeated. Platform 158*g*, which had previously been brought to a poised position and held there by brake 278 and the latch mechanism 300**, is released and another stack is built.

The platforms **158*a*–158*h* (FIG. 8) are guided in their downward movement by a pair of parallel guide rails 316 and 318 (FIGS. 8 and 9). The guide rails function to control the attitude of the platforms 158 as they move downward. The guide rails 316 and 318 (FIG. 11) have a rectangular cross section and the platforms 158 each have four wheels, two of which (320 and 322) engage the front surfaces of the guide rails 316 and 318, respectively, and two of which (324 and 326) engage the rear surfaces of the guide rails 316 and 318, respectively. The wheels 320, 322, 324, and 326 support the platforms 158** and resist any tendency for the platform to tilt downward under the weight of the stack built upon it.

During stacking, the guide rails 316 and 318 (FIG. 13) cause the platform 158 to move downward in a straight path which is inclined 15 degrees from vertical. The torque caused by the weight of the stack on the platform 158 is resisted by the guide rails 316 and 318 and is not transmitted to the chains 230, 232, 234, and 236, which serve only to control the descent of the platforms and to return the platforms to the top of the guide rails. The guide rails 316 and 318 terminate at the bottom of the forward run of the chains 230–326 (FIG. 8), and the platforms 158 are relatively free on the upward, return run of the chains. The guide rails 316 and 318 have a curved, tapered portion 328 at the top of the return run of the chains 230–236 so that the wheels 320–326 of the platforms 158 are guided into place just before the chains 230–236 make their turn around the upper sprockets 238, 240, 242 and 244.

All the platforms 158 are generally alike, and the one shown in FIGS. 11, 12 and 13 is typical. The platform 158 includes a carriage assembly 330 (FIG. 11) and a stack supporting plate 332 connected with the carriage assembly. The carriage assembly 330 includes a cross shaft 334 extending between the guide rails 316 and 318. The previously mentioned wheels 320 and 322 are rotatably mounted on opposite ends of the cross shaft 334. Brackets 336 and 338 are fixedly connected with the cross shaft 334. The brackets 336 and 338 support the wheels 324 and 326, respectively, which are rotatably mounted thereon.

The brackets 336 and 338 are generally similar in structure and function, and FIG. 13 illustrates the position of the bracket 338 when the wheels 322 and 326 are in contact with the front and rear surfaces of the guide rail 316 during downward movement of the platform 158. The wheel 326 is behind and above the wheel 322 as the platform 158 moves downward. Any torque applied to the cross shaft 334 by the weight of the stack growing on the stack support plate 332 is resisted by the wheels 322 and 326.

The carriage assembly 330 is connected with chains 232 and 234 through identical brackets 340 and 342 (FIG. 11). The brackets 340 and 342 each include a pin 341 and 343, respectively, which extends through a link of the chain 232 or 234, respectively. The brackets 340 and 342 are connected with a mating bracket 344 and 346, respectively which are permanently connected with the shaft 334. When it is desired to remove the platform 158 from the stacker assembly 56, it is only necessary to disconnect the bracket 340 from the mating bracket 344 and the bracket 342 from the mating bracket 346. The entire carriage assembly 330 and stack supporting plate 332 connected to it can then be removed by sliding it down and off the bottom of the guide rails 316 and 318.

It is appropriate to note here that when stacking bundles, all eight platforms 158*a*–158*h* (FIG. 8) are used. When stacking logs platforms 158*c*, 158*d*, 158*g* and 158*h* are removed. This doubles the spacing between the platforms to accommodate the larger logs.

The platform 158 illustrated in FIG. 11 includes brackets 340 and 342 along with cooperating brackets 344 and 346, respectively, which are positioned along shaft 334 for connection with the inner pair of chains 232 and 234, respectively. This arrangement is suitable for use with platforms 158*b*, 158*d*, 158*f* and 158*h*, all of which are connected with the inner pair of chains 232 and 234. To connect the platforms 158*a*, 158*c*, 158*e*, and 158*g* to the outer pair of chains 230 and 236, the brackets 240, 242, 244, and 246 are moved outward on the shaft 334 to the position shown in phantom in FIG. 11 where the brackets are aligned with the chains 230 and 236.

The stack supporting plate assembly 332 (FIG. 12) is pivotably mounted to the carriage assembly 330. The stack supporting plate assembly 332 is connected with a support bracket 350 which has a passage through which the cross shaft 334 extends. Rotation of the support bracket 350 downward (counterclockwise as viewed in FIG. 12) is limited by a clamp 352 (FIGS. 11 and 12) which is fixedly connected with the cross shaft 334. A pin 354 extending generally parallel with the cross shaft 334 is connected with the support bracket 350 and engages a tab on the clamp 352 thereby preventing further counterclockwise movement of the support bracket 350 relative to the cross shaft 334.

The platform 158 includes a hinge and spring arrangement which enables the platform to be pretensioned while being held by the latch mechanism 300. When the latch mechanism releases the tip of the platform 158, the spring arrangement snaps the platform 158 into the stream of incoming sheet-like articles. This snap action eliminates the need for a gap maker or other device to temporarily interrupt the incoming stream of articles while a complete stack is being lowered and the next platform is being brought into place.

A pair of torsion coil springs 358 and 360 (FIG. 11) bias the rotatable support bracket 350 toward engagement with the clamp 352. One end portion of the torsion coil springs 358 and 360 are fixed against rotation relative to the cross shaft 334, and the other end portion of the torsion coil springs extend to engage the pin 354 connected with the support bracket 350. When the support bracket 350 is rotated in the clockwise direction (as viewed in FIG. 12) toward the position shown in phantom, the springs 358 and 360 tighten and resist this motion.

Referring to FIG. 8, it can be seen that as the support platform 158*a* is brought into position with its tip 296 engaging the latch assembly 300, continued downward movement of the carriage assembly 330 causes the stack supporting plate 332 to rotate in a clockwise direction about the cross shaft 334 (FIGS. 11 and 12) and thus increases the tension in the springs 358 and 360. When the latch assembly 300 is released, the springs 358 and 360 cause the stack supporting plate 332 to snap downward rapidly in a counterclockwise direction, to thereby intercept the arriving stream of articles.

The stack supporting plate 332 of the platform 158 (FIG. 11) is connected with the support bracket 350. The support bracket 350 extends generally perpendicular to the shaft 334. The platform 332 includes a pair of tines 333 extending transverse to the support bracket 350 on both sides. The stack receiving supports 290 and 292 (FIGS. 1A and 7) are formed with tines 370 which fit between or interdigitate with the tines 333 of the stack supporting plate 332 of the platform 158. As noted above, when a stack (either a bundle or a log) is completed, the platform 158 (FIG. 8) supporting the stack is lowered rapidly to transfer the stack to either the upper stack receiving support 292 or the lower stack receiving support 290. As the platform 158 moves downward its tines 333 trace out vertical paths which fit between the tines 370 of the upper and lower stack receiving supports 290 and 292, and the stack which was once on the stack supporting plate 332 is automatically transferred to one of the stack receiving supports.

The stack support 292 (FIG. 7) is removable and adapted to be positioned at the level indicated in phantom in FIG. 8 for receiving bundles from the platform 158. The stack support 292 (FIG. 7) includes a plate member 371 of which the tines 370 are an integral part. The plate member 371 is connected with a bracket 372 which provides support for the plate member 371. A pair of pins 377 and 378 are connected with the skid plates 380 at the level of the upper stack support. The pins 377 and 378 are received in openings 375 and 376, respectively, in the bracket 372 and hold the stack support 297 fixed to the stacker assembly 58 (FIG. 1A) and generally perpendicular to the rear skid plates 380 to receive bundles. The stack support 392 may be lifted off the pins 377 and 378 when logs are being made.

The lower stack support 290 (FIG. 8) is connected with the stacker assembly to receive logs from the platforms 158. Because the logs are relatively heavy, the lower stack support 290 is mounted on shock absorbing springs 373.

Once the stack is on either the upper or lower stack receiving support 290 or 292, two things happen. First, the pair of chains 230 and 240 or 232 and 234 (FIG. 9) to which the platform 158 upon which the stack had just been resting is connected are advanced to bring the next platform connected with that same pair of chains into an indexed position with its tip 296 (FIG. 8) engaged by the latch assembly 300. As this is happening, the shuttle mechanism 100 (FIG. 1) moves the stack on the stack receiving support 290 or 292 from the stacker section 58 into one or the other of the compensator sections 64 or 66 which are positioned immediately adjacent the stacker section 58.

Figure 13A:
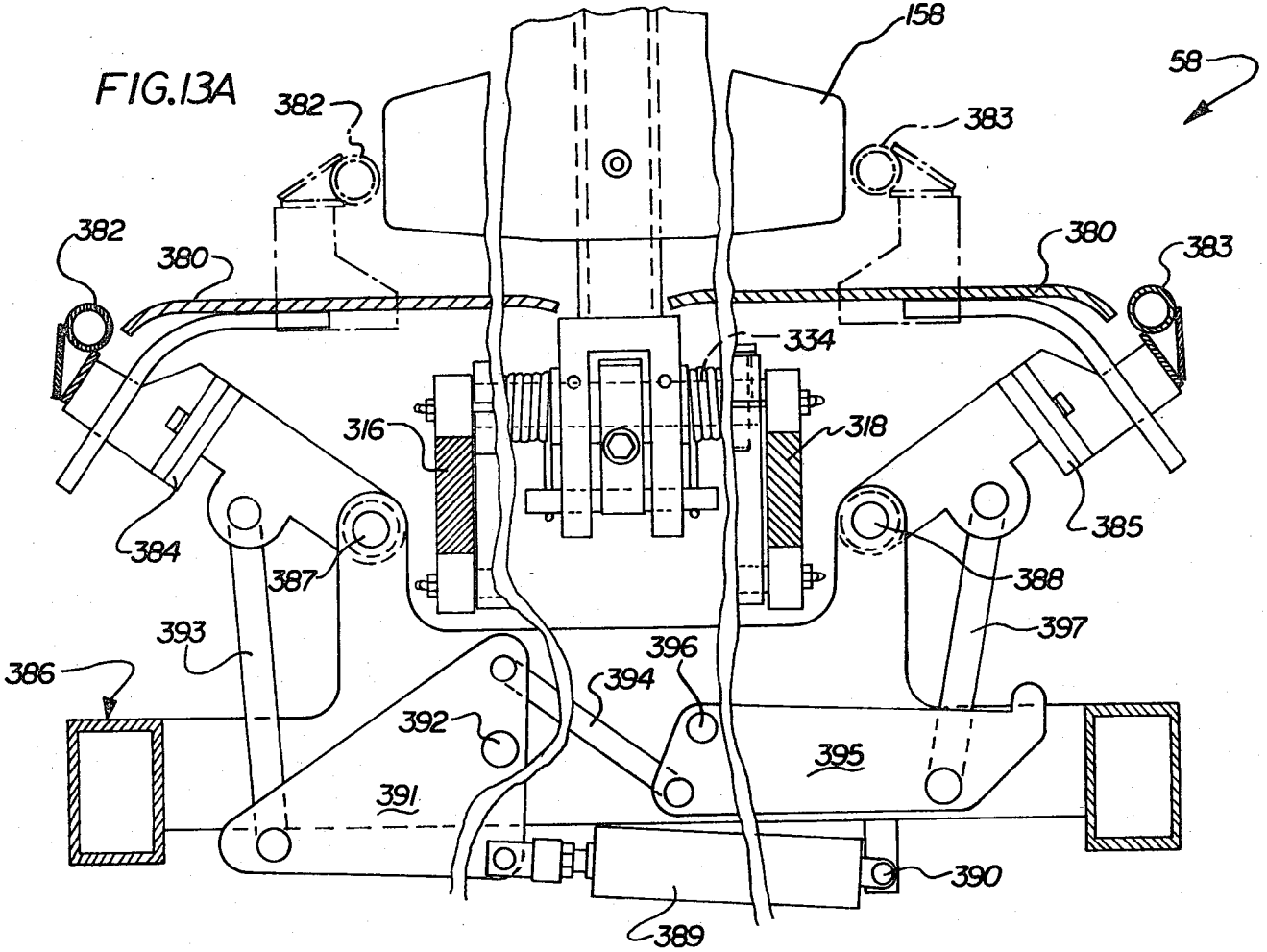
FIG. 13A is a cross sectional view of a portion of the stacker of FIG. 8.

It has proven advantageous to provide the stacker section 58 with a pair of retractable guide bars 382 and 383 (FIG. 13A). The guide bars, when in the extended position shown in phantom in FIG. 13A, extend parallel to the downward stacking path of the platform 158 and engage opposite sides of the stack as the platform 158 is lowered to thereby keep the stack in proper alignment.

The guide bars 382 and 383 are mounted on the ends of arms 384 and 385, respectively, which are mounted in the frame 386 of the stacker section 58 for rotation about axes 387 and 388, respectively.

A hydraulic cylinder 389 is effective to rotate the arms 384 and 385 about axes 387 and 388, respectively, when it extends and retracts. The cylinder 389 is pivotably connected with the frame 386 at 390 and its opposite end is connected with lever 391. The lever 391 rotates about axis 392 when the cylinder 387 extends or retracts. Lever 391 is connected by link 393 with arm 384 and by link 394, lever 395 and link 396 with arm 385. When the cylinder 389 extends, lever 391 rotates about axis 392 and lever 395 rotates about axis 396 to move the arms 384 and 385 toward the position shown in phantom. The guide bars 382 and 383 are kept in this position while a log is being built. Once the log is completed, the guide bars 382 and 383 are retracted by the contraction of the cylinder 389, and as discussed below, the stack is then moved laterally out of the stacker section 58.

Movement From Stacker

The shuttle mechanism 100 (FIG. 1) includes pusher assemblies 706, 708, 710 and 712 to be discussed below which engage the trailing side of the completed stack in the stacker section 58. The pushers engage the trailing side of the stack and accelerate the stack laterally while preserving vertical alignment of the articles in the stack. As the stack starts to slow down, a pusher disposed on the leading edge of the stack comes into play. The momentum of the rapidly moving stack causes the stack to engage the pusher located adjacent the leading side of the stack. Because the shuttle mechanism 100 includes pushers located on both the leading side and trailing side of the stack being moved laterally from the stacker section 58 into the compensator section 64, it is possible to accelerate and decelerate the stack very rapidly while preserving vertical alignment of the stack. Since alternate stacks are moved in opposite directions from the stacker section 58 into one or the other of the compensator sections 64 and 66, the roles of the pushers as engaging the leading or trailing sides of the stacks changes with the direction of motion of the particular stack.

Figure 10:
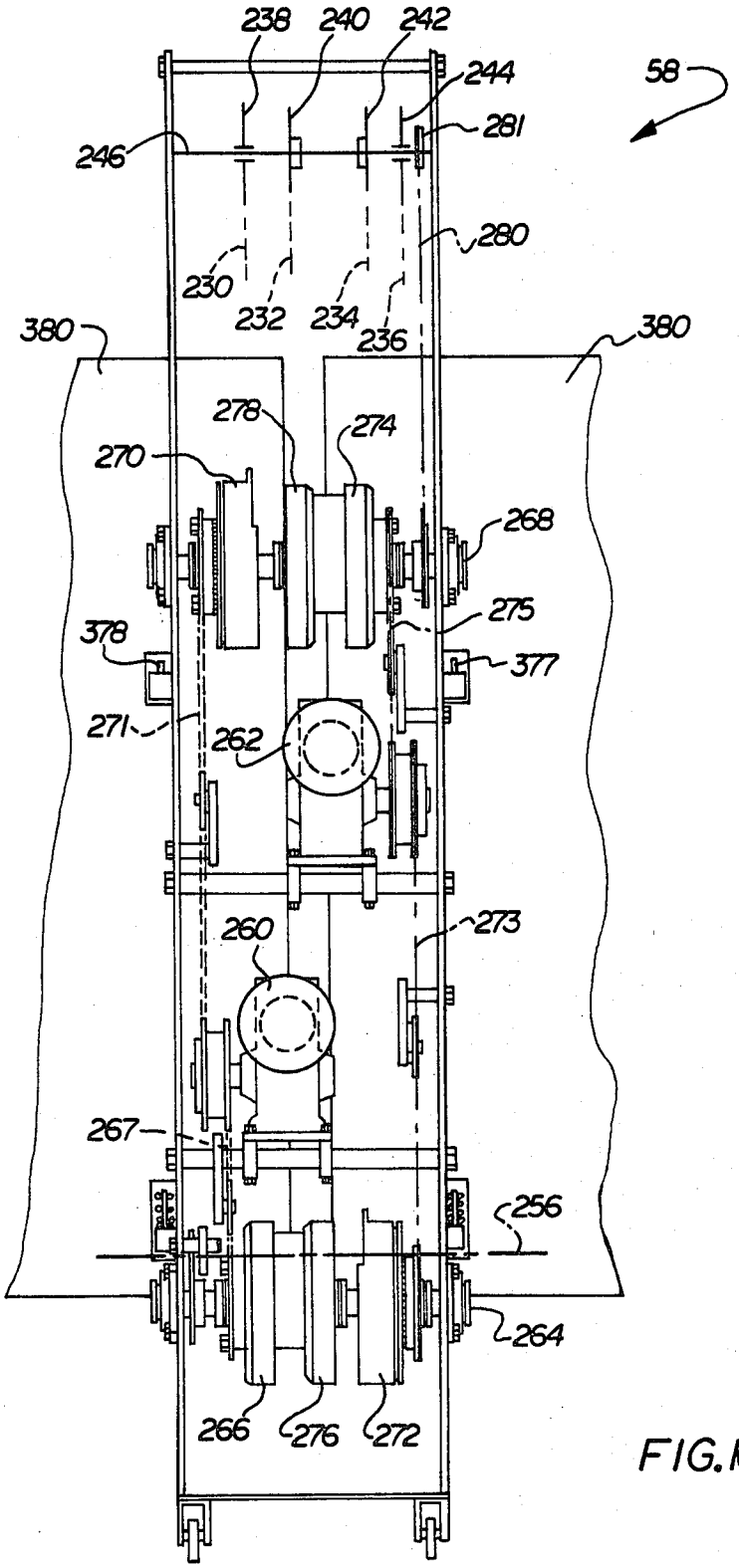
FIG. 10 is a rear elevational view taken along line 10—10 of FIG. 8.

The stacker section 58 includes rear skid plates 380 which are disposed parallel to the guide rails 316 and 318 (FIGS. 8, 9 and 10). The rear skid plates 380 form a continuation of the deflectors 150 and 152 and are inclined 15 degrees from vertical. They are generally perpendicular to the plane of the stack receiving supports 290 and 292 as the platforms move downward. As the stack on a platform 158 grows, the stack leans against the rear skid plates 380. The compensators 64 and 66 include rear skid plates 390 which together with the skid plates 380 of the stacker section 58 provide continuous support for the back of the stacks as they are moved within the stacker assembly 56. There are similar rear skid plates 504 and **504*a* (FIG. 18) in the tyers 70 and 72 and the delivery stations 80 and 82. The rear skid plates 380, 390, the pushers of the shuttle mechanism 100, the stack receiving supports 290 or 292 of the stacker and the stack receiving supports 382, 382*a*, 405 or 405*a* of the compensators cooperate to support four of the six faces of a stack during movement, and thus to preserve alignment of the articles in the stack. Therefore, when the stack or partial stack arrives at a compensator section 64 or 66 or a tyer 70 or 72**, no rejogging is required to realign the articles in the stack despite the rapid acceleration and deceleration of the stacks as they are moved.

Compensator Sections

The compensator sections 64 and 66 (FIG. 1) are utilized only when making bundles. The stacker-tyer 50 does not make compensated logs because the logs are intended for further automatic processing with which alternating orientation of the articles would not be compatible. When making compensated bundles the counter 279 (FIG. 3) which controls the release of the latch mechanism 300 is set to count one-half of the total number of articles required to make a complete bundle. This "half bundle" is then lowered onto the stack receiving support 292 (FIG. 8) and moved laterally by the shuttle mechanism 100 into one of the compensator sections 64 or 66 (FIG. 1). The compensator sections 64 and 66 are substantially identical, and only the compensator section 64 will be described in detail, it being understood that the description applies equally to the compensator section 66.

A half bundle is pushed by the shuttle mechanism 100 across the stack support 292 and a similar stack support 382 connected with the compensator section 64 into the compensator section (FIGS. 16 and 17) to a position (FIG. 17) where it is aligned over an elevator platform 400. The elevator platform 400 is connected with a cylinder assembly 402 (FIG. 16) which lifts the elevator platform 400 and the half bundle on it upward into a rotatably mounted compensator box 404. When making logs, the elevator platform 400 of the compensator section is locked in its uppermost position and the stack support 382 is removed to permit lateral movement of the logs whose bottom is supported by stack support 405 which forms a continuation of the stack support 290 in the stacker section 56.

Figure 16:
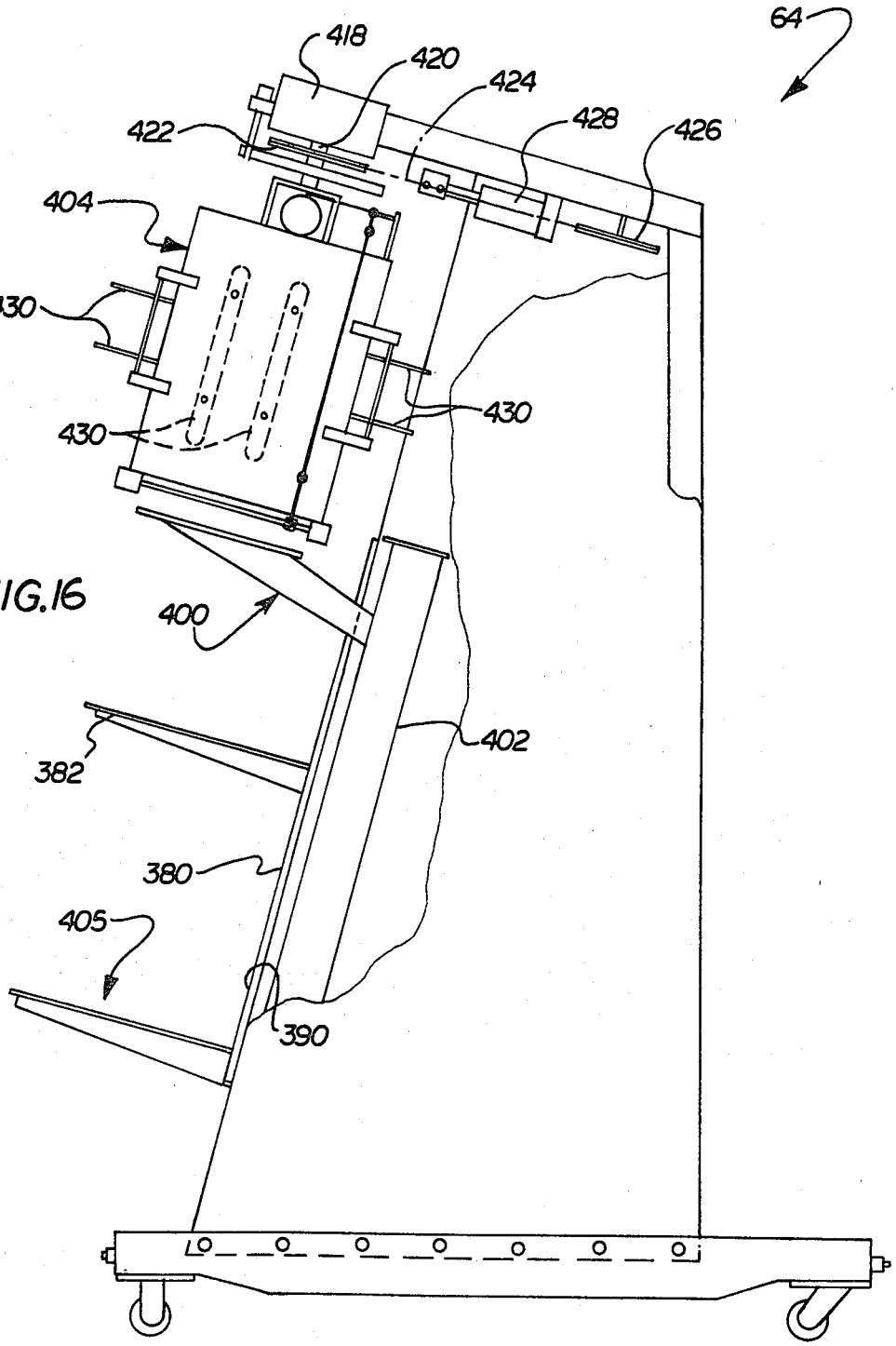
FIG. 16 is a side elevation view, partly cut away, of a compensator section forming a part of the stacker-tyre illustrated in FIG. 1.
Figure 17:
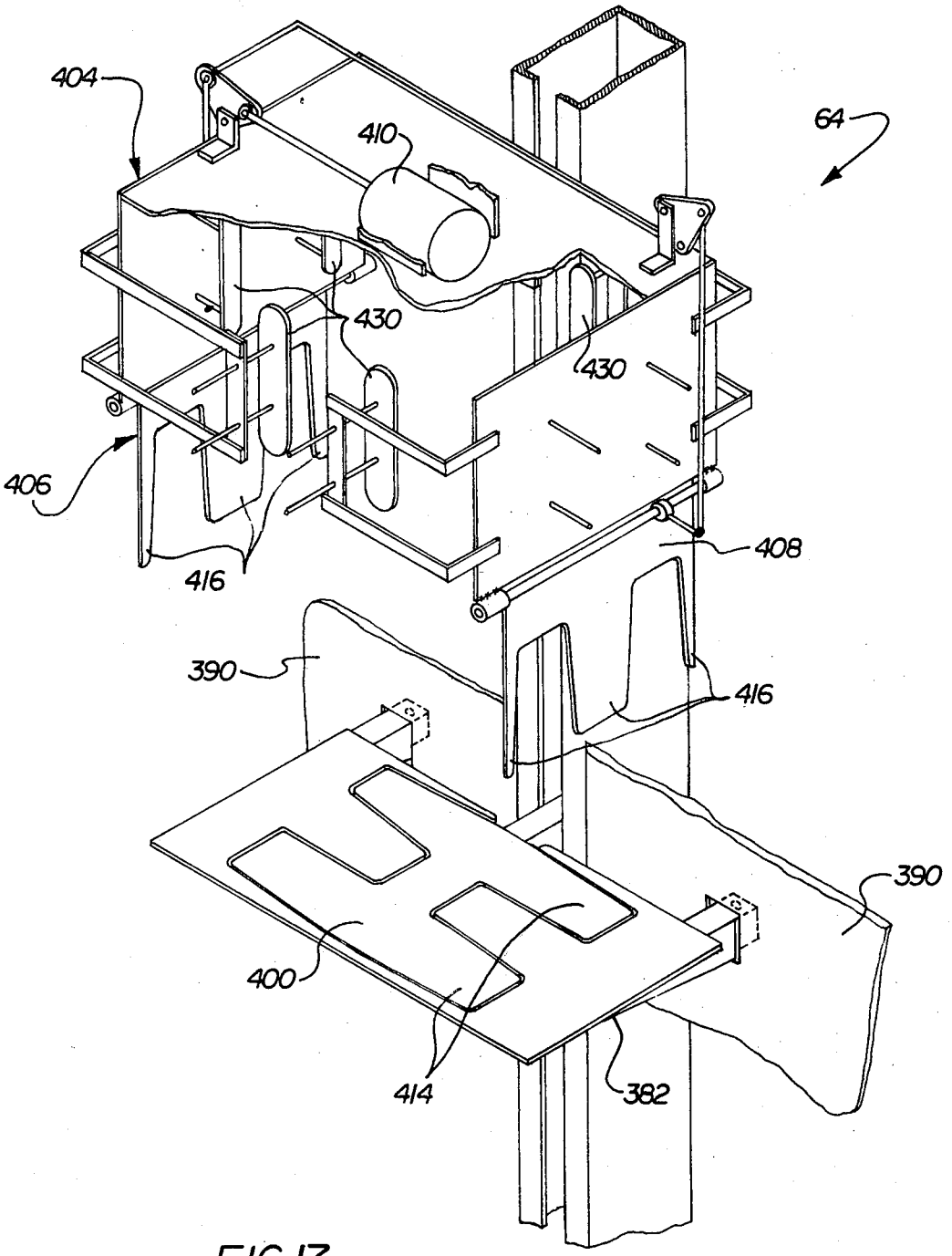
FIG. 17 is a perspective illustration of a portion of the compensator assembly of FIG. 16.

The compensator box 404 includes a pair of pivotable supports 406 and 408. The supports 406 and 408 form the bottom of the box 404 and are hinged to opposite bottom edges of the compensator box 404. The supports 406 and 408 may be moved from a position in which they are generally vertical (as shown in FIG. 17) and hence the bottom of the box is open to a position in which they are generally horizontal (FIG. 16) and the bottom of the compensator box 404 is closed. A cylinder and linkage mechanism 140 is utilized to move the supports 406 and 408 between these two positions.

The elevator platform 400 includes a plurality of tines 414, and each of the supports 406 and 408 which form the hinged bottom of the compensator box 404 is formed with tines 416 which intedigitate with the tines on the elevator platform 414. When a half bundle has been pushed onto the elevator platform 400 from the stacker section 58, the supports 406 and 408 are extended downward so that the bottom of the compensator box 404 is open. The cylinder assembly 402 then lifts the elevator platform 400 to bring a half bundle inside the compensator box. Thereafter, the cylinder and linkage mechanism 410 is actuated to pivot the supports 406 and 408 to their horizontal position as shown in FIG. 16 to support the bottom of the half bundle inside the compensator box 404. Next, the elevator platform 400 is lowered leaving the half bundle inside the compensator box 400.

As previously noted, the compensator box 404 is rotatably mounted. A bearing assembly 418 (FIG. 16) supports a shaft 420 which is connected with the top of the compensator box 404 for rotation about an axis parallel to the plane of the rear skid plates 380. A sprocket 422 is fixedly connected with the shaft 420 and an endless chain 424 fits around sprocket 422 and sprocket 426. A cylinder assembly 428 is connected between the frame of the compensator section 64 and the chain 424. By actuating the cylinder assembly 428, the chain causes the shaft 420 and therefore the compensator box 404 to rotate. The compensator box 404 is rotated 180 degrees when the cylinder assembly 428 moves between its extended and retracted positions.

While one-half bundle is being lifted by the elevator platform 400 into the compensator box of the lefthand compensator section 64 (FIG. 1) the stacker section 58 is building another half bundle which will be moved by the shuttle mechanism 100 to the right to the compensator section 66. The succeeding half bundle built in the stacker section 58 is moved laterally by the shuttle mechanism 100 to the left into the compensator section 64. Once this succeeding half bundle is positioned on the elevator platform 400 (FIG. 16), the cylinder and linkage mechanism 410 is actuated to pivot the supports 406 and 408 downward to thereby drop the half bundle in the compensator box 404 onto the half bundle which is on the elevator platform 400. Since the half bundle from the compensator box 404 has been rotated and the succeeding half bundle on the elevator platform has not been rotated, the resulting complete bundle is compensated.

The compensator box 404 includes adjustable bundle side supports 430 (FIG. 17) which permit the compensator box to accommodate stacks formed of articles having dimensions from 7×10 inches to 12×17 inches. Moreover, the operation of the compensator section 64 has been described as building a complete bundle in which half of the articles face one direction and half the articles are rotated 180 degrees. It is also possible to operate the compensator section so that the complete bundle is built in quarters with each succeeding quarter rotated 180 degrees from the preceding quarter.

Once a complete bundle is in the compensator section 64 (FIG. 1), pusher assemblies of the shuttle mechanism 100 are extended and then moved laterally to push the bundle from the compensator section 64 into the tyer 70. A complete bundle in the compensator section 66 is pushed laterally in the opposite direction into the tyer 72.

Tyer

Once a completed bundle from one of the compensator sections 64 and 66 (FIG. 1) has been pushed by the shuttle mechanism 100 into an adjacent one of the tyers 70 and 72, the tyer compresses the stack and ties a band or bands around it. The tyer sections 70 and 72 can compress either bundles or logs and can tie either one band or two parallel bands around a stack. The tyer 70 is substantially the same as the tyer 72, and consequently, only the tyer 70 will be described in detail. However, it will be understood that the description of the tyer 70 is equally applicable to the tyer 72.

The tyer 70 (FIG. 18) includes a frame 500 and is positioned adjacent the compensator section 64 (FIGS. 1 and 1A). The tyer 70 includes rear skid plates 504 (FIGS. 18 and 20) which are coplanar with and form a continuation of the rear skid plates 380, 390 and **390*a* (FIG. 1A) of the stacker 58 and compensators 64 and 66. The tyer 70 also includes a stack receiving support 506 (FIG. 18) which supports the bottom of the stack when it is pushed into the tyer 70. The stack receiving support 506 may be positioned either even with the stack receiving support 290 (FIG. 8) when it is in its lower position in the stacker assembly 56 or it may be elevated to be even with the position of the upper stack receiving support 292**, as will be discussed in more detail below.

When a stack is pushed into the tyer 70 (FIG. 18) its bottom is supported by the stack receiving support 506 and the entire stack leans against the rear skid plate 504. The tyer 70 includes a pair of compression cylinders 510 and 512 (FIG. 19). The cylinder portions of the compression cylinder assemblies 510 and 512 are fixedly connected to the frame 500, and a compression plate 514 and 516 (FIG. 19), respectively, is connected with the piston of each of the cylinder assemblies. The compression cylinder assemblies 510 and 512 have a stroke sufficient to compress a bundle from about 18 inches in height when it arrives at the tyer 70 to a height of about 12 inches. In addition, the compression cylinder assemblies 510 and 512 can compress a log from an initial height of about 63 inches to approximately 48 inches.

When the compression cylinder assemblies 510 and 512 are actuated, the compression plates 514 and 516 contact the top of a stack and press downward, compressing the stack against the stack receiving support 506. The tyer 70 includes two compression cylinder assemblies 510 and 512 and two compression plates 514 and 516. There is a gap 517 between the two compression plates so that a band or strap used to tie the stack may pass between the plates and be fastened while the stack is being held compressed.

Each of the compression cylinder assemblies 510 and 512 includes a guide rod 518 and 520, respectively, which is slidable in a bushing fixedly connected with the frame 500. The guide rods 518 and 520 resist any tendency of the compression plates 514 and 516 to tilt or twist while a stack is being compressed. This not only forces even compression of the stack, but also protects the seal within the compression cylinder assemblies 510 and 512 from excessive wear.

Figure 18:
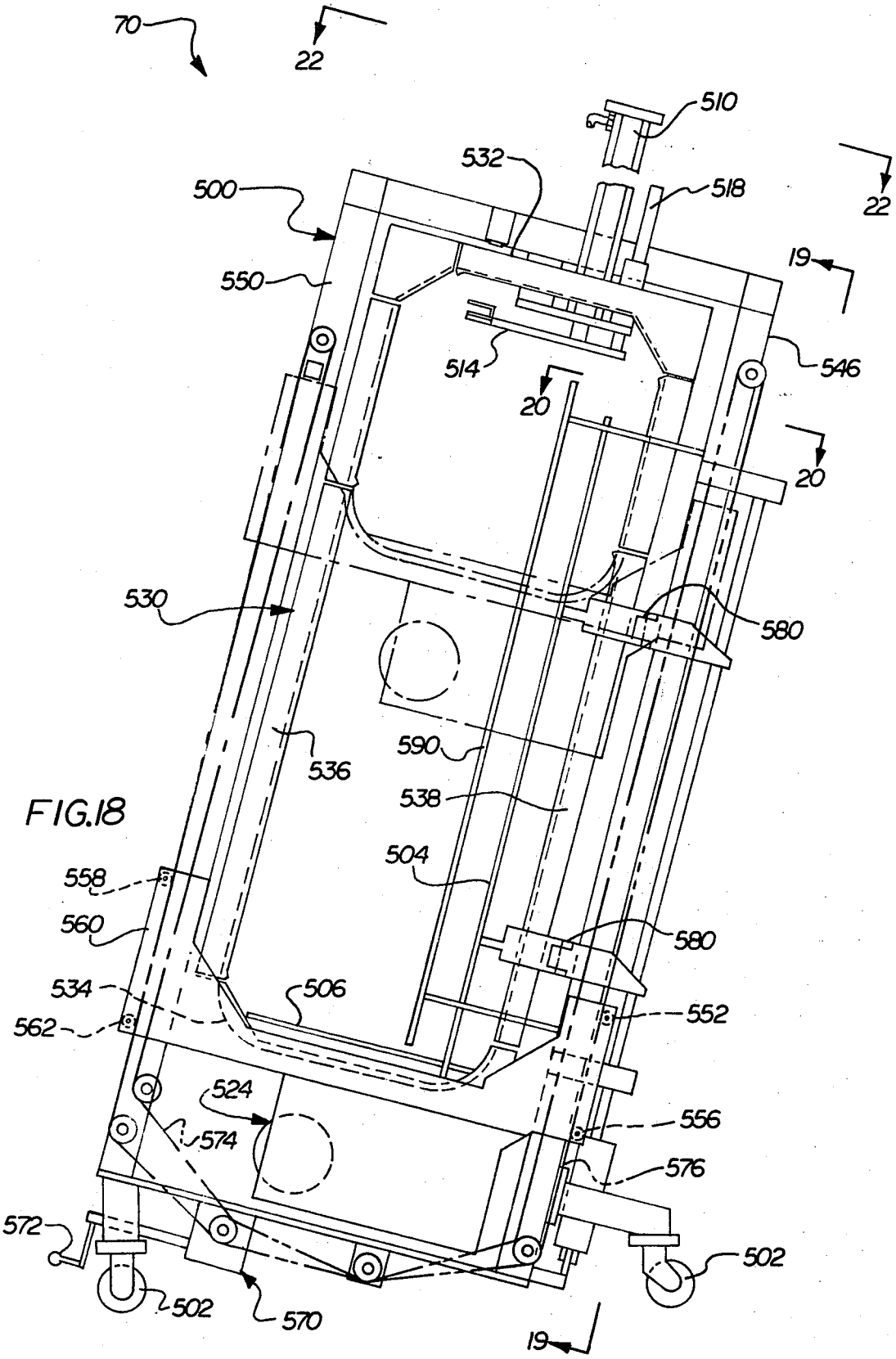
FIG. 18 is an elevation view of a tyer assembly forming a part of the stacker-tyer illustrated in FIG. 1.
Figure 19:
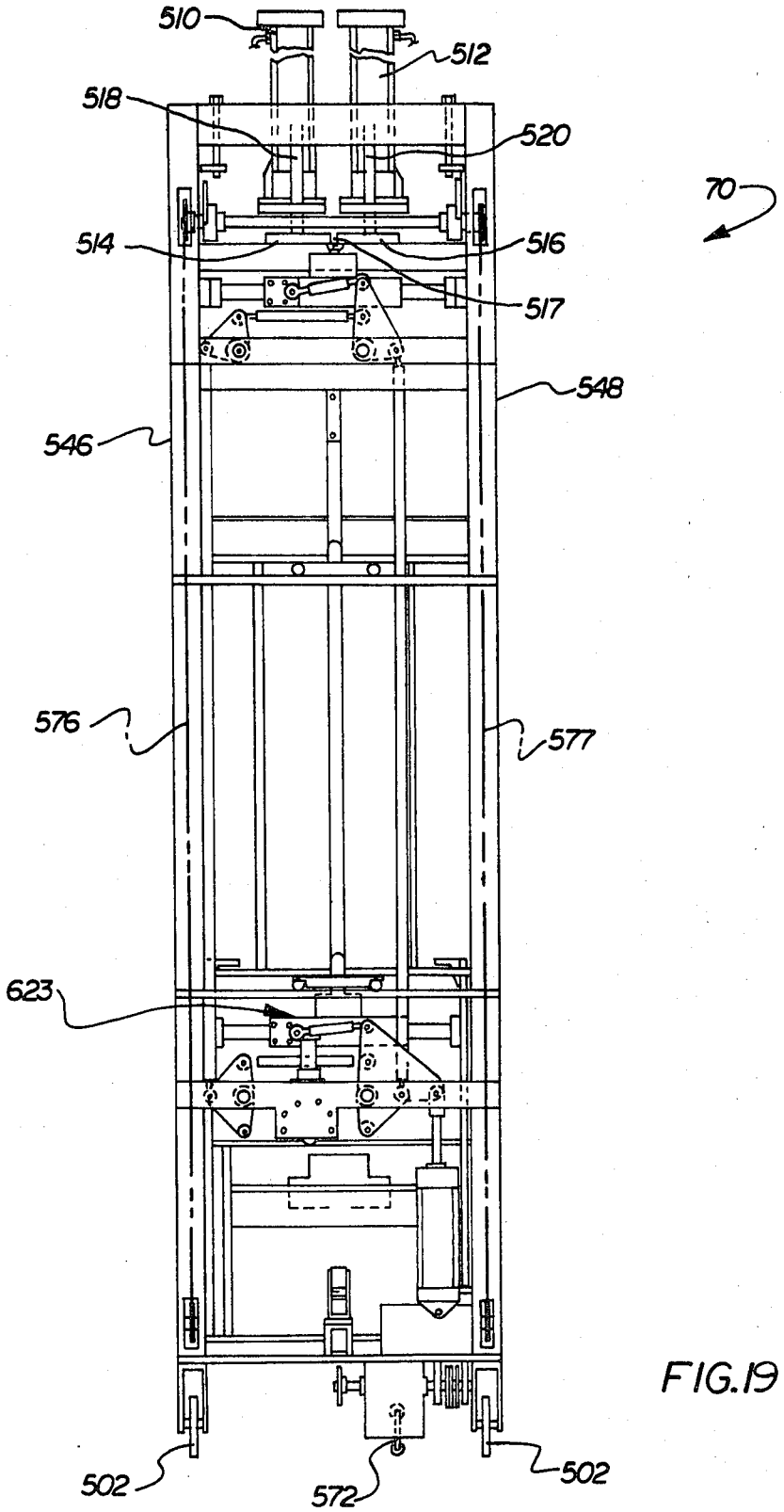
FIG. 19 is a rear elevation view taken along line 19—19 of FIG. 18.

Connected with and below the stack receiving support 506 is a conventional tie head 524 (FIG. 18). The particular tie head used is manufactured by Signode Corporation, 2600 N. Western Avenue, Chicago, Illinois 60647, sold under the trade name "SERIES MCD". The tie head 524 includes a supply of banding material and a mechanism which feeds the band through a trough 530 around the stack, tightens the band, cuts the end of the band and binds the ends together.

Mounted in the frame 500 is the trough 530 which is aligned with the tie head 524 and guides the band of material around the stack in the tyer 70. The trough 530 defines a generally rectangular path with rounded corners. In cross section the channel which forms the trough 530 is generally U-shaped (FIG. 20) and its open face is toward the inside of the rectangle. The open face of the U-shaped trough may be covered with a spring biased closure (not shown) which guides the band while it is being passed around a stack and opens in response tension in the band as it is being pulled tight.

The trough 530 includes a U-shaped upper end portion 532 (FIG. 18) which is fixedly connected with the frame and a U-shaped lower end portion 534 which is fixedly connected with the movable stack receiving support 506. In addition, the trough 530 includes a pair of removable side portions 536 and 538. When logs are being tied, the side portions 536 and 538 are positioned in the tyer 70 (as shown in FIG. 18) to connect the upper and lower end portions 532 and 534 of the trough 530, making a continuous smooth rectangular path for the band of material to pass through. When bundles are being tied, the side portions 536 and 538 of the trough 530 are removed, and the stack receiving support 506 and the tie head 524 are elevated to the level of the upper level of the stack receiving support 290 of the stacker assembly 56 (as shown in phantom in FIG. 18). This brings the lower end portion 534 of the trough 530 into juxtaposition with the upper end portion 532 thus forming a shorter and nearly square path for the band of material.

The frame 500 in which the stack support 506 moves is shown in plan view in FIG. 22. The frame 500 has a horizontal rear member 542, and extending from the middle of the rear frame member and perpendicular thereto is a member 544. Thus, the frame 500 in plan view has a generally T-shaped configuration. Extending generally vertically downward from opposite end portions of the rear frame member 542 are vertical members 546 and 548 (FIGS. 18–20), and a vertical member 550 extends downward from and is connected with the end of the member 544 which is remote from the rear frame member 542.

The stack receiving support 506 and the tie head 524 attached thereto are mounted for easy vertical movement in the frame 500. Guiding with the stack receiving support 506 are a pair of guide rollers 552 and 554 (FIG. 22). These guide rollers engage the rear surfaces of frame members 546 and 548, respectively. As shown in FIG. 18, a second guide roller 556 is positioned vertically below the guide roller 552, and another guide roller (not shown) is positioned vertically below the guide roller 554.

A forward guide roller 558 (FIG. 22) is connected with the stack receiving support 506 by means of a bracket 560 which extends forwardly from the stack receiving support. In a manner similar to the rear guide rollers 552, 554 and 556, a second forward guide roller 562 (FIG. 18) is positioned vertically below the forward guide roller 558. Both the guide rollers 558 and 562 bear against the forward vertical frame member 550.

The stack receiving support 506 with the attached tie head 524 and lower portion 534 of the trough 530 can be raised and lowered in the frame 500 by means of a crank and chain mechanism 570 (FIG. 18). When the hand crank 572 is turned, the chains 574, 576, and 577 (FIG. 19) move to raise or lower the stack receiving support. The chain 574 is connected with the bracket 560 (FIG. 22) which extends forward from the stack receiving support 506. Similarly, the chains 576 and 577 are connected with the brackets 578 and 579 which connect the rear guide rollers 552 and 554 with the stack receiving support 506.

To change from tying logs to tying bundles, the stack receiving support 506 is moved from the position shown in solid in FIG. 18 to the position shown in phantom. To do this, it is necessary to swing the rear skid plate 504 out of the way. To facilitate this, each half of the rear skid plate 504 is mounted by upper and lower hinges 580. After the rear skid plates 504 have been swung out of the way, the hand crank 572 can be turned and the stack receiving support elevated to its upper position for compressing and tying bundles. Locking means (not shown) are utilized to hold the stack receiving support, tie head, and lower end portion 534 of the trough 530 in its upper position. Thus, the tyer 70 (FIG. 18) is adapted to compress and tie either bundles or logs. It does this with only a single tie head 524 which may be moved in the frame of the tyer from a lower portion in which its stack receiving support 506 is positioned to receive logs and an upper position in which the stack receiving support is positioned to receive bundles.

The tyer 70 includes side supports 590 and 592 (FIGS. 18 and 20) which engage and support the side of a stack during compression and tying. Moreover, as will be discussed more fully below, the side supports 590 and 592 may be moved laterally to move the entire stack relative to the trough 530 so that the stack may be tied with two parallel bands on either side of a vertical center line through the stack.

The side supports 590 and 592 (FIG. 20) move from the position shown in solid in FIG. 18 to the position shown in phantom upon the arrival of a stack to be tied in the tyer 70. The side supports 590 and 592 are mounted on arms 594 and 596 which are pivotally connected with a base 598 for rotation about axes 600 and 602, respectively. A hydraulic cylinder 604 has one end portion connected with the base 598 and its movable piston rod 606 is pivotably connected with an intermediate lever 608. The intermediate lever 608 is mounted to pivot about an axis 610 which is fixed relative to the base 598. The end portion of the intermediate lever 608 which is remote from the piston rod 606 has a pin 609 which fits in a slot 611 in the arm 594. When hydraulic pressure is applied to the cylinder 604, the piston rod 606 extends causing the intermediate lever to rotate about axis 610, and this in turn causes the arm 594 to rotate about the axis 600 to bring the side support 590 from the position shown in solid to the position shown in phantom.

The arm 596 is connected through links 612, 614, 616 and 618 with intermediate lever 608. Consequently, when the hydraulic cylinder 604 is actuated, the side support 592 is brought from the position shown in solid in FIG. 20 to the position shown in phantom.

Figure 20:
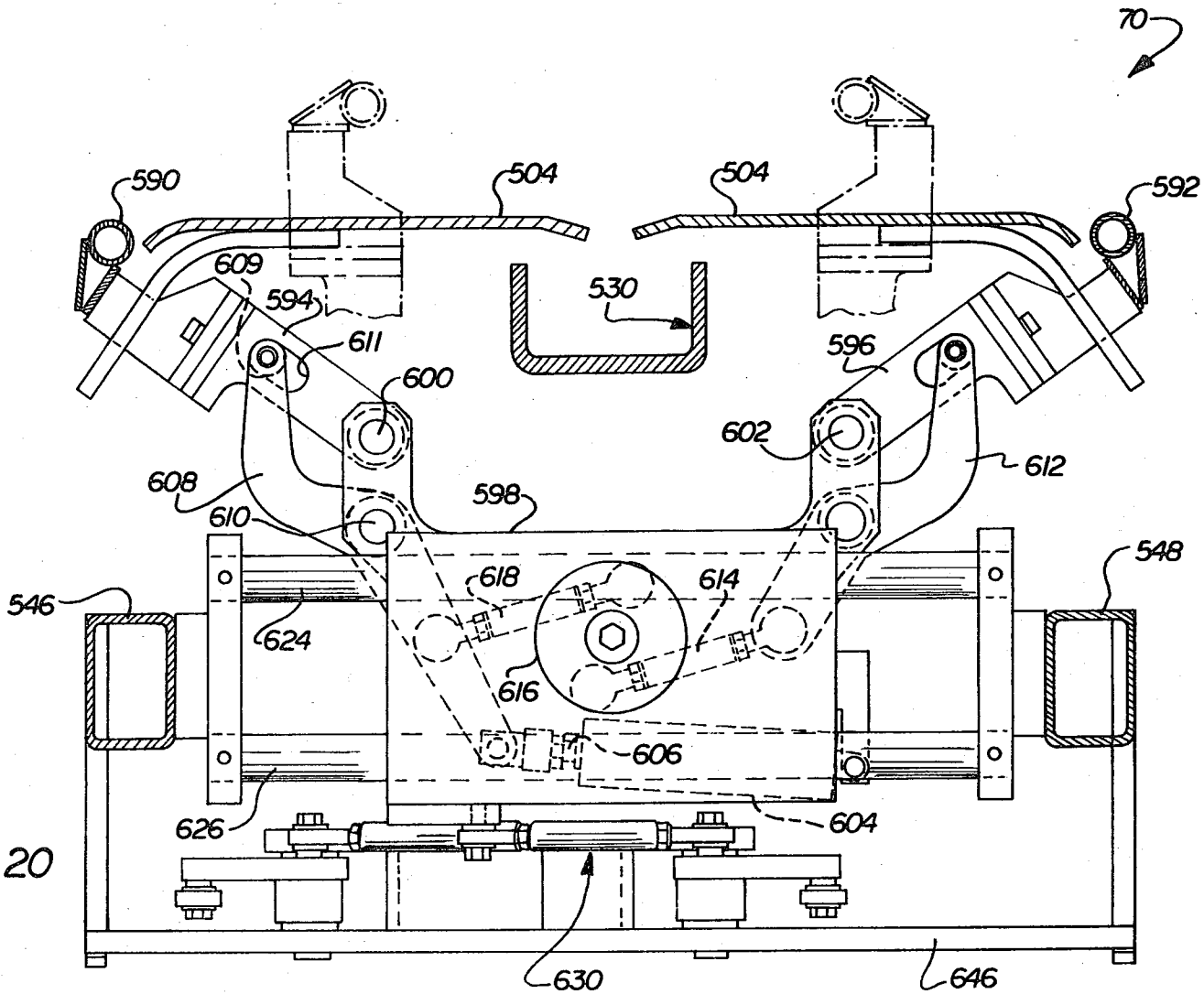
FIG. 20 is a view taken along line 20—20 of FIG. 18.

The mechanism illustrated in FIG. 20 is connected with the upper end portions of the side supports 590 and 592 to move them between the phantom and solid positions of FIG. 20. A similar mechanism 623 (FIGS. 19 and 21) is connected with the lower end portion of the side supports 590 and 592.

It is contemplated that logs will be tied with two bands and that bundles will be tied with only one band. However, the tyer 70 could be operated to tie either logs or bundles with either one or two bands. As mentioned above, the side supports 590 and 592 may be moved laterally with respect to the rear skid plates 504 and the trough 530. This is done when it is desired to place two parallel bands around a bundle or log. To this end, the base 598 (FIG. 20) is slidably mounted on a pair of cross shafts 624 and 626 which are in turn fixedly connected with the vertical frame members 546 and 548. A mechanism 630 is actuated by a hydraulic cylinder 632 (FIG. 21) and is effective to cause the base 598 to slide laterally with respect to the frame members 546 and 548. The base 633 of the lower mechanism 620 is similarly mounted for lateral sliding and also moves when cylinder 632 extends or retracts. This, in turn, causes the arms 590 and 592 to move the stack laterally.

When it is desired to place a single band around a compressed stack, the base 598 (FIG. 20) stays in the central position shown. In this case, the stack arrives in the tyer 70 (FIG. 1) and is automatically positioned by the shuttle mechanism 100 so that the vertical midline of the stack is aligned with the trough 530 (FIG. 20). The side supports 590 and 592 may then brought to the position shown in phantom in FIG. 20 in which they are symmetrical about the gap between the rear skid plates 504 and the trough 530. In some tying operations it may not be necessary to actuate the side supports 590 and 592. Then the compression cylinders 510 and 512 (FIG. 19) are actuated to compress the bundle and the tie head 524 (FIG. 18) is activated to pass a band around the stack and tie it. Thereafter the compression cylinders are released and the shuttle mechanism 100 moves the compressed and tied stack out of the tyer into the delivery station 80.

In the event that two bands are to be placed around the stack, once the stack is in the tyer and the side supports 590 and 592 (FIG. 18) are brought into engagement with opposite sides of the stack, clutches contained in links 616 and 623 are actuated to lock the side supports 590 and 592 in position. This is necessary so that the force of moving the log does not overcome the pressure in cylinder 604 allowing the side supports 590 and 592 to move.

Once the side supports are locked, the mechanism 630 is actuated to move the entire stock laterally with respect to the rear skid plate 504 and the trough 530 through which the band of material is passed. Once the stack is in the desired position with respect to the trough 530, the compression cylinders 510 and 512 extend, and the tie head 524 is actuated to place the first band around the stack. Thereafter, the compression cylinders 510 and 512 are released so that the compression plates 514 and 516 are drawn upward away from the stack, and the mechanism 630 is operated to slide the base 598 and the corresponding base of the lower mechanism 620 the opposite side of a vertical center line through the stack. It is contemplated that the bands might be about six inches apart. Once positioned for the second band, the compression cylinders 510 and 512 are again extended and the tie head 524 then ties the second band around the stack. Thereafter, the stack is returned to its original position centered over the trough 530.

Figure 21:
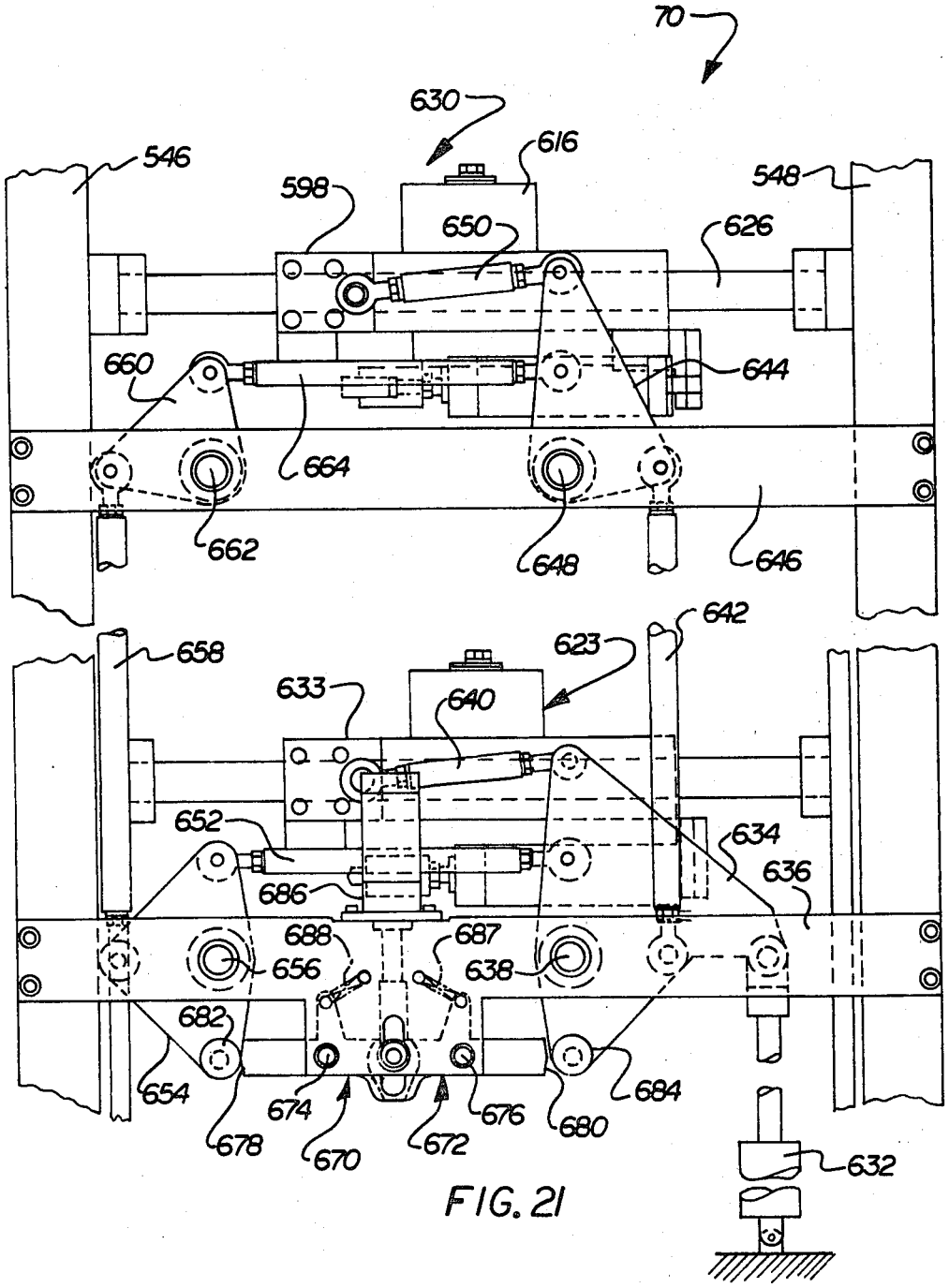
FIG. 21 is an enlarged view of portions of the tyer illustrated in FIG. 19.

The mechanism 630 for shifting the stack laterally (FIG. 21) is actuated by hydraulic cylinder 632. The mechanism 630 comprises a triangular link 634 which is pivotally mounted to a frame member 636 for rotation about axis 638. Connected with link 634 is one end portion of a rod 640, the other end portion of which is connected with the base 633 of the mechanism 623. Therefore, when the cylinder 632 is extended from the position shown in FIG. 21, it causes the link 634 to rotate counterclockwise (as shown in FIG. 21) about the axis 638. This in turn pushes the rod 640 to the left and the base 633 also moves to the left. When the cylinder 632 is contracted, the motions of the link 634 and rod 640 are reversed and the base 633 moves to the right of its central position as shown in FIG. 19.

The base 598 is connected with the link 634 through a series of rods and links which serve to move the base member 598 in the same direction and to the same extent as the base member 633. One end portion of a rod 642 is pivotally connected with link 634. The other end portion of the rod 642 is pivotally connected with the link 644 which is rotatably mounted to frame member 646 for rotation about axis 648. One end portion of a rod 650 is pivotally connected with link 644, and the other end portion of the rod 650 is connected with the base 598. When actuation of the cylinder 632 causes the link 634 to rotate clockwise (as viewed in FIG. 21) about the axis 638, the rod 642 moves downward and causes the link 644 to rotate clockwise about the axis 648. This in turn pulls the rod 650 and the base 598 which is connected with it to the right of the central position shown in FIG. 21.

While in theory it would be possible to operate the rod 642 in the reverse direction, that is, to push upward on the rod 642 to move the base member 598 to the left of its central position, it is not practical to do so. The rod 642 is long and slender and would tend to buckle under the large compressive forces which would be applied to the rod under those circumstances. Moreover, the logs are relatively heavy and the force required to move a log laterally in a short time are relatively large.

Instead of applying compressive forces to rod 642, a series of links and rods are used so that the base 598 may be moved to the left of its central position through a linkage whose slender member 658 is under tension, not compression. To this end, one end portion of a rod 652 is pivotally connected with link 634. The other end portion of the rod 652 is pivotally connected with a link 654 which is mounted for rotation on cross member 636 about an axis 656. One end portion of a rod 658 is pivotally connected with the link 654 and the other end portion of the rod 658 is pivotally connected with a link 660. The link 660 is pivotally mounted on frame member 646 for rotation about an axis 662. One end portion of a rod 664 is connected with link 660, and the other end portion of the rod 664 is connected with link 644. When the cylinder 632 is extended from the position shown in FIG. 21, link 634 rotates counterclockwise (as viewed in FIG. 21) about axis 638, moving rod 652 toward the left. Movement of the rod 652 toward the left causes link 654 to rotate counterclockwise about the axis 656, and this in turn pulls downward on rod 658. Downward motion of rod 658 causes link 660 to rotate counterclockwise about axis 662 which in turn pulls rod 664 toward the left. Leftward movement of rod 664 causes link 644 to rotate counterclockwise about its axis 648 and this achieves the final result of pushing rod 650 and the base 598 to which it is connected leftward.

Thus by extending or retracting the cylinder 632 from the position shown in FIG. 21, the bases 598 and 633 can be moved either to the left or the right of the central position shown in FIG. 19. This in turn causes the side supports 590 and 592 (FIG. 20) to move a stack in the tyer to the left or the right of the trough 530.

When it is desired to tie only a single band around a stack, the bases 598 and 633 are locked in a central position by means of a pair of levers 670 and 672 (FIG. 21). The levers 670 and 672 are pivotally mounted to frame member 636 for rotation, respectively, about axes 674 and 676. When the levers 670 and 672 are aligned with each other as shown in FIG. 21, the end face 678 of lever 670 and the end face 680 of lever 672 abut stops 682 and 684 which are connected with links 654 and 634, respectively. The contact between stop 682 and end face 678 prevents the link 654 from rotating counterclockwise, and this prevents the bases 598 and 633 from moving to the left of their central position. The contact between end face 680 and the stop 684 prevents the link 634 from rotating clockwise, and this prevents the bases 598 and 633 from moving to the right of their central position. The levers 670 and 672 may be moved out of alignment by actuation of hydraulic cylinder 686 which pulls the levers against the bias of springs 687 and 688 which tend to return them to their aligned position illustrated in FIG. 21.

The tyer 70 includes a mechanism illustrated in FIGS. 22A and 22B for detecting whether or not a stack has been successfully tied. A tie attempt can fail for any number of reasons ranging from an absence of strap material to an inadequate binding. Stacks that are not successfully tied must be detected so that they are not allowed to move on for further handling where loose, unbound, articles could jam machinery.

The mechanism illustrated in FIGS. 22A and 22B includes a finger 689 which extends from the compression plate 514 and which is temporarily caught under the strap tied around a stack. When the compression plate 514 is lifted after tying, the finger 689 is displaced by the strap indicating a successful tying operation. If the tying operation was unsuccessful, the finger is not displaced.

The finger 689 extends across the gap between the compression plates 514 and 516 and is pivotably mounted so that it is temporarily trapped by the strap of banding material while the plates 514 and 516 are compressing a stack and the strap is tied around a stack. The finger 689 pivots out from under the strap (as shown in phantom in FIG. 22B) as the compression plates 514 and 516 are lifted from the stack. A spring (not shown) may be used to bias the finger 689 to the position shown in solid lines in FIG. 22B. The finger 689 is pivotably mounted in a slot 690 (FIG. 22A) in compression plate 514. The finger 689 is connected with shutter 691 by a linkage comprising shaft 692, a lever 693 connected with shaft 692, a link 694 connected with lever 693 and with arm 695 which also carries shutter 691.

The mechanism for signaling a successful tying operation also includes a photo cell 696 and a mirror 697. The mirror 697 is mounted on a bracket 698 on the compression plate 514 which moves up and down with each tying operation. The photo cell 696 is mounted on the stationary and relatively vibration-free frame member 544 (FIG. 22) of the tyer 70. The shutter 691 (FIG. 22B) is coated with a non-reflective material so that when it is in the position shown in solid, no light is reflected from the mirror 697 to the photo detector 696. When a strap pivots the finger 689, the shutter 691 is temporarily moved out of the path of reflected light and the photo detector receives reflected light indicating a successful tying operation.

Shuttle Mechanism

The shuttle mechanism 100 (FIG. 1) includes a frame 700 which supports a laterally reciprocatable carriage 702 and a drive mechanism for causing the carriage to reciprocate. The drive mechanism 704 (FIGS. 25–27 and 29) is effective to reciprocate the carriage 702 between an extreme right position as illustrated in FIG. 23, and an extreme left position illustrated in FIG. 24. The carriage 702 includes four selectively extendable pusher assemblies 706, 708, 710 and 712 (FIGS. 1, 23 and 24) which, when extended, engage stacks to move them laterally as the carriage moves laterally.

The sequence of operation of the shuttle mechanism 100 can be described with reference to FIGS. 1, 23, and 24 as follows. Assuming the carriage 702 is initially in its central position illustrated in FIG. 1, sheet-like articles are stacked in the stacker section 58 of the stacker assembly 56. When a stack (or a half stack if compensated bundles are to be made) is completed in the manner previously described, three pusher assemblies 708, 710 and 712 are extended and the drive mechanism engages the reciprocating carriage 702 to move it to the right to the position illustrated in FIG. 23. As this happens, the pusher assembly 708 engages the trailing side of the stack in the stacker section 58 and pushes it toward the compensator section 66. Simultaneously, the pusher assembly 710 engages any stack which might have been in the compensator 66 and pushes it toward the tyer 72, and the pusher assembly 712 pushes any stack which might have been in the tyer 72 into the delivery station 82. Once the reciprocating carriage 702 has completed moving the stack from the stacker section 58 into the compensator section 66, the pusher assemblies 708, 710 and 712 are retracted, and the carriage 702 returns from its righthand position illustrated in FIG. 23 to its central position illustrated in FIG. 1.

When the succeeding stack (or half stack) has been stacked in the stacker section 58, it will be moved to the left from the stacker section 58 into compensator section 64. To accomplish this, the pusher assemblies 706, 708 and 710 are extended, as illustrated in FIG. 24, and the drive mechanism 704 moves the reciprocating carriage 702 to the left of its central position as illustrated in FIG. 24. Again, once the stacks have been moved, the pusher assemblies 706, 708 and 710 are retracted and the reciprocating carriage 702 returns to its central position.

FIGS. 25, 26 and 27 each show a portion of a side elevation view of the shuttle mechanism 100 including the drive mechanism 704 which drives the carriage 702. The Figures may be placed edge to edge with FIG. 25 on top, FIG. 26 in the middle and FIG. 27 on the bottom to form a continuous drawing showing a complete side elevation view of the shuttle mechanism 100.

The drive mechanism 704 includes a crank 714 shown schematically in FIG. 26 and in more detail in FIG. 28. The crank 714 is driven by a motor 716 (FIG. 27) which is connected by a belt to a countershaft 718 (FIG. 26). The countershaft 718 carries a flywheel, a brake and a clutch through which the motor 716 is selectively connected to a 90 degree gear box 720. The output shaft 722 of the gear box 720, in turn, drives the crank 714.

To reduce distortion of to the crank 714 caused by large torques, it is driven from both sides. One side of the crank 714 is driven directly by the output shaft 722 of the gear box 720. The other side of the crank 714 is driven from a sprocket 724, a chain 726, a sprocket 728 (FIG. 25) carried on a cross shaft 730 which carries at its opposite end another sprocket 732 which in turn drives a chain 734 which is connected by a sprocket 736 (FIG. 26) with a stub shaft 738 to which the crank 714 is connected.

The crank 714 (FIG. 28) is a double throw crank which is rotatable about the axis of output shaft 722 and stub shaft 738. The crank 714 has a pair of diametrically opposed pins 740 and 742. The pins 740 and 742 are equally spaced from the axis about which the crank 714 rotates, i.e., the axis of shafts 722 and 738, and each pin carries a connecting rod 744 and 746, respectively, journaled thereto.

Opposite from the pins 740 and 742 the connecting rods 744 and 746, carry wrist pins 748 and 750, respectively, which are rotatably mounted in their respective connecting rods. The pins 748 and 750 carry bearing blocks 752 and 754, respectively, which are rotatable on the pin 750 and are axially slidable within slides 756 and 758 (FIG. 29). The slides 756 and 758 guide the bearing blocks 752 and 754 and thereby guide the pins 748 and 750 as the crank 714 rotates.

The slides 756 and 758 are pivotable about axes 760 and 762, respectively, which are fixed with respect to the frame 700. Cylinders 764 and 766, respectively, have one end pinned to the frame 700 and the other end pinned to one of the slides 756 and 758. Extension and retraction of the cylinders 764 and 766 cause the slides 756 and 758 to pivot about their respective axes.

As can be seen in FIG. 29, as the crank 714 rotates, the pins 748 and 750 move in generally opposite directions. By connecting one of the pins 748 and 750 with the carriage 702, it is possible to make the carriage move from its central position to one side and back as the crank makes one complete rotation. The slides 756 and 758, and the cylinders 764 and 766 make possible selective connection of the pins 748 and 750 to the carriage 702 so that the carriage may be moved to one side or the other from the central position. To move the carriage 702 from its central position (FIG. 1) to the right (as viewed in FIG. 29 and to the left as viewed in FIGS. 1, 23 and 24) a controller 768 (FIG. 29) connects the pin 750 with the carriage when the crank 714 is rotated so that the pin 750 is at the "bottom" of its stroke, i.e., as close to the axis of rotation of the crank as possible. When the crank 714 is then rotated through a complete revolution (360 degrees), the carriage 702 makes an excursion from its central position to the position illustrated in FIG. 24 and back to its central position. Thereafter, the controller 768 disconnects the pin 750 by retracting cylinder 766 and connects pin 748 by extending cylinder 764. Rotation of the crank 714 through another complete revolution moves carriage 702 in the opposite direction and back to the central position.

When the double throw crank 714 rotates 180 degrees the carriage 702 starts from a stopped position centered about the stacker section 58 (FIG. 1), accelerates as it moves to, e.g., the left and decelerates so that by the time it is in its left extreme position (FIG. 24) it is again fully stopped. As the crank 714 rotates the next 180 degrees the carriage 702 is again accelerated and decelerated to a full stop by the time it returns to its center position (FIG. 1). A single throw crank having twice the radius of the crank 714 could move the carriage the same distance as the double throw crank 714, but it would not decelerate to a full stop at the central position nor could it be controlled to move always to the same side of its central position as can the drive mechanism 704 (as is discussed below).

FIG. 30 is a schematic illustration of one half of the reciprocating carriage 702. The portion of the carriage 702 not shown is a mirror image of the portion shown in FIG. 30.

The reciprocating carriage 702 (FIG. 30) includes a pair of U-shaped brackets 770 (only one shown) which are adapted to receive one of the pins 748 and 750. The U-shaped socket 770 has an upwardly opening U-shaped opening which is adapted to receive the pin 748. The pin 748 may be moved into or out of the U-shaped socket by actuation of the cylinder 764 (FIG. 29). When the carriage 702 is in its central position, and the crank 714 is in the position where the pin 748 is pulled in to its closest position to the axis of rotation of the crank, the cylinder 764 may be extended causing the slide 756 to pivot clockwise about the axis 760 as viewed in FIG. 29, and this causes the pin 748 to move down into the bracket 770. On the other hand, retraction of the cylinder 764 causes a slide 756 to rotate in the opposite direction and lifts the pin 748 out of the U-shaped socket.

Once the pin 748 is in the U-shaped socket, the crank 714 may be rotated to cause the reciprocating carriage 702 to move from its central position illustrated in FIG. 1 toward its righthand position illustrated in FIG. 23 and back again to the central position. Since the pin 750 moves in the opposite direction from the pin 748, it is obviously necessary that the pin 750 be disconnected from the carriage during motion of the carriage to the right of its central position. This is accomplished by retracting cylinder 766 which pulls the pin 750 out of engagement with the U-shaped socket corresponding to socket 770.

When it is desired to move the reciprocating carriage 702 to the left of its central position, the cylinder 764 is retracted, lifting the pin 748 out of engagement with socket 770, and simultaneously the cylinder 766 is extended. This causes the slide 758 to rotate counterclockwise about the axis 762 (as viewed in FIG. 29) and this in turn causes the pin 750 to drop into a socket corresponding to socket 770. Whereupon, the crank 714 may be rotated and the reciprocating carriage 702 moves toward the left of its central position and returns.

The drive mechanism 704 can be operated to move the carriage 702 only to one side of its central position. This is accomplished by simply engaging one of the pins 748 or 750 with the corresponding socket 770 on the reciprocating carriage 702 and leaving it engaged while the other pin (750 or 748) remains disengaged. This might prove advantageous when the supply of incoming articles is not arriving at such a speed that the use of both tyers 70 and 72 and deliveries 80 and 82 is necessary. This is also advantageous when some portion of the machinery on one side or the other needs repair. In the event, for example, that one of the tyers 70 or 72 malfunctions, the entire printing press, folders, and stuffers, must be slowed down to half of their normal operating speed in order that the stacker and the single remaining tyer can keep up with the supply. However, this is far better than the alternative of having to shut down the entire press while a single tyer is being repaired. Further, when an unsuccessful tieing operation has been detected on one side, the carriage 702 can automatically move stacks only to the opposite side until the untied stack is removed.

The frame 700 is equipped with a linear ball bushing (FIG. 25), and a rod 773 connected with the upper portion of the carriage 702 slides therein. Rollers 774 are mounted to the lower portion of the frame 700 for rotation in a generally vertical plane which is laterally offset from the axis of rod 773 so that the reciprocating carriage 702 is inclined at a 15 degrees angle from vertical. A U-shaped channel 775 is connected with the carriage and surrounds the rollers 774. In this way, the carriage 702 may slide laterally in a plane which is approximately parallel with the rear skid plates 380 (FIG. 8) of the stacker assembly 56 and the rear skid plates 504 (FIG. 18) of the tyers 70 and 72.

One half of the reciprocating carriage 702 is illustrated in FIG. 30. Although only half of the reciprocating carriage 702 is illustrated, it will be understood that the opposite half is generally symmetrical with the half illustrated and integral therewith, and the description of the half illustrated is equally applicable to the half not shown if left and right are interchanged.

The reciprocating carriage 702 includes four horizontal tubes 790, 792, 794 and 796 which are interconnected by a plurality of vertical members 798, 800, 802 and 804. These horizontal tubes 790–796 and vertical members 798–804 form a rigid framework to which the rods 773 and channels 775 are connected.

The pusher assemblies 710 and 712 are connected with the vertical members 802 and 804, and 798 and 800, respectively. The pusher assembly 712 includes upper pusher bars 806 and 808 and lower pusher bars 810 and 812. The upper pusher bars 806 and 808, when extended, fit between the compensator section 66 (FIG. 1) and the tyer 72. Upon acceleration of the reciprocating carriage 702 to the right of the central position illustrated in FIG. 1, the upper pusher bar 806 engages the side of a bundle in tyer 72 and pushes the bundle toward the delivery section 82. At the same time the pusher bar 808 serves to slow a bundle being pushed from the compensator section 66 toward the tyer 72 as the reciprocating carriage 702 decelerates. When logs are being made instead of bundles, the lower pusher bar 810 is positioned coaxial with the upper pusher bar 806 and is connected therewith. Similarly, the pusher bar 812 is positioned coaxial with the upper pusher bar 808 and is connected with it. The pusher bars 806 and 810 thus form a continuous bar to push against the side of a log to move the log laterally in the stacker-tyer 50.

The pusher bars 806, 808, 810 and 812 are mounted adjustably so that the distance between them can be varied. This is necessary to accommodate varying widths of articles being stacked. When the articles being stacked are relatively narrow, the distance between the pusher bars 806, 810 and the pusher bars 808, 812 must be increased so that the sides of the stacks will have good support and the stacks will remain in vertical alignment during lateral movement. Conversely, when the articles being stacked are relatively wide, the pusher bars 806, 810 and 808, 812 are brought closer together.

The pusher bars 806, 808, 810 and 812 are each supported by two brackets, all of which are identical. Therefore, only the bracket 814 will be described in detail. The bracket 814 is fixedly connected with the upper pusher bar 806 and includes a rod 815 which extends through a bar 816. The rod 815 of the bracket 814 is generally perpendicular to the upper pusher bar 806 and may be slid relative to the bar 816 to select the desired position of the upper pusher bar 806. Thereafter, a locknut (not shown) is tightened onto the rod 815 to clamp it into position relative to the bar 816. The pusher bars 806 and 808 are thus adjustably mounted to the bar 816 by brackets similar to bracket 814.

The bar 816 forms one side of a four bar linkage which permits the pusher bars 806 and 808 to be extended or retracted away from or toward the horizontal bars 790–796 and the vertical members 798–804 which form the fixed framework of the reciprocating carriage 702. The bar 816 has a pivotal connection with two links 818 and 819, and these links are in turn pivotably connected with vertical members 798 and 800 by means of shafts 820 and 822, respectively. The shafts 820 and 822 are rotatably mounted in the vertical members 798 and 800 and the link 819 is fixedly connected with the shaft 822 and the link 818 is fixedly connected with the shaft 820. When the shaft 822 is rotated, the links 818 and 819 rotate with it and thus cause the bar 816 to move toward or away from the framework of the reciprocating carriage. As will be discussed below, the shuttle mechanism 100 includes means for causing the shaft 822 to rotate to thereby selectively extend or retract the pusher bars 806 and 808.

The lower pusher bars 810 and 812 are mounted in a similar fashion except that when the lower pusher bars are in use, they are connected directly with the upper pusher bars and hence there is no need to separately actuate the linkage which connects the lower pusher bars 810 and 812 with the framework of the reciprocating carriage.

The remaining pusher assembly 710 illustrated in FIG. 30 and the pusher assemblies 706 and 708 are generally the same as the pusher assembly 712 and consequently a detailed description is not required. However, it should be noted that lower link 832 of the pusher assembly 710 is rotatably mounted on shaft 822 so that movement of the pusher bars of pusher assembly 710 is not affected by rotation of shaft 822. However, the upper link 830 is fixedly connected with shaft 834, and so rotation of shaft 834 is effective to extend or retract pusher assembly 710.

Rotation of shaft 822 is accomplished by means of a gear 836 fixedly connected therewith. A rack 838 is disposed in meshing engagement with the gear 836 and extends generally perpendicular to the shaft 822 and parallel with the vertical members 798–804. The rack 838 is supported for sliding movement in a bearing blocks 840 and 841 which are fixedly connected with the frame work of the carriage 702. When the rack 838 is moved vertically, it causes the shaft 822 to rotate which in turns extends or retracts the pusher bars of pusher assembly 712. A similar rack 842 and gear 844 serve to rotate the shaft 834, and to thereby extend or retract the pusher bars of pusher assembly 710.

A mechanism 850 (FIG. 27) selectively raises and lowers the racks 838 and 842 (FIG. 30) and the corresponding racks (not shown) which operate the pushers 708 and 706 (FIGS. 1, 23, and 24). The mechanism 850 includes a pair or horizontal, parallel tracks 852 and 854 (FIG. 32) connected with the frame 700 of the shuttle mechanism 100. The rack 838 which actuates the pusher assembly 712 carries a wheel 856 adapted to ride in the tracks 852 and 854. Similarly, the rack 842 (FIG. 30) carries a wheel 858, and the wheels 860 and 862 (shown somewhat schematically in FIGS. 35A–35D) which actuate the pushers 708 and 706, respectively, also ride in the tracks 852 and 854 (FIG. 35).

At spaced intervals along the tracks 852 and 854 are ten switching sections 870, 872, 874, 876, 878, 880, 882, 884, 886, and 888. For purposes of simplicity of description, the switching sections 870–888 may divided into three groups: an "A" group consisting of switching sections 878 and 880; a "B" group consisting of switching sections 870, 872, 874 and 876; and a "C" group consisting of switching sections 882, 884, 886 and 888. This grouping is convenient because, as will be discussed below, when the switching sections are actuated, all the sections in each group move in unison.

Figure 35A:
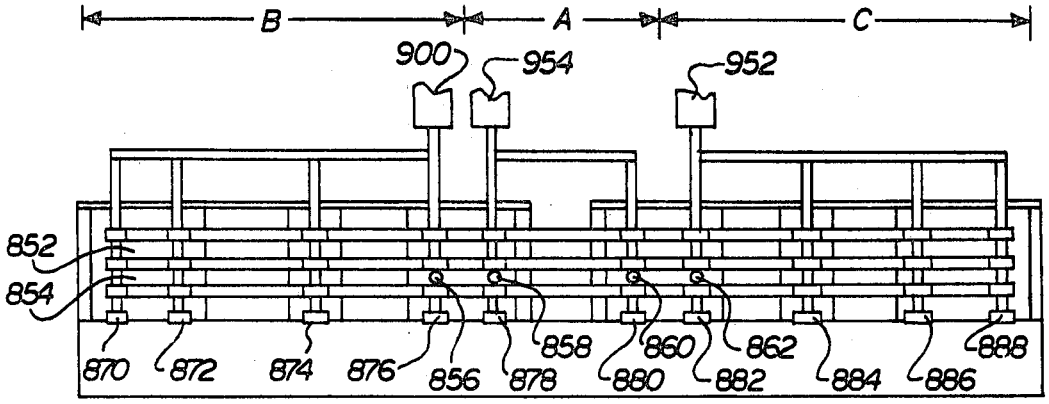

The pusher assemblies 706–712 are retracted when the followers 856–862 ride in the lower track 854 (FIG. 35A). The switching sections 870–888 are selectively actuatable to elevate the followers 856–862 which in turn causes the pusher assemblies to extend, as described above with reference to FIGS. 1, 23, and 24. The switching sections 870–888 are actuatable in the A, B and C groupings described. The mechanism for switching each of the groups are generally similar and therefore only the mechanism for switching the B group will be described in detail.

Switching section 876 of the B group (FIG. 33 is operated by a cylinder 900, one end of which is connected with a housing 901 connected to the frame 700 and the other end of which is pivotally connected with an arm 902. The arm 902 is mounted for rotation about the axis of a shaft 904 which is rotatably supported by the frame 700. One end of the arm 902 is connected with the switching section 876. In FIG. 33 the cylinder 900 is shown in its retracted position and the wheel 856 is aligned with the lower track 854. When the cylinder 900 is extended, it causes the arm 902 to rotate counterclockwise about the axis of shaft 904 as viewed in FIG. 33, thus elevating the switching section and the wheel 856 to the upper position shown in phantom in which the wheel is aligned with the track 852.

Referring to FIGS. 33 and 34, it can be seen that the switching section 876 includes a slidable body member 928 which is connected with the arm 902 and is vertically slidable in the frame 700 in response to movement of the arm 902. The body member 928 carries four extensions 930, 932, 934, and 936 (FIG. 33) which define three slots 938, 940, and 942. The slots 938, 940, and 942 are spaced apart from each other the same distance as are tracks 852 and 854. The block 928 is slidable between a position in which the slots 938 and 940 are aligned with the tracks 852 and 854, respectively, and a position in which the slots 940 and 942 are aligned with the tracks 852 and 854, respectively. Adjustable stops **943*a* and 943*b* are provided to assure that the slots 938, 940 and 942 align properly with tracks 852 and 854. By moving the block 928 when a wheel such as the wheel 856 is between two of the extensions 930–936 of the block 928, the wheel can be moved from alignment with the track 852 to alignment with track 854**, or vice versa.

The remaining switching sections 870, 872 and 874 (FIG. 34) are actuated by arms 944, 946 and 948 which are similar to arm 902 and which are fixedly connected with shaft 904. In addition, a tubular stiffening member 950 interconnects the arms 902, 944, 946 and 948 rigidly. Therefore when cylinder 900 is actuated, all the arms in the B group operate their respective switching sections simultaneously.

The C group is actuated by a single cylinder 952 which is connected in the same way as cylinder 900 to the various switching sections in its group, and the switching sections in the A group are similarly actuated by cylinder 954.

Figure 35B:
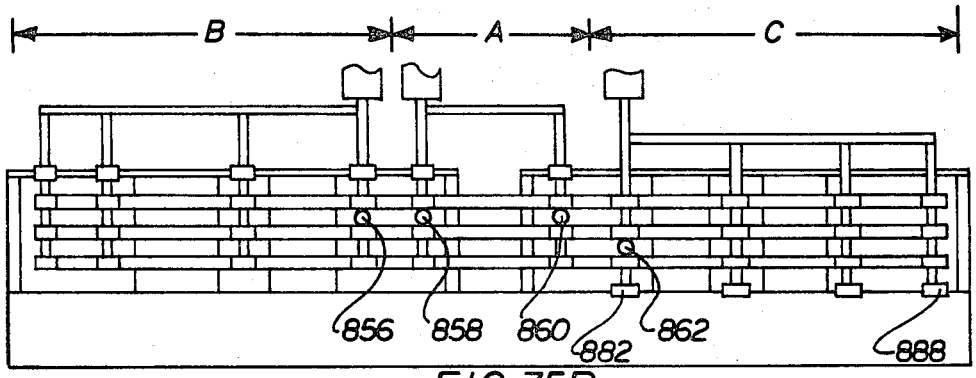
Figure 35C:
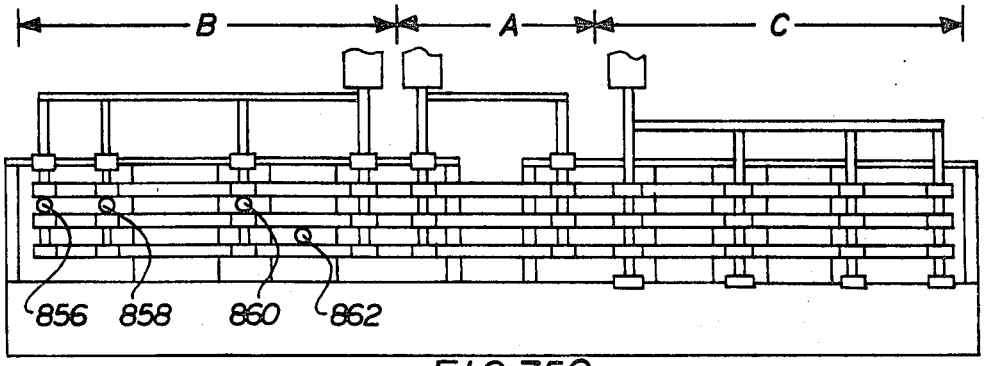
Figure 35D:
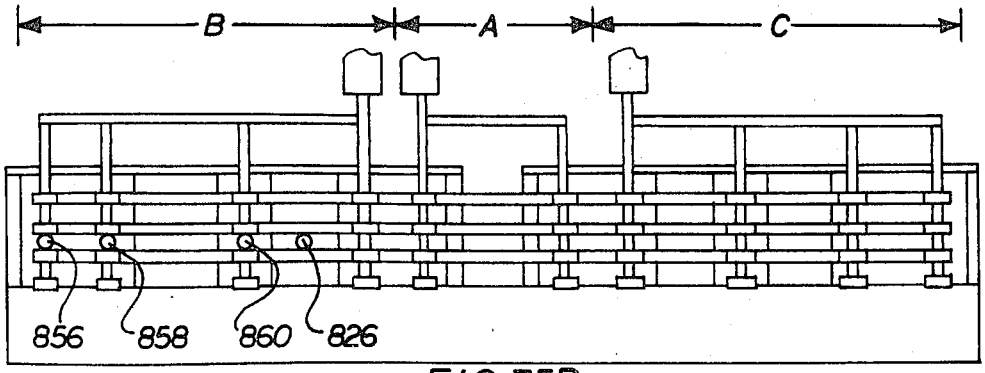

In operation, when the pusher assemblies 706–712 are all in their retracted positions as shown schematically in FIG. 1, all the wheels 856–862 are in the lower track 854 as shown in FIG. 35A. In order to extend the pushers 708, 710 and 712 in preparation for movement from the center position shown in FIG. 1 to the position shown in FIG. 23, the switching sections in the A group and in the B group are moved upward as shown in FIG. 35B. Whereupon the shuttle drive mechanism 704 (FIG. 29) moves the shuttle to the right to the position shown in FIG. 23 (which is to the left in FIGS. 35A–35D), and the wheels 856–862 are moved to the position shown in FIG. 35C. Thereafter, ths pushers are retracted by moving the switching sections in the A and B groups downward to the position shown in FIG. 35D. This causes the wheels 856, 858 and 860 to move down into alignment with track 854 and the pusherse 708, 710 and 712 to retract. Thereafter, the carriage returns to its central position shown in FIG. 1 and the wheels 856–862 return to their initial position. Upon movement of the carriage to the left of its center position as illustrated in FIG. 24 (which is to the right in FIG. 35), the switching sections in the A group and C group are actuated to elevate the switching sections associated therewith and the process is repeated.

Summary

Thus, it is clear that the present invention provides a stacker-typer 50 (FIG. 1) which receives a stream of sheet-like articles and forms them into either tall stacks (logs) or short stacks (bundles). The present invention uses two tyers 70 and 72, one located immediately adjacent each side of the stacker 56, and the stacks (either bundles or logs) are shifted alternately from the stacker laterally and directly into one or the other of the tyers. With the tyers 70 and 72 right next to the stacker 56, lengthy conveyors are eliminated.

The stacker 56 receives a stream of sheet-like articles from an overhead conveyor. The leading edge of each article hits deflectors 150 and 152 (FIG. 5) and the articles drop to form a stack on a downwardly movable platform 158 (FIG. 8) which supports the bottom of the stack. As the stack grows, the platform 158 is moved downward, so that the top of the stack remains at approximately the same level.

The stacker 56 also includes a stack support 290 for receiving tall stacks (logs) from the movable platform. An upper stack support 292 for receiving short stacks (bundles) from the movable platform 158 is removably positioned above the stack support 290. When the stack being built has a preselected number of sheet-like articles in it, the platform 158 moves downward to the appropriate level where the stack is transferred from the platform to one of the stack supports 290 and 292 and moved laterally to one or the other of the tyers 70 and 72 (FIG. 1).

The stack support 292 and support 382 (FIG. 16) on the compensator 64 and a corresponding support **382*a* on compensator 66 (FIG. 1B) extend laterally across the entire width of the stacker 56 when bundles are being built. The platform 158 supporting a bundle is moved downwardly as the bundle is built, and when the bundle is complete the platform moves rapidly to the level of the stack support 292. The bundle is transferred to the stack support 292 and then pushed laterally across the stack support into one or the other of the tyers 70 and 72** where the bundle is compressed and tied.

When log-sized stacks are to be built, the stack support 292 is removed (FIG. 1A). As articles pile on to build a log, the platform 158 moves downward past the level where the stack support 292 had been for receiving bundles. When a full log has been built the platform 158 moves downward rapidly to the level of the stack support 290. The log is transferred to the stack support 290 and moved laterally across one of the stack supports 405 and **405*a* in the compensator sections 64 and 66 into an adjacent tyer 70 or 72 (FIG. 1**) (which has been adjusted to tie a log-sized stack). The tyer then compresses the log and ties it.

The stacker includes a series of platforms **158*a*–158*h* which move downward along a stacking path inclined from vertical. Movement of the platforms 158*a*–158*h*** is coordinated so that when one stack has a preselected number of articles in it, the succeeding platform moves into position to intercept the incoming stream of articles and thus begin the succeeding stack.

As the stacks ae completed, they are pushed laterally from the stacker assembly 56 into one or the other of the tyers 70 and 72 by a shuttle mechanism 100 (FIG. 1) with the bottom of the stacks resting on one of the stack supports 290 and 292 and one of the stack supports 382 or 405 in the compensator sections 64 and 66 within the stacker assembly 56. The present invention eliminates conveyors between the stacker 56 and the tyers 70 and 72 and the problems associated with them. The resulting stacker-tyer 50 (FIG. 1A) is more compact than prior art devices.

The shuttle mechanism 100 moves the stacks from the stacker assembly 56 (FIG. 1) to the tyers 70 and 72. The shuttle mechanism 10 has pushers 706, 708, 710 and 712 which engage two opposite sides of the stack to push the stack laterally while simultaneously keeping the stack in vertical alignment during movement. A third side of the stack is supported by skid plates 380 in the stacker section 58 and skid plates 390, 390*a* zand 504 and 504*a* in the compensators and tyers, respectively, (FIG. 1A) which extend laterally parallel to the direction of movement of the stack. The skid plates 380 are inclined from vertical with the result that the stack leans against them. The skid plates 380 extend the full length of the stacks and laterally from the stacker 56 to each of the tyers 70 and 72. The pushers 706, 708, 710, and 712 (FIG. 1) of the shuttle mechanism 100 and the skid plates 380 (FIG. 1A) support three sides of the stacks as they are moved across stack supports 292, 382 or 382*a* or 290 and 405 or 405*a* from the stacker 56 to the tyers 70 and 72 so that the stacks arrive at the tyers in vertical alignment and do not require realignment prior to tying.

The shuttle mechanism 100 (FIG. 1) of the present invention ordinarily moves stacks alternately to one or the other of the tying mechanisms 70 and 72 (see FIGS. 23 and 24). However, the shuttle mechanism 100 may be adjusted so that every stack goes to the same tyer (either 70 or 72). This permits efficient stacking and tying when articles are arriving relatively slowly as well as permitting repair or maintenance of one tyer without stopping, stacking and tying entirely.

Related Cases

The conception and development of a stacker tyer with tyers immediately adjacent a stacker (which may include compensator mechanisms) and a means for moving the stacks from the stacker to one or the other of the tyers while keeping the stacks in alignment is the work of Mr. Merwarth, the applicant herein. Mr. Merwarth also conceived and developed such a stacker tyer in which the stacks are kept in alignment by fixed rear skid plates and bottom supports and retractable pushers connected to a shuttle mechanism which engage two sides of the stacks during movement. The concept of a stacker which can stack either short stacks (bundles) or tall stacks (logs) is also the work of Mr. Merwarth alone.

Mr. Merwarth and Mr. McGinnis jointly conceived and developed a shuttle mechanism for moving each of a series of stacks from a stacker alternately to one or the other of a pair of tyers which also has the ability to move each stack in a series of stacks to the same tyer.

Mr. Merwarth and Mr. McGinnis also jointly developed a shuttle mechanism with extendable and retractable pushers which together with an inclined rear skid plate and a stack support for supporting the bottom of a stack operates to move a stack between a stacker and one of a pair of adjacent tyers while maintaining the stack in vertical alignment and in which the positions of the pushers are controlled by actuator rods with wheels which ride in a pair of tracks and which may be selectively switched between the tracks to extend and retract the pushers.

Mr. McGinnis and Mr. Merwarth also jointly conceived and developed a shuttle mechanism for use with a single stacker and a pair of tyers in which a carriage is driven in reciprocating motion first in one direction from a central position and back and then in the opposite direction from the central position and back by a double throw crank having a pair of connecting rods one end of which are connectd to separate, diametrically opposite crank pins and the opposite ends of which may be selectively engaged with the carriage to cause the motion specified.

An application Ser. No. 279,671, entitled "Stacker Tyer" jointly by Mr. Merwarth and Mr. McGinnis was filed concurrently herewith with claims to the subject matters they jointly conceived and developed.

Mr. Noll conceived and developed a tyer which can tie either bundles or logs by elevating a tie head together with a stack bottom support and which can tie either one or two straps around either with a single tie head by moving the stack laterally. Mr Noll also conceived and developed the mechanism for detecting when a tying operation has been successful. An application Ser. No. 279,621, entitled "Stacker Tyer" by Mr. Noll was filed concurrently with the present application with claims to the subject matter he conceived and developed.

What is claimed is:

1. An apparatus for receiving a continuous stream of sheet-like articles and for forming the stream into either short or tall stacks, said apparatus comprising a frame, a platform for supporting the bottom of a stack, deflector means connected with said frame for causing one of an incoming stream of sheet-like articles to drop onto said platform and for causing each succeeding incoming sheet-like article to pile up to form a stack on top of said one sheet-like article, means for guiding said platform in said frame along an inclined stacking path, means for moving said platform along said stacking path from an uppermost position in which said platform receives said one article downward to a lowermost position as the succeeding articles pile up, a stack support for receiving stacks from said platform, means for connecting said stack support with said frame adjacent the lowermost portion of the stacking path of said platform for receiving tall stacks from said platform, and means for connecting said stack support with said frame at a location between the uppermost and lowermost portions of the stacking path of said platform for receiving short stacks from said platform.

2. An apparatus as set forth in claim 1 wherein said platform for supporting the bottom of a stack includes a plurality of tines for supporting the bottom of a stack of articles.

3. An apparatus as set forth in claim 1 wherein said means for connecting said stack support with said frame at a location between the uppermost and lowermost portions of the stacking path includes means for removably connecting said stack support at said location.

4. An apparatus as set forth in claim 1 wherein said platform for supporting the bottom of a stack includes a plurality of tines, said tines of said platform moving in inclined paths as said platform moves along said stacking path, and said stack support includes a plurality of tines, said tines of said stack support extending between said paths of said tines of said platform.

5. An apparatus as set forth in claim 4 wherein said means for connecting said stack support with said frame at a location between the uppermost and lowermost portions of the stacking path includes means for removably connecting said stack support at said location.

6. An apparatus as set forth in claim 1 further including infeed conveyor means for receiving an incoming steam of sheet-like articles and directing said stream toward said deflector means.

7. An apparatus as set forth in claim 1 further including a plurality of said platforms for supporting the bottom of a stack of sheet-like articles and means for moving each of said platforms along said stacking path.

8. An apparatus as set forth in claim 1 wherein said means for guiding said platform in said frame along an inclined path includes a guide rail fixedly connected with said frame, and each of said platforms includes a pair of rotatably mounted wheels engaging opposite sides of said rail as said platform moves along said stacking path.

9. An apparatus as set forth in claim 8 further including means for causing each of said platforms to intercept said incoming stream of articles when the stack on the preceding platform has reached a predetermined size, said means including releasable restraining means for holding the succeeding platform out of the stream of articles until the stack on the preceding platform includes a selected number of articles and for thereafter releasing said platform into said stream.

10. An apparatus as set forth in claim 9 wherein each of said platforms is pivotably mounted and includes means for biasing said platform to a position generally perpendicular to said stacking path and said restraining means engages said platform and rotates said platform against the bias to a retracted position in which said platform forms an acute angle with said stacking path.

11. An apparatus for receiving a stream of sheet-like articles, forming the sheet-like articles into stacks and tying the stacks, said apparatus comprising stacking means for receiving an incoming stream of sheet-like articles and for building a series of stacks of said articles from said stream, first and second tying mechanisms for tying said stacks, said first and second tying mechanisms being located on opposite sides of said stacking means, and transfer means for moving each succeeding stack of said series of stacks laterally and alternately toward one or the other of said tying mechanisms and for maintaining the sheet-like articles forming each of said stacks in alignment while being moved toward one or the other of said tying mechanisms.

12. An apparatus as set forth in claim 11 wherein said transfer means includes means for moving each of said stacks out of the one of said tying mechanisms to which it had been moved.

13. An apparatus as set forth in claim 11 wherein each of said tying mechanisms is removable.

14. An apparatus as set forth in claim 11 wherein said transfer means includes pusher means for engagement with opposite generally vertical side portions of each one of said stacks during movement of said stacks from said stacking means to one of said tying mechanisms.

15. An apparatus as set forth in claim 11 wherein said transfer means includes stack support means for supporting the bottom and at least three sides of each of said stacks during movement from said stacking means to one of said tying mechanisms.

16. An apparatus as set forth in claim 15 wherein said stack support means includes plate means for supporting a first side of a stack during lateral movement, said plate means including plates connected with said stacking means and plates connected with each of said tying mechanisms, said plates being coplanar, inclined from vertical and parallel with the path of lateral movement of said stacks, a first side of each of said stacks resting against said plates connected with said stacking means and said plates connected with the one of said tying mechanisms toward which the stack is moved during lateral movement from said stacking means toward said one of said tying mechanisms.

17. An apparatus as set forth in claim 16 wherein said stack support means further includes bottom support means for supporting the bottoms of said stacks during lateral movement of said stacks from said stacking means to one of said tying mechanisms, said bottom support means being connected with said stacking means and each of said tying mechanisms and defining a plane parallel to the path of lateral movement of said stacks and perpendicular to the plane defined by said plate means.

18. An apparatus as set forth in claim 17 wherein said bottom support means includes a stack receiving support for receiving complete stacks from said stacking means and means for connecting said stack receiving support to said stacking means at a first location for receiving completed stacks which are tall and means for connecting said stack receiving means to said stacking means at a second location for receiving stacks which are short.

19. An apparatus as set forth in claims 15 or 17 wherein said stack support means includes first and second pusher means for engaging opposite sides of a stack and said transfer means includes drive means for moving said first and second pusher means together laterally in a first direction to move a stack toward a first one of said tying mechanisms away from said stacking means and for moving said first and second pusher means together laterally in a second direction for moving a stack away from said stacking means toward a second one of said tying mechanisms.

20. An apparatus as set forth in claim 11 wherein said stacking means includes compensator means for receiving a portion of each stack of said series of stacks of articles and rotating said portions whereby said stacking means build compensated stacks.

21. An apparatus for receiving a stream of sheet like articles, forming the sheet like articles into stacks and tying the stacks, said apparatus comprising stacking means for receiving an incoming stream of sheet like articles and for building a series of stacks of said articles from said stream, said stacking means including a frame, a platform for supporting the bottom of a stack, deflector means connected with said frame for causing one of the incoming stream of sheet like articles to drop onto said platform and for causing succeeding incoming sheet like articles to pile up to form a stack on top of said one sheet like article, means for guiding said platform in said frame along an inclined stacking path, means for moving said platform along said stacking path from an uppermost position in which said platform receives said one article downward o a lowermost position as the succeeding articles pile up, stack support means for receiving stacks from said platform, means for connecting said stack support with said frame adjacent the lowermost portion of the stacking path of said platform for receiving tall stacks from said platform, and means for connecting said stack support with said frame at a location between the uppermost and lowermost portions of the stacking path of said platform for receiving short stacks from said platform, first and second tying mechanisms for tying said stacks, said first and second tying mechanisms being located on opposite sides of said stacking means, and transfer means for moving each succeeding stack of said series of stacks laterally and alternately toward one or the other of said tying mechanisms and for maintaining the sheet like articles forming each of said stacks in alignment while being moved toward one or the other of said tying mechanism.

22. An apparatus as set forth in claim 21 wherein each of said tying mechanisms is removable.

23. An apparatus as set forth in claim 21 wherein said transfer means includes stack support means for supporting the bottom and at least three sides of each of said stacks during movement from said stacking means to one of said tying mechanisms.

* * * * *